US009126395B2

(12) United States Patent
Rossini

(10) Patent No.: US 9,126,395 B2
(45) **Date of Patent: *Sep. 8, 2015**

(54) BRIDGE SLEEVES WITH DIAMETRICALLY EXPANDABLE STABILIZERS

(71) Applicant: ROSSINI S.P.A., an Italian corporation, Rescaldina (IT)

(72) Inventor: Felice Rossini, Rescaldina (IT)

(73) Assignee: ROSSINI S.P.A., Milan (IT)

( * ) Notice: Subject to any disclaimer, the term of this patent is extended or adjusted under 35 U.S.C. 154(b) by 198 days.

This patent is subject to a terminal disclaimer.

(21) Appl. No.: 13/753,622

(22) Filed: Jan. 30, 2013

(65) Prior Publication Data

US 2013/0284037 A1 Oct. 31, 2013

Related U.S. Application Data

(60) Provisional application No. 61/640,277, filed on Apr. 30, 2012, provisional application No. 61/678,867, filed on Aug. 2, 2012, provisional application No. 61/757,440, filed on Jan. 28, 2013.

(51) Int. Cl.

| | |
|---|---|
| ***B41F 13/10*** | (2006.01) |
| ***B41F 3/18*** | (2006.01) |
| ***B41F 27/10*** | (2006.01) |

(52) U.S. Cl.

CPC ..... *B41F 3/18* (2013.01); *B41F 27/105* (2013.01); *B41P 2227/20* (2013.01)

(58) Field of Classification Search

CPC ..... B41F 13/08; B41F 13/10; B41F 27/06; B41F 27/14; B41F 27/105; B41F 27/1212; B41N 6/00; B41P 2227/20; B41P 2227/21

See application file for complete search history.

(56) References Cited

U.S. PATENT DOCUMENTS

| | | | | |
|---|---|---|---|---|
| 3,739,722 | A * | 6/1973 | Zottoli | 101/375 |
| 4,028,783 | A | 6/1977 | Buck | |
| 4,360,208 | A | 11/1982 | Hill et al. | |
| 4,583,460 | A | 4/1986 | Maslin et al. | |
| 5,036,766 | A | 8/1991 | Songer | |
| 5,499,780 | A | 3/1996 | Gensheimer | |
| 5,735,206 | A | 4/1998 | Rossini | |
| 5,782,181 | A | 7/1998 | Rossini | |
| 5,819,657 | A | 10/1998 | Rossini | |
| 5,840,386 | A | 11/1998 | Hatch et al. | |
| 5,904,095 | A | 5/1999 | Nelson | |
| 6,276,271 | B1 | 8/2001 | Busshoff | |
| 6,360,662 | B1 | 3/2002 | Busshoff | |
| 6,401,613 | B1 | 6/2002 | Gayle et al. | |
| 6,401,615 | B1 | 6/2002 | Heinicke | |
| 6,467,409 | B2 | 10/2002 | Busshoff | |
| 6,523,470 | B2 | 2/2003 | Kolbe et al. | |
| 6,640,711 | B2 | 11/2003 | Smoot et al. | |

(Continued)

FOREIGN PATENT DOCUMENTS

| | | | | |
|---|---|---|---|---|
| DE | 19940109 | * | 3/2001 | B41F 30/04 |
| DE | 10023742 | | 11/2001 | |
| EP | 0527293 | | 2/1993 | |

*Primary Examiner* — Blake A Tankersley

(74) *Attorney, Agent, or Firm* — Dority & Manning, P.A.

(57) ABSTRACT

A bridge sleeve has at each extreme end of the bridge sleeve, a multi-component stabilizer. One component of each stabilizer includes an inner cylindrical contacting surface having a diameter that changes as this respective component of the stabilizer moves axially relative to at least one other component of the respective stabilizer.

24 Claims, 32 Drawing Sheets

(56) References Cited

U.S. PATENT DOCUMENTS

| | | | |
|---|---|---|---|
| 6,647,879 | B1 | 11/2003 | Papadopoulos et al. |
| 6,669,613 | B1 | 12/2003 | Van Denend |
| 6,688,226 | B2 | 2/2004 | Rossini et al. |
| 6,691,614 | B2 | 2/2004 | Bell et al. |
| 6,725,775 | B2 | 4/2004 | Palmatier et al. |
| 6,782,821 | B2 | 8/2004 | Dilling et al. |
| 6,792,858 | B2 | 9/2004 | Kolbe et al. |
| 6,799,510 | B2 | 10/2004 | Sandstrom |
| 7,107,907 | B2 | 9/2006 | Vrotacoe |
| 7,124,685 | B2 | 10/2006 | Re et al. |
| 7,207,267 | B2 | 4/2007 | Salvestro et al. |
| 7,225,736 | B2 | 6/2007 | Blom et al. |
| 7,290,488 | B2 | 11/2007 | Petersen et al. |
| 7,624,680 | B2 | 12/2009 | Metrope |
| 7,900,559 | B2 | 3/2011 | Rasch et al. |
| 2007/0144381 | A1 | 6/2007 | Lorig et al. |

* cited by examiner

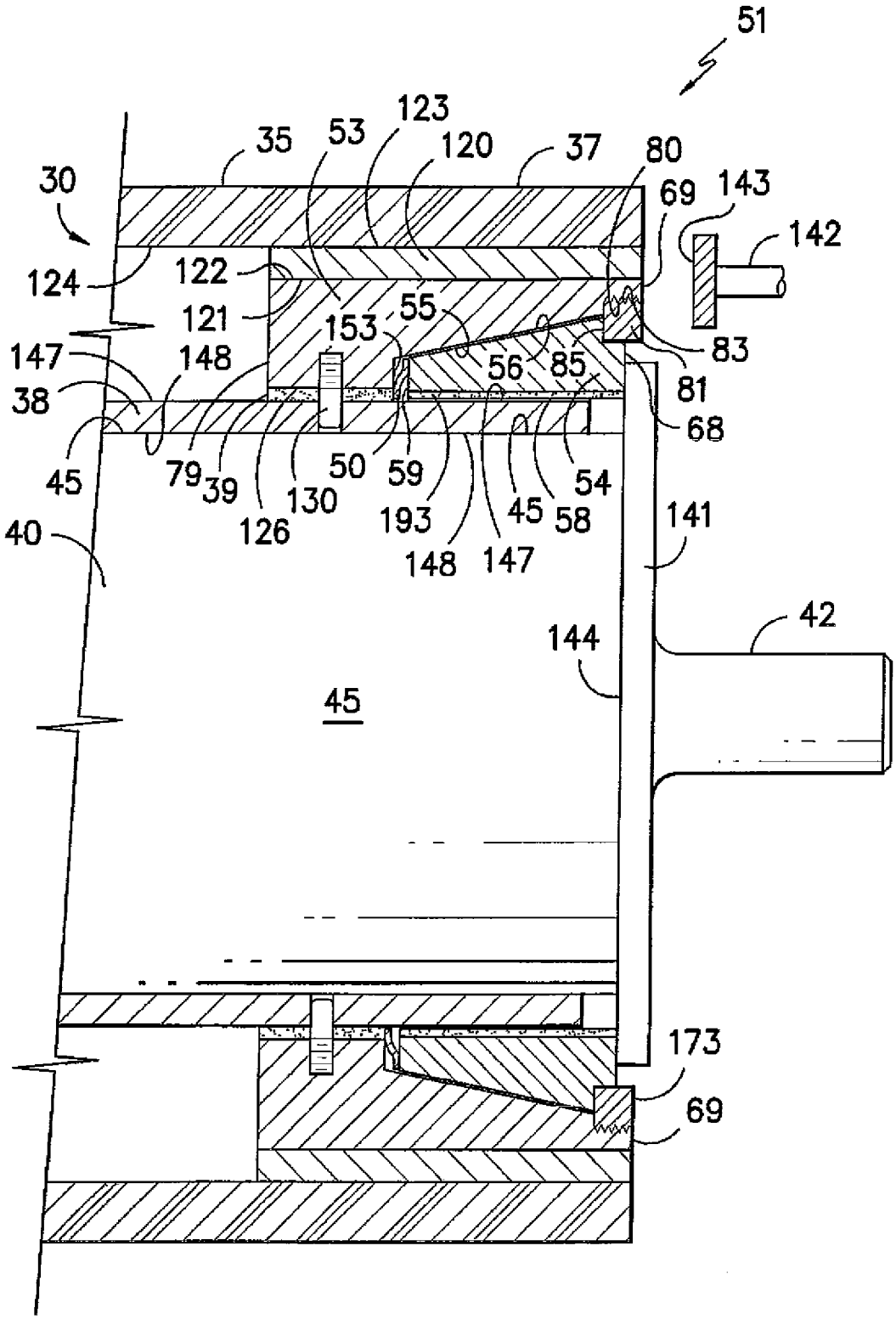
FIG. –28–

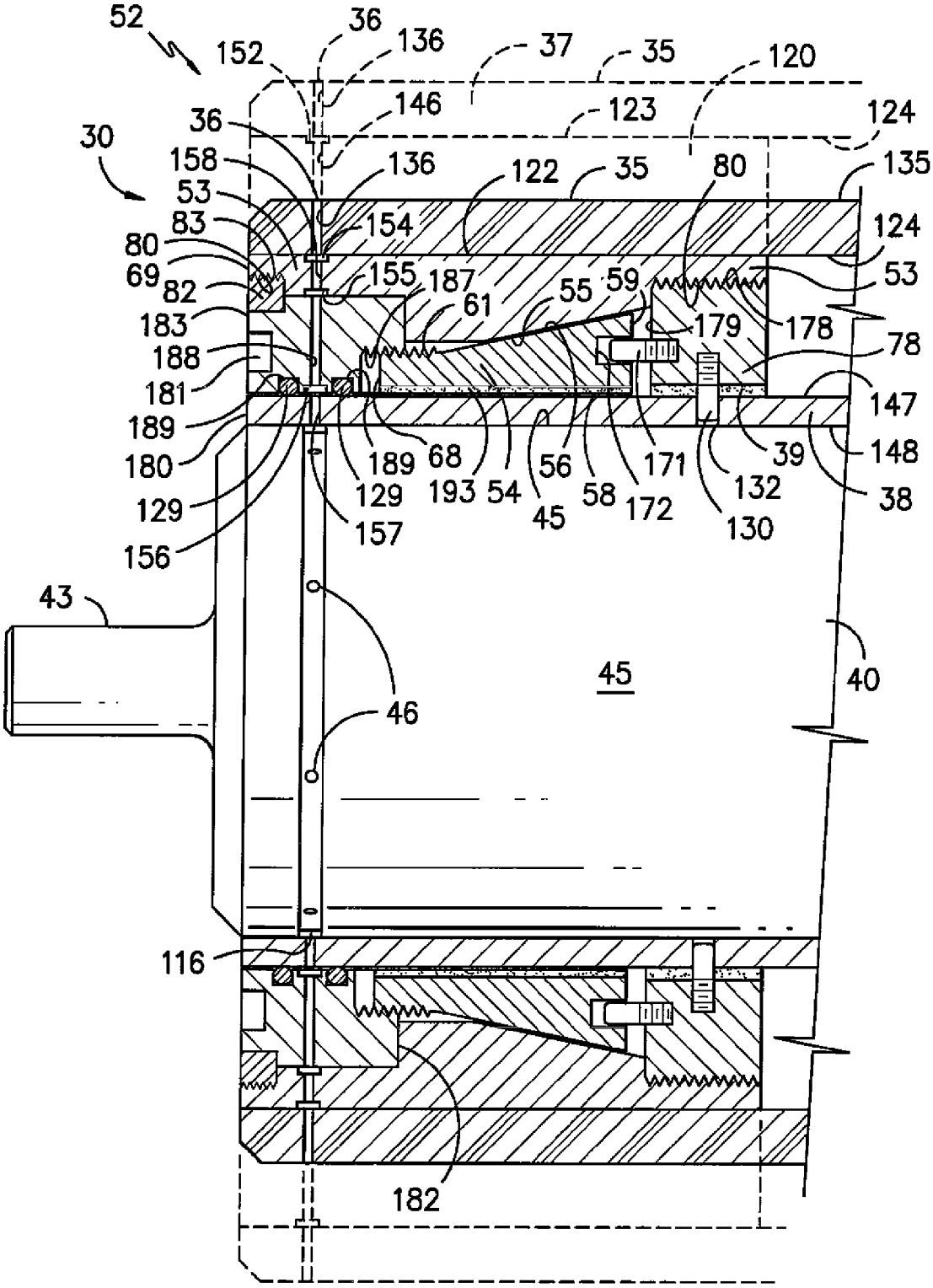
FIG. –29–

BRIDGE SLEEVES WITH DIAMETRICALLY EXPANDABLE STABILIZERS

CROSS REFERENCE TO RELATED APPLICATIONS

The present application claims priority to U.S. Provisional Patent Application Ser. Nos. 61/640,277 filed Apr. 30, 2012; 61/678,867 filed Aug. 2, 2012 and 61/757,440, filed Jan. 28, 2013, and each such provisional patent application is hereby incorporated herein in its entirety by this reference for all purposes.

FIELD OF THE INVENTION

The present invention relates to bridge sleeves (aka carrier sleeves, aka adapter sleeves) that themselves can be air mounted to the mandrel of a printing machine in the flexographic, offset or rotogravure printing field and that permit air mounting of a printing cylinder onto the bridge sleeves.

BACKGROUND OF THE INVENTION

Assuming that the outside diameter of the rotary mandrel of a printing machine in the flexographic, offset or rotogravure printing field is concentric with the mandrel's axis of rotation, then as the rotational speed of the print sleeve that is mounted on that mandrel increases, maintenance of adequate print quality increasingly depends on maintaining a fixed and invariable radial distance between the outside diameter of the rotary mandrel and the inside diameter of the print sleeve. If this radial distance varies, then print quality degrades. One type of degraded print quality takes the form of lightly inked or un-inked portions of the image alternating with darkly inked portions of the image. Another type of degraded print quality arises when portions of the image contain too much ink so as to decrease the desired resolution of that portion of the image on the substrate that advances past the printing surface of the print sleeve.

Variation in this desired fixed and invariable radial distance can occur if the print sleeve is subject to vibration as the print sleeve and the mandrel rotate. Such variation in the fixed and invariable radial distance can arise when an asymmetric printing surface of the print sleeve causes uneven pressure to be applied to the print sleeve, and this uneven pressure in turn causes a vibrational resonance effect to be transmitted to the bridge sleeve that results in the bridge sleeve becoming out of round as the print sleeve and the mandrel rotate. Such variation in the fixed and invariable radial distance can also occur for example due to the rotational inertia that acts on the bridge sleeve at very high run speeds and causes the bridge sleeve to become out-of-round as the print sleeve and the mandrel rotate.

In the flexographic, offset or rotogravure printing field, in order to increase the circumference of the printing surface without increasing the diameter of the rotary mandrel, it is known to use a bridge sleeve that is disposed between the outside cylindrical (or conical) surface of a rotary mandrel of the printing machine and the inside cylindrical (or conical) surface of an actual print sleeve, which carries on its outer cylindrical surface the data and/or images that are to be printed. The use of a bridge sleeve such as disclosed in commonly owned U.S. Pat. No. 5,782,181, which is hereby incorporated herein in its entirety for all purposes, enables various print developments to be achieved with the same rotary mandrel, without the need to replace this latter (generally of steel and hence heavy or of carbon fiber and hence costly) following a change in print development compared with the previous work carried out on the same printing machine.

However, a bridge sleeve that fails to serve as a rigid concentric attachment between the outside diameter of the rotary mandrel and the inside diameter of the print sleeve will fail to maintain a fixed and invariable radial distance between the outside diameter of the rotary mandrel and the inside diameter of the print sleeve and so result in the types of unsatisfactory print quality described above.

Various methods are known for mounting a conventional bridge sleeve (defined by a hollow cylinder with a through hole) onto a rotary mandrel of a printing machine. While mounting systems employing hydraulics and mounting systems employing mechanical connections are known, these typically are more cumbersome and heavier than a much used "air mounting" system that employs a conventional bridge sleeve that has an inner core layer, which though the inner core layer is slightly expandable in the radial direction, under atmospheric conditions the inner core layer defines an inner surface diameter slightly smaller than the diameter of the outer surface of the mandrel. The difference between these diameters enables an interference fit to be achieved between the mandrel of the printing machine and the conventional bridge sleeve. Positioning the conventional bridge sleeve at one end of the mandrel, compressed air is supplied (by known methods) between the outer surface of the mandrel and the inner surface of the bridge sleeve. The compressed air expands the diameter of the inner surface of the conventional bridge sleeve sufficiently to allow the bridge sleeve to slide over a cushion of air, a so-called air bearing, onto the outer surface of the mandrel. When the supply of compressed air is ended, the diameter of the inner surface of the conventional bridge sleeve shrinks sufficiently to allow the inner surface to grip the outer surface of the mandrel in an interference fit between the mandrel and the conventional bridge sleeve. Similarly, by again feeding compressed air onto the mandrel surface (by known methods), the inner surface of the conventional bridge sleeve can be slightly expanded to enable the conventional bridge sleeve to be released from the interference fit and removed from the mandrel.

Air-mountable bridge sleeves such as disclosed in commonly owned U.S. Pat. Nos. 5,819,657; 6,688,226; and 6,691,614, each of which being hereby incorporated herein in its entirety for all purposes, is usually made with a multi-layer body comprising a rigid outer cylinder made of carbon fiber and a cylindrical inner layer with an inner cylindrical surface that defines a bore with the diameter that is slightly smaller than the diameter of the outer surface of the mandrel. This type of conventional air-mounted bridge sleeve also includes at least one elastically compressible and radially deformable layer running the length of the bridge sleeve, and this compressible layer can be disposed against the outer cylindrical surface of the bridge sleeve's cylindrical inner layer. The compressed air acting against the inner surface of the inner layer of such a conventional bridge sleeve compresses this elastically compressible and radially deformable layer, which can be made of polyurethane foam for example, to enable the inner surface of the inner layer of the bridge sleeve to expand radially as it is being mounted on the outer surface of the mandrel.

However this elastic characteristic of the compressible layers of these air-mounted bridge sleeves works at cross purposes with the need for the bridge sleeve's outer surface to remain as rigidly fixed as possible with respect to the mandrel of the printing machine in order to resist the vibrations that are generated during operation of the modern printing machines that operate at very high run speeds. When the mandrel of such a printing machine rotates at speeds necessary to advance the substrate through the printing machine at line speeds of more than about 250 meters/minute, the non-uniform forces applied by the asymmetric printing surfaces of printing plates and/or the presence of the elastically compressible and radially deformable layer in a conventional bridge sleeve result(s) in machine vibrations that cause radial displacements of the bridge sleeve's outer surface with respect to the mandrel. These radially-directed displacements are transmitted to the printing surface of the print sleeve that is carried by the bridge sleeve, thereby causing the print sleeve to bounce against the substrate in rhythm with the vibrations instead of maintaining constant pressure contact with the substrate to be printed. The bouncing of the print sleeve against the substrate to be printed causes the printed image to include alternating regions where the image is printed darker than it should be followed by a region where the image is printed lighter than it should be printed. This bouncing also can cause some regions of the image to be too heavily inked and lose the desired resolution of the image. Accordingly, when these radial displacements of the bridge sleeve resulting from non-uniform pressures applied by the asymmetric surfaces of print sleeves and/or the deformation of the compressible layer do(es) arise, they compromise print quality to an unacceptable level by causing the type of banding or skipping described above to result from the bouncing of the print sleeve against the substrate.

These unacceptable radial displacements of the air-mounted bridge sleeve with compressible layers are more likely to arise as the sleeve's length and/or diameter increases. Nonetheless, printing machines that generate line speeds exceeding 250 meters/minute are becoming the norm, and a need exists for air-mountable bridge sleeves that produce acceptable print quality. Indeed, printing machines that generate line speeds exceeding 1,200 meters/minute are being put into service. Thus, as print line speeds increase and/or the diameters of the bridge sleeve must be increased in order to accommodate the larger print repeats that are needed to perform various print jobs, these air-mounted bridge sleeves requiring a lengthwise compressible layer fail to serve as a rigid concentric attachment between the outside diameter of the rotary mandrel and the inside diameter of the print sleeve.

Moreover, the elastically compressible and radially deformable layer running the length of the conventional bridge sleeve eventually degrades under even normal usage of a conventional bridge sleeve at lower line speeds below 250 meters/minute. Once this elastically compressible and radially deformable layer degrades, the entire bridge sleeve becomes useless and must be discarded, notwithstanding the continued viability of the remaining components such as the outer carbon fiber cylinder.

To eliminate the compressible layer (with its undesirable effects) of the air-mounted bridge sleeves, hydraulic systems have been developed for mounting bridge sleeves to the mandrel of a flexographic printing machine. One such hydraulic system for mounting a bridge sleeve on the rotary mandrel has been developed by Fischer & Krecke of Germany. This is an hydraulic system that requires a specially configured mandrel that has a smaller diameter on the operator side than on the motor side of the mandrel. The bridge sleeve has two end heads on which are mounted a carbon fiber cylinder. One end head defines a larger inner diameter that will fit over the larger diameter portion of the outer surface of the mandrel, and the other end head defines a smaller inner diameter that is nonetheless slightly larger than the smaller diameter portion of the outer surface of the mandrel at the operator end of the mandrel. At each end of the mandrel there is an expandable ring, the diameter of which expands and contracts according to the introduction or withdrawal of incompressible grease that is hydraulically used to expand or contract the rings. Each of these rings expands to contact the inner diameter of the steel insert at each end of a carbon fiber tube that forms the bridge sleeve.

Windmoeller Hoelscher of Germany has a mechanism that is similar to the Fischer & Krecke mechanism. The problem with each of these mechanisms is of course that as the rings expand and contract with usage, the rings become fatigued and their expansion eventually occurs non-uniformly so that they are not round relative to the central axis of the mandrel. Thus, over time the bridge sleeve rotates asymmetrically with the rotational axis of the mandrel, and this produces a bouncing motion of the bridge sleeve that causes the print quality to deteriorate as described above for the air-mounted bridge sleeves with the compressible layers. This deterioration is exacerbated as the speed of the web to be printed increases until the print quality is deemed unacceptable. Examples of unacceptable print quality include the presence of bands in the printed image that result from the bounce of the bridge sleeve as the rings that contact the inside diameter of the bridge sleeve no longer expand uniformly in perfect concentricity with the axis of rotation of the mandrel.

Another mechanical system for mounting a bridge sleeve on a rotary mandrel was developed by Paper Converting Machine Corporation of Green Bay, Wis. and is described in U.S. Pat. No. 6,647,879. In this PCMC system, the bridge sleeve has opposed hubs on which are mounted a carbon fiber cylinder. The internal diameter of each of these hubs is expanded and contracted by a semi-circular collar that has one end pivotally connected to its respective hub and the opposite end connected to its respective hub via an eccentric cam that opens and closes a pivoting clamp of the collar so that the inside diameter of the collar can be expanded and contracted by movement of the eccentric cam, which is connected to an external hex nut that can be turned to tighten the collar onto the mandrel or loosen the collar from the mandrel.

However, one drawback to this PCMC system is the steel-to-steel contact between the inside diameter of the collar and the outside diameter of the rotary mandrel. Whenever this bridge sleeve is slid onto the mandrel, there inevitably is some damage to the exterior surface of the mandrel by contact with the inside diameter of the collar. Moreover, due to the steel-to-steel contact between the inside diameter of the collar of each hub and the outside diameter of the mandrel, whenever there is a machine malfunction that results in a web wrap up event that prevents further advancement of the web being printed, the steel inside diameter of the collar will rotate with respect to the outside diameter of the mandrel. This metal-to-metal relative rotation mars the outside diameter of the mandrel by the involved steel-to-steel scraping. As much as a three inch circumferential scrape in the outside diameter of the mandrel can be anticipated by such events, requiring re-machining and repair of the mandrel at the expense of both the mandrel repair and the cost of the lost downtime of the printing machine.

Another disadvantage of this PCMC system is the fact that when the diameter of the bridge sleeve must be increased, a commensurate increase in the size of the hubs results in a significant increase in the weight of the bridge sleeve. Government workplace rules typically limit the weight of the bridge sleeve to no more than 50 pounds. Still another drawback to this PCMC system is the fact that the cam eventually starts to wear with use. Such wear then causes the collar to become loose and move with respect to the stabilizer. These movements cause the bridge sleeve to lose concentricity with the mandrel, which results in the bounce that causes deterioration of the print quality as described above. These unacceptable effects due to movement of the collar become more noticeable as the speed of rotation of the bridge sleeve increases and/or as the diameter and/or length of the bridge sleeve increases.

BRIEF DESCRIPTION OF THE INVENTION

Aspects and advantages of the invention are set forth below in the following description, or may be obvious from the description, or may be learned through practice of the invention. Those of ordinary skill in the art will better appreciate the features and aspects of such embodiments, and others, upon review of the specification.

One embodiment of the present invention includes an improved bridge sleeve with a rigid stabilizer at each opposite end of the sleeve that diametrically expands using compressed air for easy mounting of the sleeve onto the printing machine's mandrel. Another embodiment of the improved bridge sleeve also has at each opposite end of the sleeve a rigid stabilizer that can be selectively diametrically expanded and contracted by manual mechanical rotation of an end cap of at least one of the stabilizers and axially directed shimming action applied to the other of the stabilizers. Yet embodiments of the bridge sleeve of the present invention need not include the elastically compressible and radially deformable layer running the entire length of the conventional bridge sleeve. This improved bridge sleeve of the present invention nonetheless exhibits sufficiently high rigidity so as not to deform unacceptably during its use on the printing machine that is running line speeds as high as 1,200 meters per minute.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 28 schematically represents an elevated perspective view of another embodiment of the operator end of a bridge sleeve in accordance with another embodiment of the invention.

FIG. 29 schematically represents an elevated perspective view of another embodiment of the machine end of a bridge sleeve in accordance with the embodiment of FIG. 28.

DETAILED DESCRIPTION OF THE INVENTION

Figure 1:
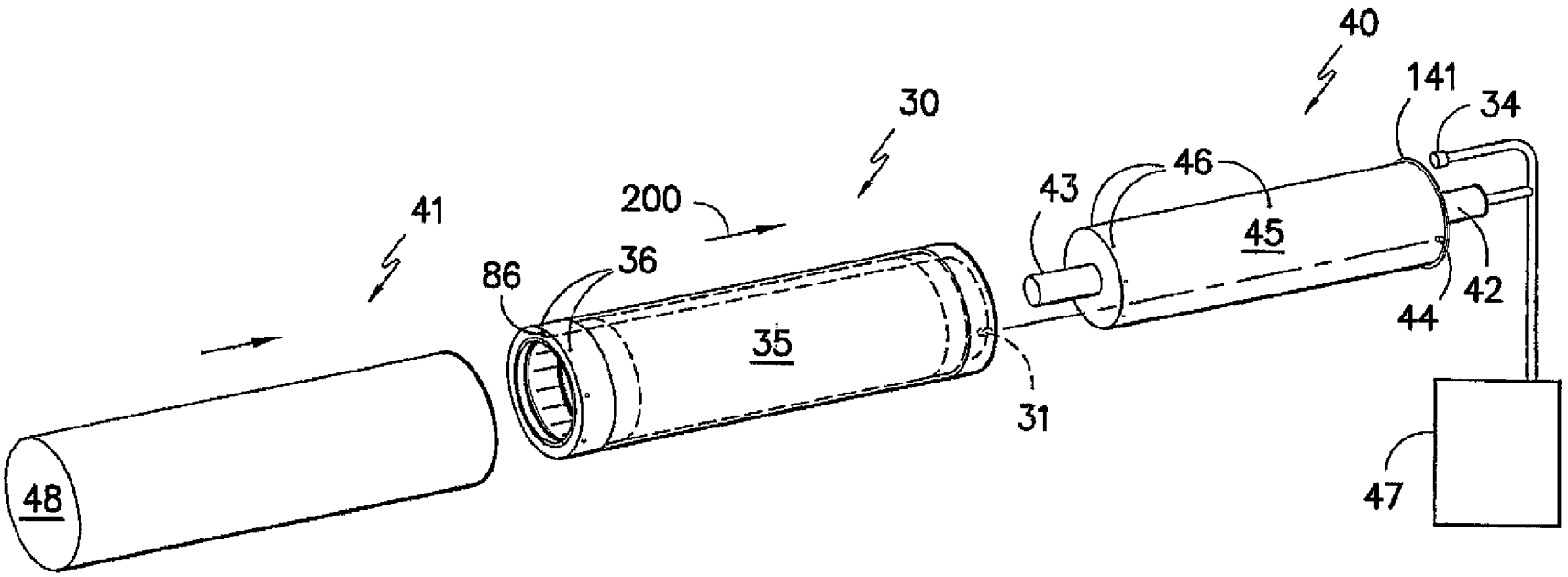
FIG. 1 schematically represents in an elevated perspective view, an embodiment of a bridge sleeve in accordance with the invention that is air-mountable on a mandrel of a printing machine housed in a plant where a supply of compressed air is available, and on which bridge sleeve a print sleeve can be air-mounted.

Reference will now be made in detail to exemplary embodiments of the invention, examples of which are illustrated in the accompanying drawings. The detailed description uses numerical and letter designations to refer to features in the drawings. Like or similar designations in the drawings and description have been used to refer to like or similar features.

Each example is provided by way of explanation of the invention, not limitation of the invention. In fact, it will be apparent to those skilled in the art that modifications and variations can be made in the present examples of the invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

References to the axial refer to the lengthwise direction in which the cylindrical sleeve or mandrel or annulus or ring elongates along an axis of rotation. References to the radial refer to the transverse direction in which the cylindrical sleeve or mandrel or annulus or ring extends outwardly or inwardly in a perpendicular direction relative to the axis of rotation. References to the circumferential refer to the tangential direction with respect to the cylindrical surface of the sleeve or mandrel or annulus or ring. A reference to the diameter of a surface refers to the diameter of the circle that defines the intersection of the surface with a plane that is normal to the axis of rotation of the surface. The meaning of additional reference terms will become apparent through their usages in the text that follows.

FIG. 1 schematically depicts an elevated view of an exemplary embodiment of a bridge sleeve 30 of the present invention. This bridge sleeve 30 is shown in relation to a mandrel 40 of a printing machine (not shown) and in relation to a print sleeve 41. As schematically shown in FIG. 1, the mandrel 40 has a journal at each opposite end that is axially aligned about the central axis of rotation of the mandrel 40. The so-called motor journal 42 is received in the printing machine and is located farthest away from the operator when the printing machine is in use. While the so-called operator journal 43 is on the end of the mandrel 40 that is closest to the operator when the printing machine is in use. The so-called machine end of the mandrel 40 has a registration pin 44 extending radially from the outer surface 45 of the mandrel 40 near where the machine end of the mandrel 40 defines an annular shoulder 141 (FIGS. 13, 26 & 28) that is present on many modern mandrels 40.

Figure 2:
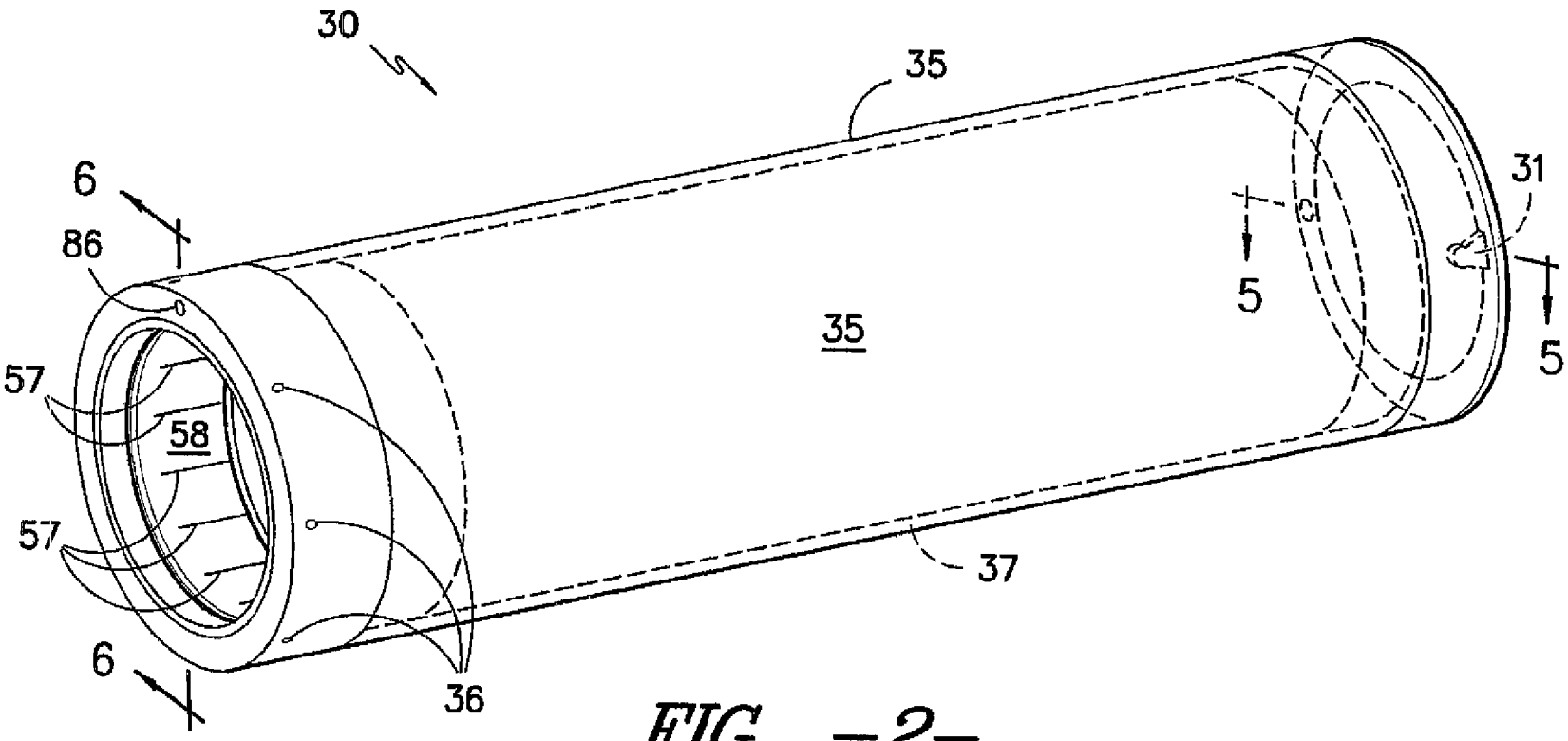
FIG. 2 schematically represents an elevated perspective view of an embodiment of a bridge sleeve in accordance with the invention.

As shown in FIGS. 1 and 2, the so-called machine end of the bridge sleeve 30 has a registration notch 31 that receives therein, the registration pin 44 of the mandrel 40 when the bridge sleeve 30 is properly aligned on the mandrel 40. As is conventional in the art, the so-called operator end of the mandrel 40 desirably can be provided with a circumferentially extending groove 116 (e.g., FIGS. 8C, 8D, 20, 27 and 29) and a plurality of air holes 46 through which compressed air can be supplied to the outer surface 45 of the mandrel 40 from a supply 47 of pressurized air that can be associated with the printing machine or can be available in the facility that houses the printing machine.

As shown in FIGS. 1 and 2, the so-called operator end of the bridge sleeve 30 is provided with a plurality of air holes 36 through which compressed air can be supplied to the outer surface 35 of the bridge sleeve 30 for mounting the print sleeve 41 (FIG. 1) onto the outer surface 35 of the bridge sleeve 30 by slightly expanding the diameter of the inner surface 48 of the print sleeve 41 and providing an air bearing between the inner surface 48 of the print sleeve 41 and the outer surface 35 of the bridge sleeve 30. This thin layer of compressed air that forms the co-called air bearing enables the operator to slide the print sleeve 41 axially over the outer surface 35 of the bridge sleeve 30. When the supply 47 of pressurized air is discontinued, the air layer disappears, the diameter of the inner surface 48 of the print sleeve 41 contracts to the diameter of the outer surface 35 of the bridge sleeve 30 and thus tightly grips the outer surface 35 of the bridge sleeve 30 in a manner that prevents both relative axial movement and circumferential movement between the print sleeve 41 and the bridge sleeve 30 under normal operating conditions of the printing machine.

The bridge sleeve 30 can be configured so that using only the compressed air that is supplied to the mandrel 40, the bridge sleeve 30 can be alternately air-mounted onto the mandrel 40 and dismounted from the mandrel 40. Alternatively, the bridge sleeve 30 can be configured for connection to a separate supply of compressed air from the compressed air that is supplied through the mandrel 40, and this separate supply of compressed air can be used to mount or dismount the bridge sleeve 30 onto the outer surface 45 of the mandrel 40.

The bridge sleeve 30 is further configured so that the print sleeve 41 can be air-mounted onto the outer surface 35 of the bridge sleeve 30. A so-called flow-through embodiment of the bridge sleeve 30 can be configured so that the compressed air that is supplied through the mandrel 40 flows radially through the bridge sleeve 30 and to the outer surface 35 of the bridge sleeve 30 and is used to mount the print sleeve 41 onto the outer surface 35 of the bridge sleeve 30. Alternatively, a so-called piped embodiment of the bridge sleeve 30 can be configured for connection to a separate supply of compressed air from the compressed air that is supplied through the mandrel 40, and this separate supply of compressed air is piped through the bridge sleeve 30, axially and radially, and used to mount the print sleeve 41 onto the outer surface 35 of the bridge sleeve 30 and alternately dismount the print sleeve 41 from the outer surface 35 of the bridge sleeve 30.

As shown in FIG. 2, the outer surface 35 of the bridge sleeve 30 is defined by the cylindrical outer surface of the rigid outermost layer 37 of the bridge sleeve 30. This rigid outermost layer 37 of the bridge sleeve 30 desirably is defined by a carbon fiber composite material that is rigid, light in weight and desirably as strong as steel. The carbon fiber in this rigid outermost layer 37 of the bridge sleeve 30 desirably is oriented parallel to the rotational axis of the bridge sleeve 30 in order to provide the rigid outermost layer 37 with maximum rigidity.

The bridge sleeve 30 desirably includes a stabilizer 51, 52 disposed near each opposite end of the bridge sleeve 30. The stabilizers 51, 52 can be actuated so that together they provide a rigid, concentric attachment and support between the outer surface 45 of the rotary mandrel 40 and the inner surface 48 of the print sleeve 41 that is mounted on the outer surface 35 of the bridge sleeve 30. However, in order to be able to mount and dismount the bridge sleeve 30 to and from, respectively, the mandrel 40, a mechanism is provided to expand the diameter of the inner contacting surface 58 of each stabilizer 51, 52 sufficiently to permit the bridge sleeve 30 to slide axially over the outer surface 45 of the mandrel 40 without contact between the outer surface 45 of the mandrel 40 and the inner contacting surface 58 of each stabilizer 51, 52. The variance in the diameter of the inner contacting surface 58 of each stabilizer 51, 52 desirably can range between slightly less than the diameter of the outer surface 45 of the mandrel 40 of the intended printing machine and a diameter that is about 0.4 millimeters larger than the diameter of the outer surface 45 of the mandrel 40 of the intended printing machine. Larger diametric ranges also can be accommodated. The inclusion of these rigid stabilizers 51, 52 assures that the radial distance between the bridge sleeve's rigid outer surface 35, which can be formed of a carbon fiber cylinder, and the equally rigid outer surface 45 of the mandrel 40 of the printing machine remains unvarying and constant, even at line speeds in excess of 1,200 meters per minute.

Figure 3:
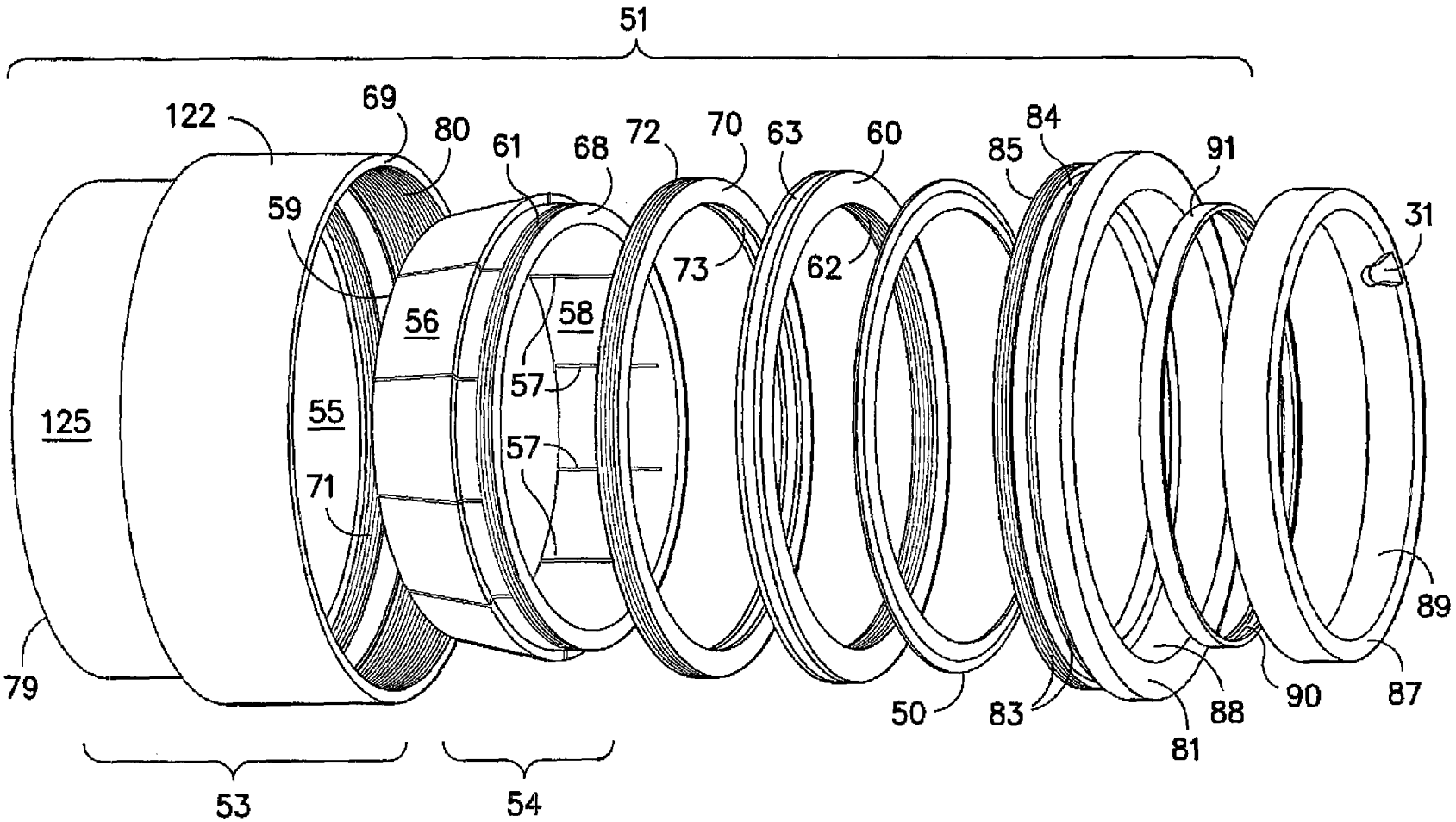
FIG. 3 schematically represents an unassembled perspective view of an embodiment of a stabilizer for the machine end of an embodiment of a bridge sleeve, showing the fully expanded slots that indicate the maximum inner diameter of the stabilizer.
Figure 5:
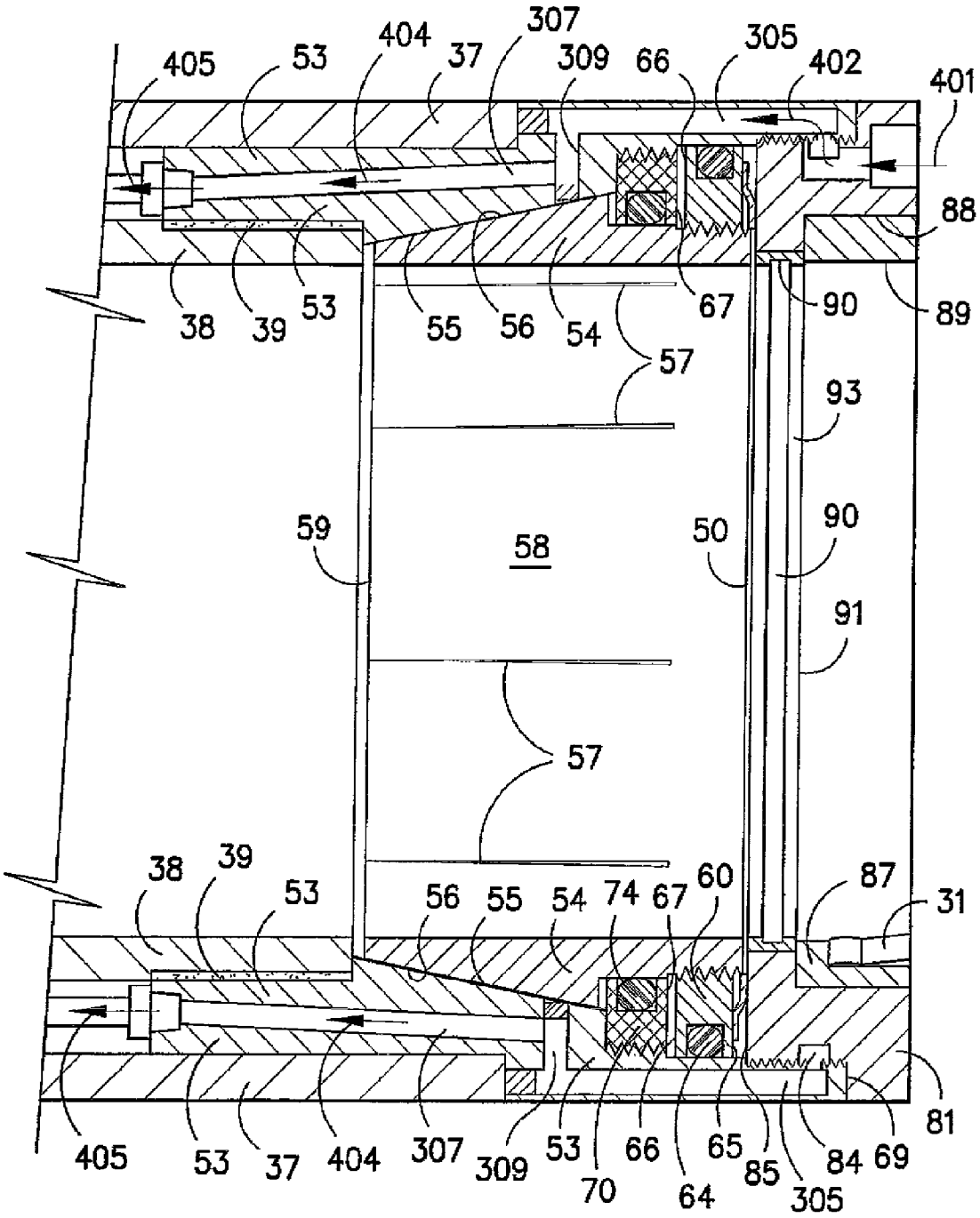
FIG. 5 schematically represents a cross-section of an embodiment of the stabilizer of FIG. 3 taken along the lines 5-5 in FIG. 2 at the machine end of the bridge sleeve before it is being mounted on the mandrel, showing the pinched slots that minimize the inner diameter of the stabilizer.
Figure 6:
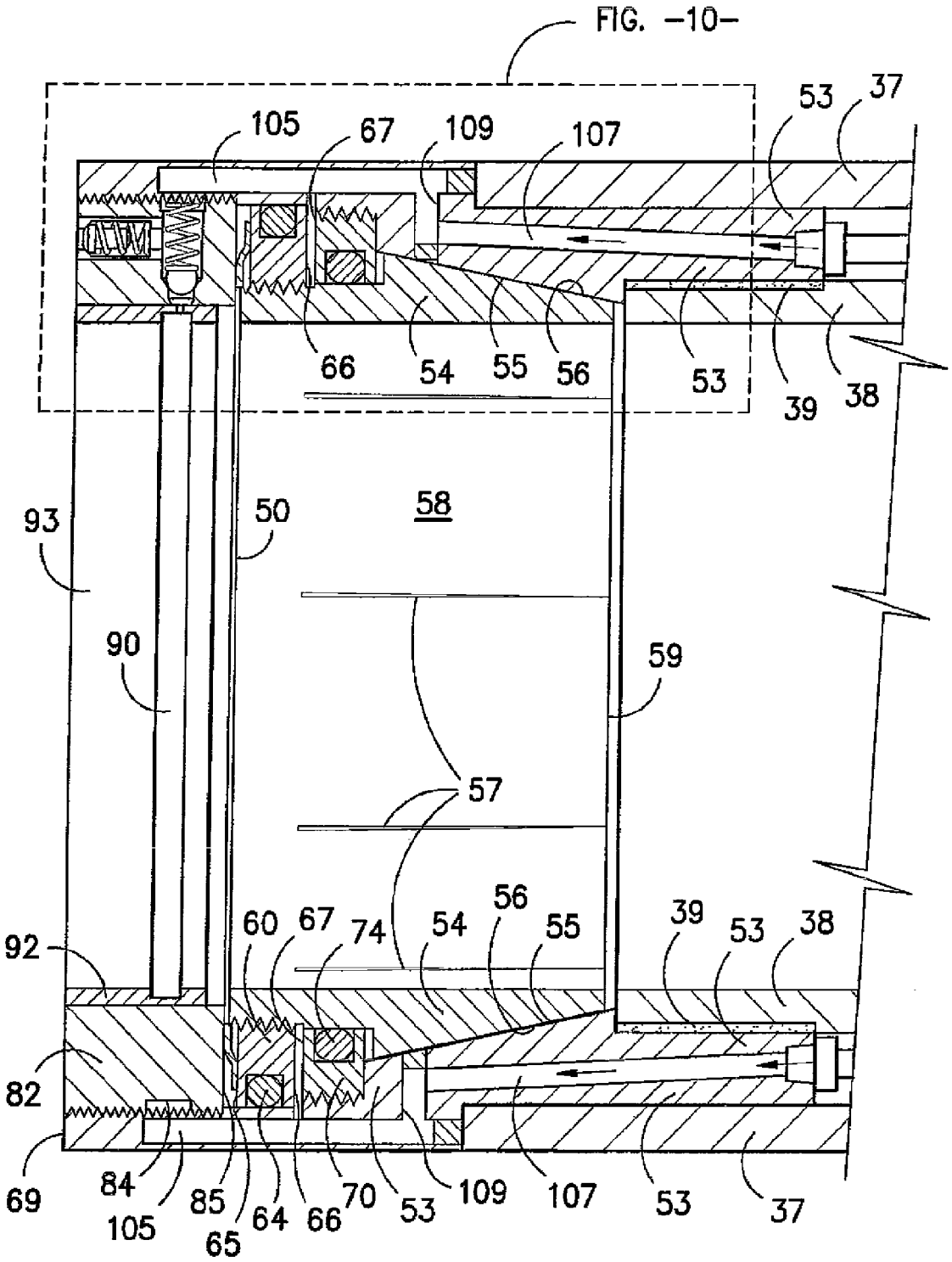
FIG. 6 schematically represents a cross-section of an embodiment of the stabilizer of FIG. 3 taken along the lines 6-6 in FIG. 2 at the operator end of the bridge sleeve before it is being mounted on the mandrel, showing the pinched slots that minimize the inner diameter of the stabilizer.

An embodiment of a first stabilizer 51 that desirably is disposed near the machine end of an embodiment of a bridge sleeve 30 is shown with its components in a disassembled state in FIG. 3. Similarly, an embodiment of a second stabilizer 52 that desirably is disposed near the operator end of an embodiment of a bridge sleeve 30 is shown with its components in a disassembled state in FIG. 4. A cross section taken through the machine end of the bridge sleeve 30 depicted in FIG. 2 is shown in FIG. 5 with the components of the first stabilizer 51 in their assembled arrangement. Similarly, a cross section taken through the operator end of the bridge sleeve 30 depicted in FIG. 2 is shown in FIG. 6 with the components of the second stabilizer 52 in their assembled arrangement.

Figure 4:
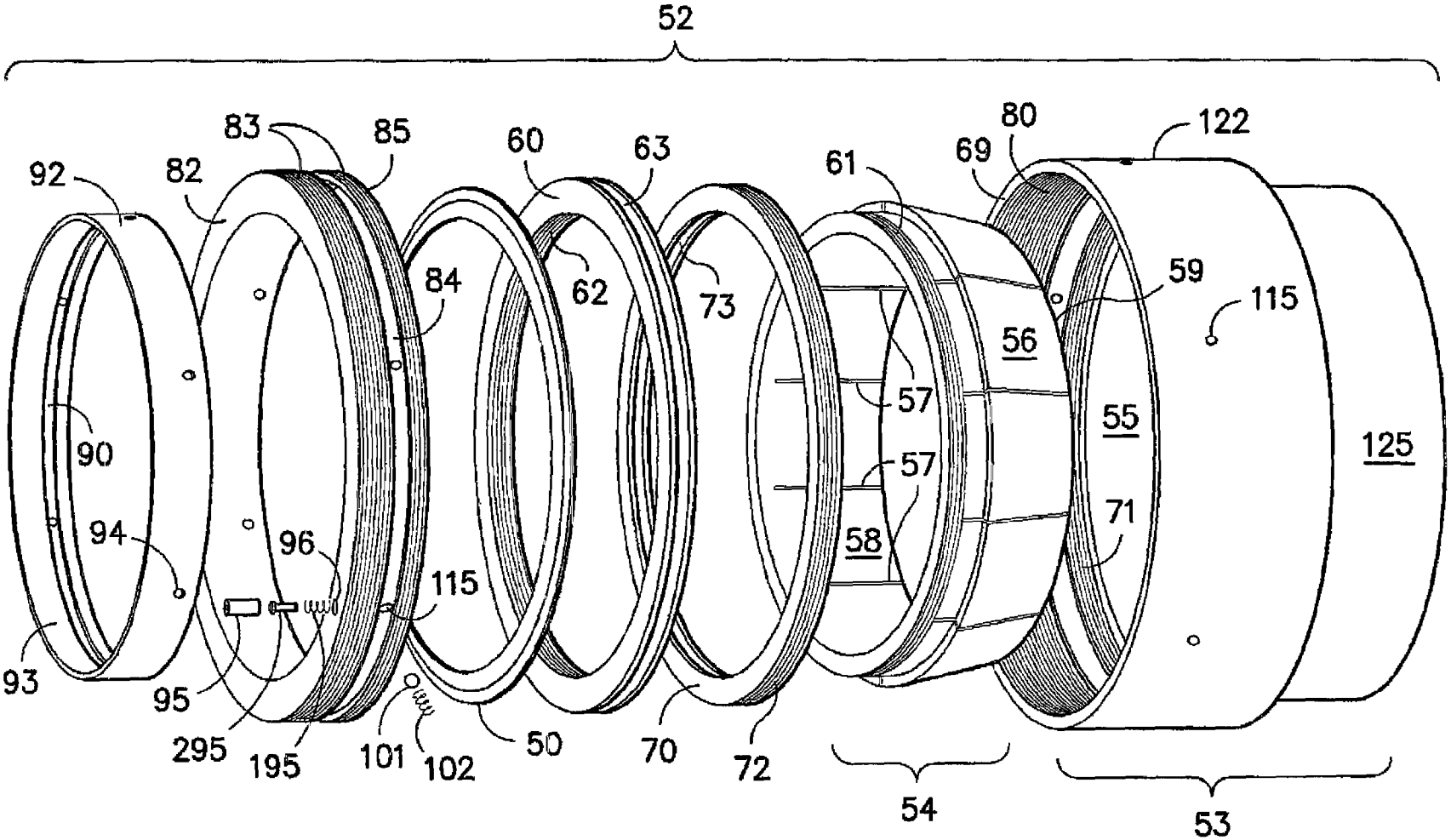
FIG. 4 schematically represents an unassembled perspective view of an embodiment of a stabilizer for the operator end of an embodiment of the bridge sleeve, showing the fully expanded slots that indicate the maximum inner diameter of the stabilizer.

As shown in FIGS. 3 and 4, each respective stabilizer 51, 52 includes an outer shell 53 and an inner shell 54 that is configured to nest at least partially within the outer shell 53. The outer shell 53 and the inner shell 54 of each of the stabilizers 51, 52 desirably is formed of rigid incompressible material such as steel or carbon fiber composite material. In an embodiment depicted in FIGS. 5 and 6 for example, the outer shell 53 is fixed with respect to the rigid outermost layer 37 of the bridge sleeve 30, and in the embodiments shown in FIGS. 5 and 6 the inwardly facing end of the outer shell 53 is shown to be directly connected to one end of the cylindrical rigid outer cylindrical layer 37 of the bridge sleeve 30. Thus, the outer shell 53 is sometimes referred to as the rigid holder body because it rigidly carries and holds one end of the rigid outermost layer 37 of the bridge sleeve 30.

Likewise, each outer shell 53 desirably is connected to one end of the radially expandable cylindrical inner core 38 of the bridge sleeve 30. As shown in FIGS. 5 and 6 for example, a compressible layer 39 desirably is disposed between the end of the outer surface of the inner core 38 and the outer shell 53 of each stabilizer 51, 52. As shown in FIGS. 5 and 6, the outer shell 53 defines an axially extending inner cavity that is partially defined by a rigid inner surface with a section defining an inner conical surface 55, which desirably has a diameter that increases as one moves inwardly from the end of the outer shell 53 where the outer shell 53 is connected to the radially expandable inner core 38 of the bridge sleeve 30.

Unlike the outer shell 53, the inner shell 54 of each stabilizer 51, 52 is not fixed with respect to either the outer shell 53 or either of the inner core 38 or the rigid outer layer 37 of the bridge sleeve 30. The inner shell 54 is defined in part by a section that has conically shaped surface 56 in a manner that complements the shape of the inner conical surface 55 of the outer shell 53 and is disposed to butt and slide against the inner conical surface 55 of the outer shell 53. Thus, the outer conical surface 56 of the inner shell 54 of each stabilizer 51, 52 nests within the inner conical surface 55 of the outer shell 53 and thus is axially, moveably received within the respective axially extending inner cavity of the respective rigid outer shell 53.

As shown in FIGS. 3-6, the section of the inner shell 54 that has the conical outer surface 56 defines a plurality of slots 57 that extend completely through the inner shell 54 from the conical surface 56 through the inner contacting surface 58 that defines a portion of the inner bore that extends axially completely through the bridge sleeve 30. In the embodiments shown in FIGS. 3-6, each slot 57 extends axially from the inward-facing edge 59 of the inner shell 54 that defines the narrower free end of the conical surface 56 and extends toward the opposite edge but not completely through the opposite edge, desirably terminating about one-sixth of the way from the opposite edge of the inner shell 54, which is the outwardly-facing edge 68. In the embodiments shown in FIGS. 23-25, each circumferentially alternating slot 57 extends axially from the outwardly-facing edge 68 of the inner shell 54 and extends toward the opposite inward-facing edge 59 but not completely through the inward-facing edge 59, desirably terminating about one-sixth of the way from inward-facing edge 59 of the inner shell 54. Though not shown in the FIGs., all of the slots 57 could be configured to extend axially from the outwardly-facing edge 68 of the inner shell 54 and extends toward the opposite inward-facing edge 59 but not completely through the inward-facing edge 59, desirably terminating about one-sixth of the way from inward-facing edge 59 of the inner shell 54.

In the embodiments shown in FIGS. 3 and 4 for example, there is a threaded surface 61 on the exterior of the unslotted section of the inner shell 54. This threaded surface 61 receives a complementarily threaded surface 62 on the interior of an inner shell ring 60 so that the inner shell ring 60 can be screwed onto the inner shell 54 and mechanically attached thereto to form a combined integral structure. Thus, axial movement of the inner shell ring 60 necessarily drags the inner shell 54 axially in the same direction as the axial movement of the inner shell ring 60 and vice-versa. As shown in FIGS. 3 and 4, a groove 63 is configured in the exterior surface of the inner shell ring 60, and this groove 63 is configured to receive a pressure sealing O-ring 64. The O-ring 64 is shown in the views of FIGS. 5 and 6 but not in the views of FIGS. 3 and 4.

In the embodiments shown in FIGS. 3 and 4 for example, there is a threaded surface 71 on the interior section of the outer shell 53 that is disposed adjacent the widest diameter portion of the conical surface 55 of the outer shell 53. This threaded surface 71 receives a complementarily threaded surface 72 on the exterior of an outer shell ring 70 so that the outer shell ring 70 can be screwed onto the outer shell 53 and mechanically attached thereto to form a combined integral structure. Thus, once screwed to the outer shell 53, the outer shell ring 70 necessarily remains fixed in position with the outer shell 53 and thus is sometimes called the fixed ring 70. As the inner shell ring 60 can be displaced with respect to the fixed ring 70, the inner shell ring 60 is sometimes called the displacement ring 60. As shown in FIGS. 3 and 4, a groove 73 is configured in the interior surface of the outer shell ring 70, and this groove 73 is configured to receive a pressure sealing O-ring 74. The O-ring 74 is shown in the views of FIGS. 5 and 6 but not in the views of FIGS. 3 and 4.

In the embodiments shown in FIGS. 3-6 for example, each of the stabilizers 51, 52 desirably includes a resiliently flexible biasing member, such as a conical spring 50, and a respective end cap 81, 82, which desirably is formed as an annular ring member. In the embodiments shown in FIGS. 3 and 4 for example, a machine end cap 81 forms part of the machine end stabilizer 51, while an operator end cap 82 forms part of the operator end stabilizer 52. As shown in FIGS. 3 and 4 for example, there is a threaded surface 80 on the interior section of the outer shell 53, and that interior section is disposed adjacent the outwardly facing free edge 69 of the outer shell 53. This threaded surface 80 receives a complementarily threaded surface 83 on the exterior of the respective end cap 81, 82 so that the respective end cap 81, 82 can be screwed onto the outer shell 53 and mechanically attached thereto to form a combined integral structure. Thus, once screwed to the outer shell 53, the respective end cap 81, 82 necessarily remains fixed in position with the outer shell 53 and provides a backstop against axial movement of one end of the conical spring 50.

In the embodiments shown in FIGS. 5 and 6, the conical spring 50 is disposed in an annular space that is defined between the inwardly facing end 85 of the respective end cap 81, 82 and the outwardly facing side 65 of the respective inner shell ring 60. The conical spring 50 thus tends to bias the integrally connected inner shell ring 60 and inner shell 54 in the axial direction toward the axial center of the bridge sleeve 30 so that the conical surface 56 of the inner shell 54 slides against the conical surface 55 of the outer shell 53. Because the outer shell 53 remains immovable, the slots 57 of the inner shell 54 narrow to accommodate the axial movement of the inner shell 54 away from the conical spring 50 and toward the conical surface 55 of the outer shell 53 with the result that the diameter of the inner contacting surface 58 of the inner shell 54 becomes diminished. The normal gap between the opposed walls defining each of the slots 57 of the inner shell 54 in an unstressed state is depicted in FIGS. 3 and 4. However, the relatively narrowed gap between the opposed walls defining each of the slots 57 of the inner shell 54 is depicted in FIGS. 5 and 6.

In the embodiments shown in FIGS. 3-6 for example, each end cap 81, 82 desirably is provided with a respective air capture ring 91, 92. Each air capture ring 91, 92 desirably is provided with an air capture groove 90 extending circumferentially around the entire the inner surface 93 thereof. Each air capture ring 91, 92 desirably is formed of material having very low static and dynamic friction coefficients (for example between about 0.045 and about 0.050) so that the inner surface 93 of each air capture ring 91, 92 readily slides over the outer surface 45 of the mandrel 40. The material forming each air capture ring 91, 92 desirably is rigid and is not radially deformable and desirably can be known material of very low friction coefficient such as molybdenum dichloride or nylon or polytetrafluoroethylene.

As shown in FIGS. 3 and 5, for example, a notch ring 87, which desirably is formed of metal, desirably is press fitted into an annular recess 88 formed in the interior circumferential surface of the annular machine end cap 81 and has defined therein the registration notch 31. As shown in FIG. 5 for example, the diameter of the opening that is defined by the inner cylindrical surface 89 of the notch ring 87 desirably is configured to be larger than the diameter of the outer surface 45 of the mandrel 40 so that the notch ring 87 easily slides over the cylindrical outer surface 45 of the mandrel 40 without touching the outer surface 45 of the mandrel 40.

Referring to FIGS. 3 and 5 for example, assembly of the embodiment of the first stabilizer 51 depicted therein proceeds by initially inserting the conical end 59 of the inner shell 54 into the outer shell 53 so that the two complementarily shaped conical surfaces 55, 56 of the respective shells 53, 54 touch one another. Next the sealing gasket O-ring 74 is inserted in the groove 73 in the outer shell ring 70. The outer shell ring 70 is inserted with the sealing gasket O-ring 74 touching the sliding surface of the inner shell 54 and is screwed into the complementary threads on an inner surface of the outer shell 53 via the threads formed on the outer surface of the outer shell ring 70. Next, the sealing O-ring 64 is inserted in the groove 63 in the inner shell ring 60. The inner shell ring 60 is screwed onto the complementary threaded surface at the non-conical end of the inner shell 54. Next, the conical spring 50 is inserted against the outwardly facing side 65 of the inner shell ring 60. Next, the outer threads on the inner section of the machine end cap 81 is screwed into the complementary threads on the inner surface of the outer shell 53 to back stop the conical spring 50 that biases the axial position of the inner shell 54 toward the center of the bridge sleeve 30. The air capture ring 91 is press-fitted into the machine end cap 81. As shown in FIG. 3, the registration notch 31 is defined in a portion of the inner surface of the notch ring 87, and the outer surface of the notch ring 87 is glued to and/or press-fitted into the inner surface of the machine end cap 81. With the exception of the notch ring 87, the assembly of the second stabilizer 52 proceeds in a fashion similar to that of the aforementioned assembly of the first stabilizer 51.

The bridge sleeve 30 desirably includes two separate pressurized air circuits that receive pressurized air from a source outside of the bridge sleeve 30. One of these two pressurized air circuits is configured to actuate the expansion mechanisms that expand the diameter of the inner contacting surface 58 of the inner shell 54 of each of the stabilizers 51, 52 so that the bridge sleeve 30 alternately can be air-mounted onto or removed from the mandrel 40. The other one of these two pressurized air circuits is configured to provide pressurized air to the air holes 36 at the outer surface 35 of the bridge sleeve 30 to provide a cushion of air that expands the diameter of the inner surface 48 of the print sleeve 41 so that the print sleeve 41 can slide just above the outer surface 35 of the bridge sleeve 30 and thereby alternately become air-mounted onto or removed from the outer surface 35 of the bridge sleeve 30.

Figure 7:
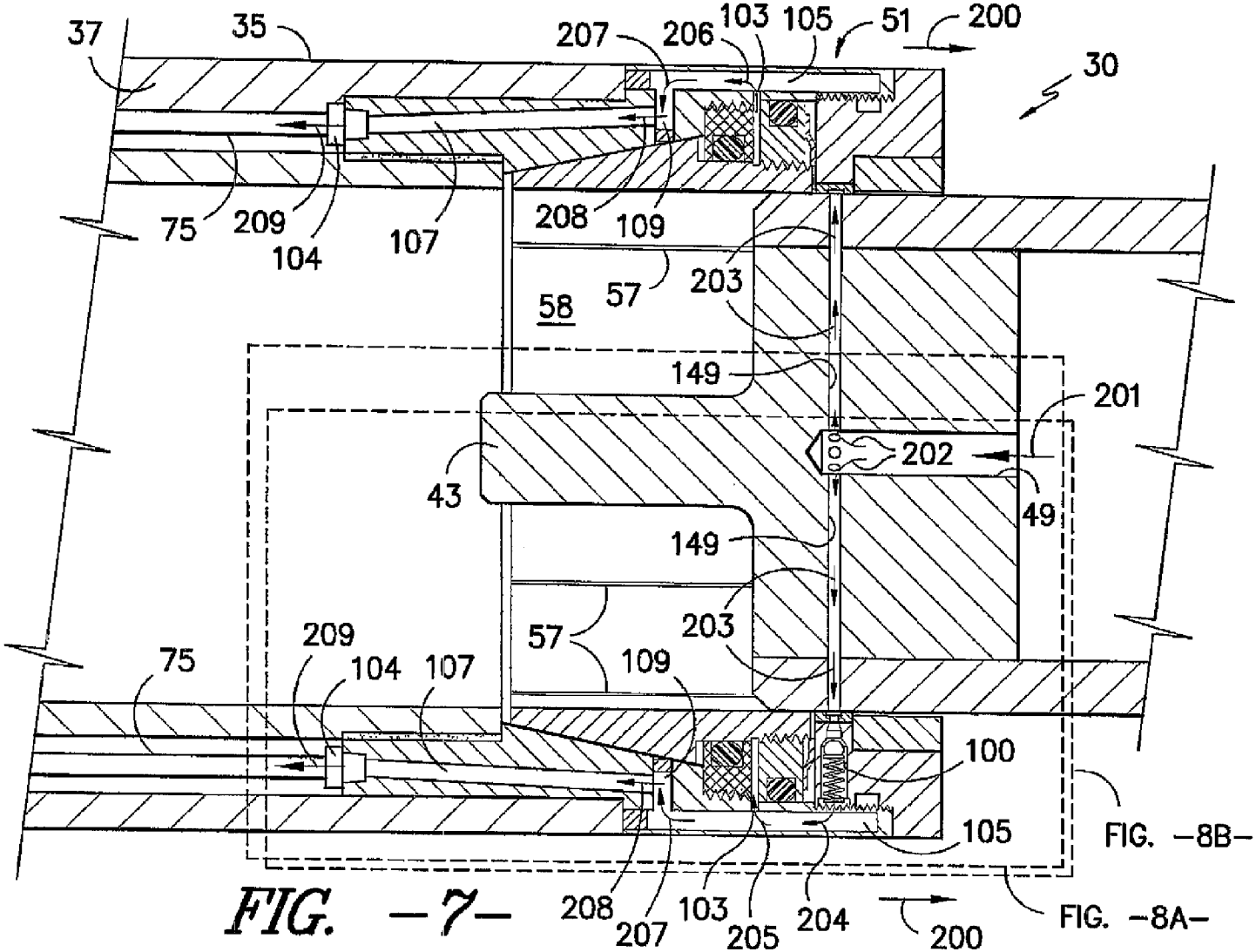
FIG. 7 schematically represents a cross-sectional view of an embodiment of components of the machine end of a bridge sleeve being air mounted onto the operator end of the mandrel.

FIG. 7 depicts a cross-sectional view of the machine end of a bridge sleeve 30 while the entrance opening to the pressurized air circuit that actuates the diametric variation of the inner contacting surfaces 58 of the stabilizers 51, 52 becomes positioned in communication with the air holes 46 through the outer surface 45 at the operator end of the mandrel 40 while the pressurized air is being supplied through the mandrel 40 to the air holes 46. Note that the cross-section depicted in FIG. 7 differs from the cross-section depicted in FIG. 5 and desirably is rotated 90 degrees from the cross-section depicted in FIG. 5.

Figure 8A:
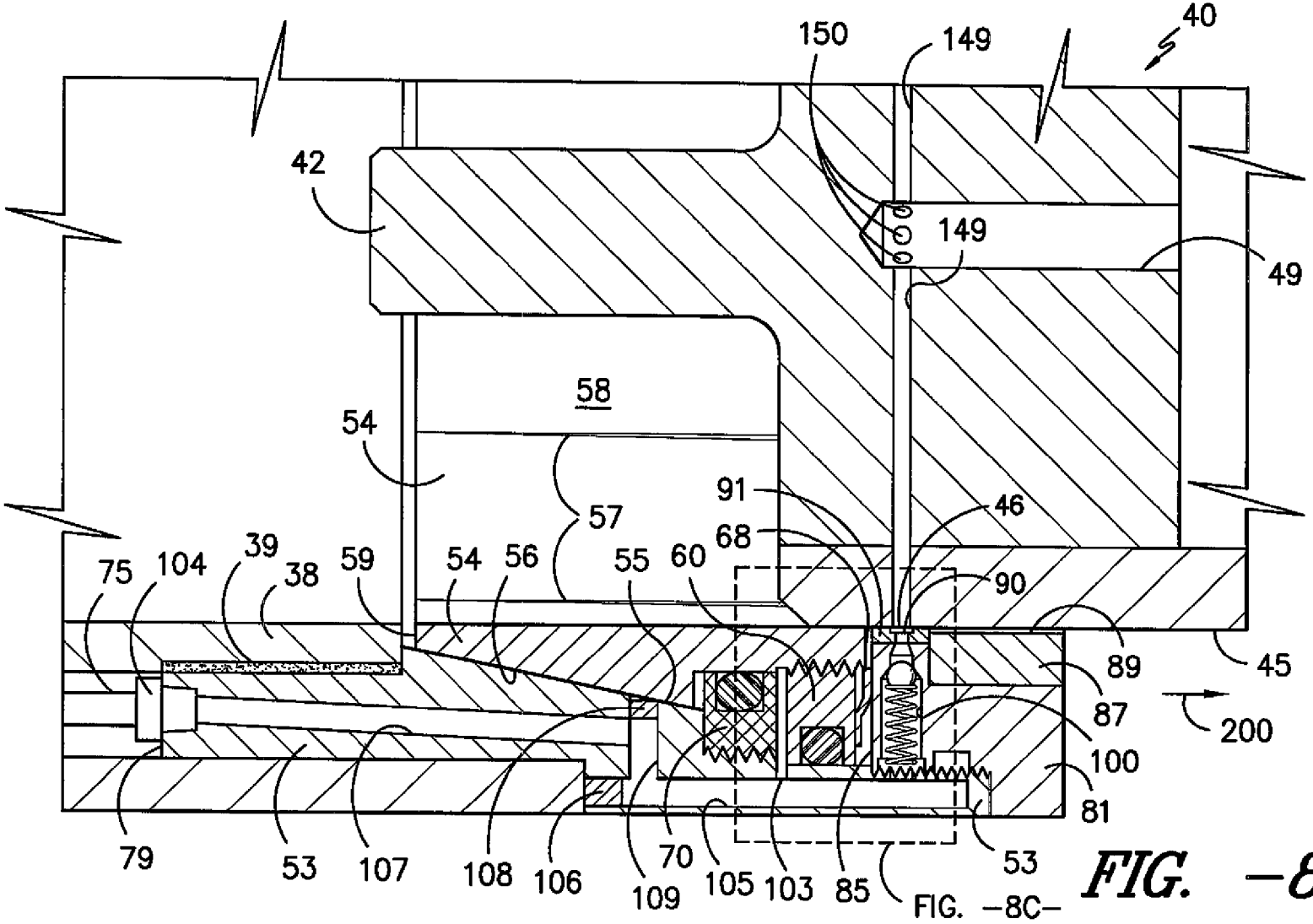
FIG. 8A shows an enlarged partial cross-section of the machine end of the bridge sleeve shown in FIG. 7 being mounted on the mandrel before the pressurized machine air is supplied to the mandrel.

FIG. 8A is an enlarged detailed view taken from FIG. 7 at a time just before the pressurized air is supplied through the mandrel 40. In FIGS. 1 and 8A for example, the arrow designated 200 schematically illustrates the direction in which the bridge sleeve 30 is being pushed onto the stationary mandrel 40 by an operator. Note that in the operational state depicted in FIG. 8A, the conical spring 50 is configured at its minimal state of compression so that the axial distance between the inwardly facing end 85 of the end cap 81 and the outwardly facing side 65 of the inner shell ring 60 is at its maximum distance. As shown in FIG. 8A, the gap that exists between the outer surface 45 of the mandrel 40 and the inner surface 89 of the notch ring 87 permits enough clearance so that the notch ring 87 slides easily over the outer surface 45 of the mandrel 40.

Figure 8B:
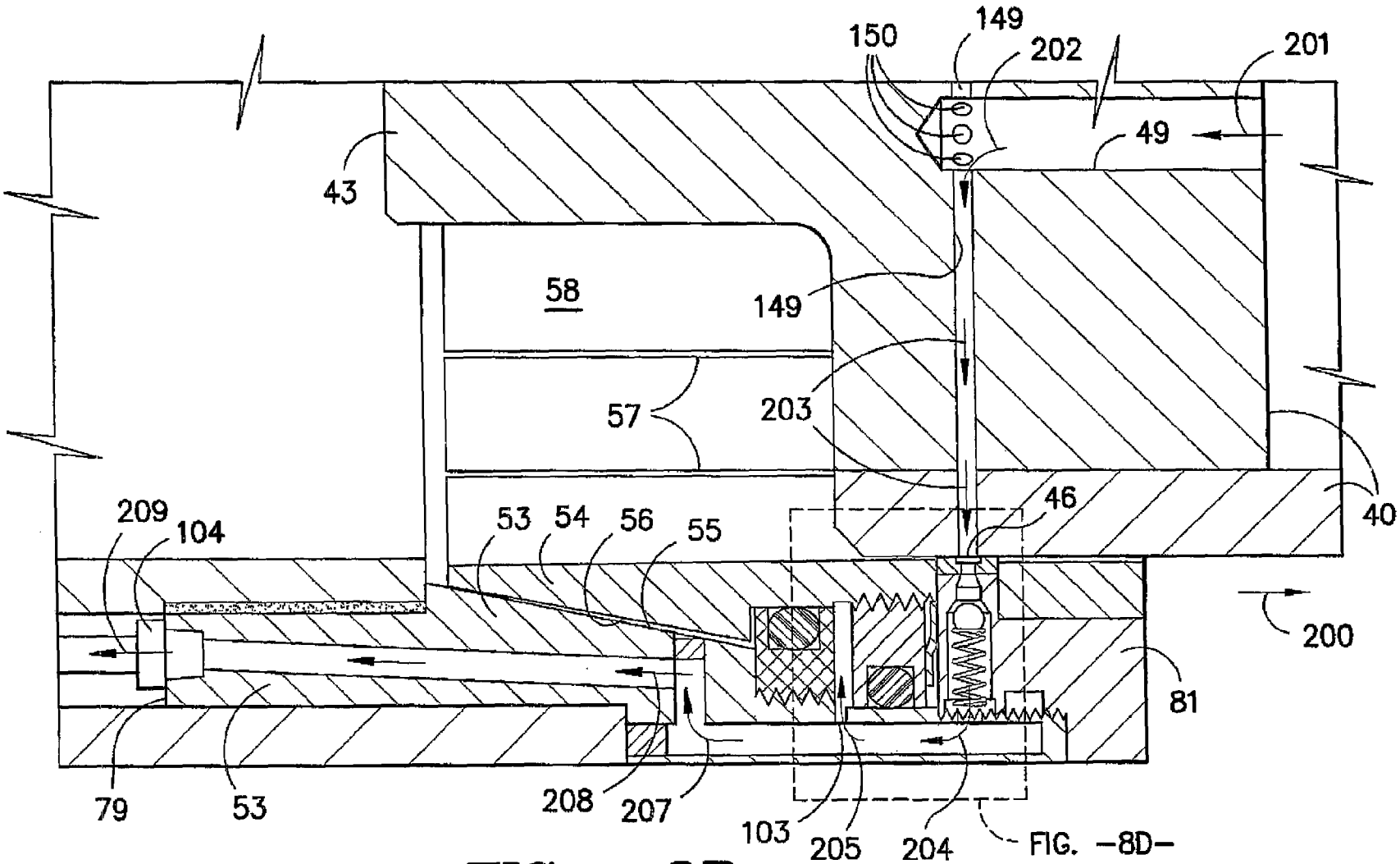
FIG. 8B shows an enlarged partial cross-section of the machine end of the bridge sleeve shown in FIG. 7 being mounted on the mandrel while the pressurized machine air is supplied to the mandrel.
Figure 8C:
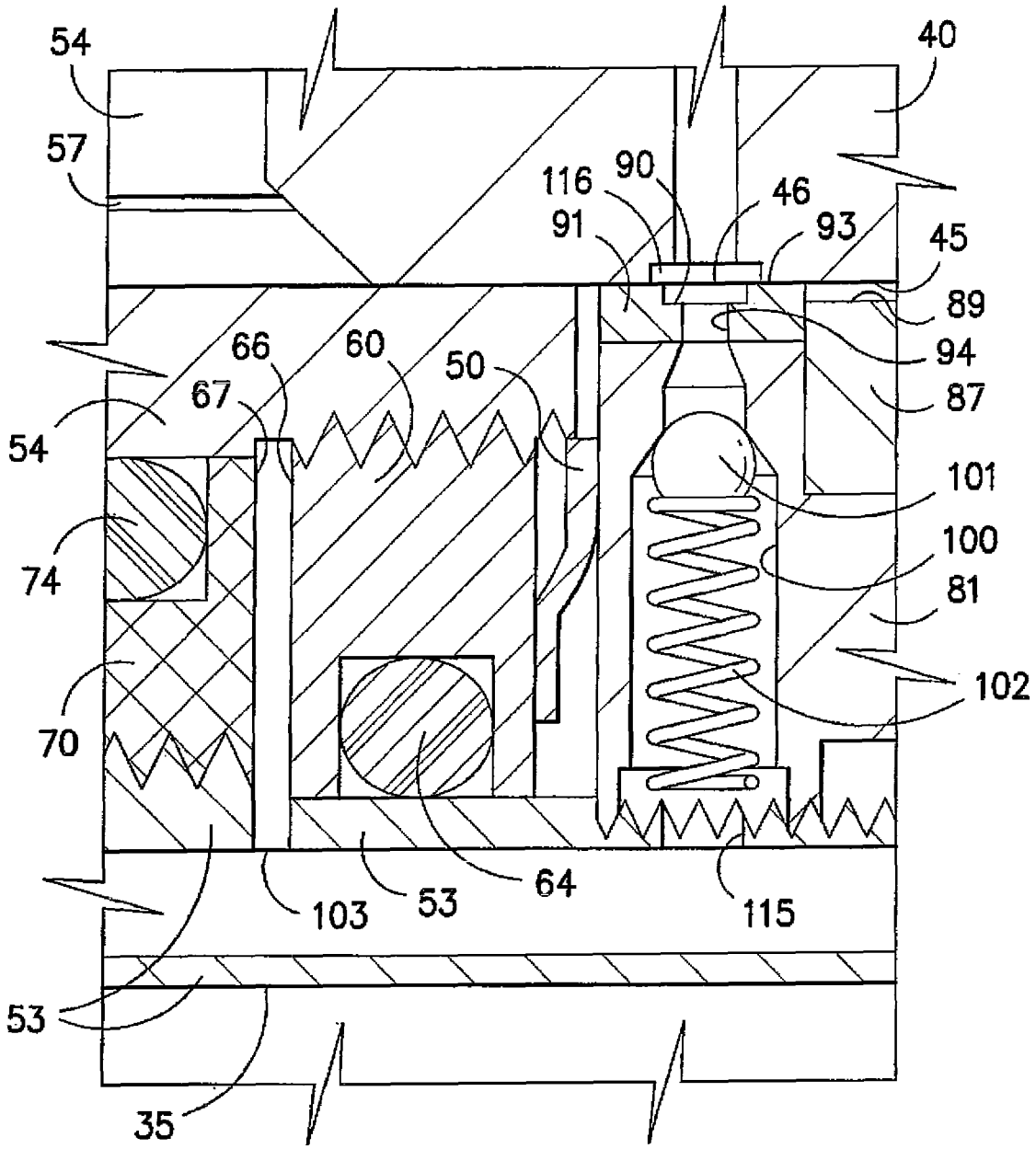
FIG. 8C shows an enlarged partial cross-section of the machine end of the bridge sleeve shown in FIG. 8A being mounted on the mandrel before the pressurized machine air is supplied to the mandrel.

FIG. 8C is an enlarged detailed view taken from FIG. 8A at a time just before the pressurized air is supplied through the mandrel 40. As shown in FIG. 8C, the inner surface 93 of the air capture ring 91 in which the air capture groove 90 is formed has a sufficiently low coefficient of friction to enable the air capture ring 91 also to slide across the outer surface 45 of the mandrel 40 with relative ease. Additionally, the portions of the slots 57 in the inner shell 54 near the blind ends of the slots 57 are wide enough so as to permit this portion of the inner shell 54 also to slide across the outer surface 45 of the mandrel 40 for a distance that is sufficient to enable the operator to position the air capture groove 90 directly in alignment with the air pressure holes 46 in the outer surface 45 of the mandrel 40.

As shown in FIG. 8C, the end cap 81 at the machine end of the bridge sleeve 30 defines a radially extending entrance bore 100 that communicates with an exit opening 94 that is defined through the air capture ring 91. The entrance bore 100 is conically shaped with the narrowest diameter portion in direct communication with the exit opening 94 through the air capture ring 91. Furthermore, a one-way valve is disposed within this radially extending entrance bore 100. The one-way valve is configured to admit air into the entrance bore 100 and prevent escape of air from the entrance bore. As schematically shown in FIG. 8C, the one-way valve desirably can be provided in the form of a check valve that has a ball 101 and a spring 102, which biases the ball 101 against a relatively narrower diameter portion of the entrance bore 100 so as to permit pressurized air to enter the entrance bore 100 from the air holes 46 in the surface 45 of the mandrel 40 but prevents escape of that pressurized air once it has passed the ball 101.

As shown in FIG. 8A, the pressurized air circuit for actuating the expansion mechanisms that expand the diameter of the inner contacting surface 58 of the inner shell 54 of each of the stabilizers 51, 52 desirably includes an outer axial conduit 105 that is formed in the outer shell 53. The outer axial conduit 105 is defined by a cylindrical passage that extends axially into the outer shell 53 and terminates before passing through the outwardly facing free edge 69 of the outer shell 53. As shown in FIG. 8A, the open end of the outer axial conduit 105 is sealed by a plug 106. The pressurized air circuit further desirably includes an inner axial conduit 107 that is defined by a cylindrical passage that extends axially into the outer shell 53. The central axis of inner axial conduit 107 need not be parallel to the central axis of the outer axial conduit 105 but desirably is located at a smaller diametric distance from the central axis of the outer shell 53, hence the name inner axial conduit 107.

As shown in FIG. 8A, the pressurized air circuit further desirably includes a radial conduit 109 that connects the outer axial conduit 105 with one end of the inner axial conduit 107. The radial conduit 109 is formed in the outer shell 53 by a cylindrical passage drilled radially through the conical inner surface 55 of the outer shell 53 and extending until the radial conduit 109 intersects with the inwardly facing end of the axial outer conduit 105. The open end of the radial conduit 109 near the conical inner surface 55 of the outer shell 53 is closed by the insertion of a plug 108 that seals the open end of the radial conduit 109. An identical outer axial conduit 105, radial conduit 109 and inner axial conduit 107 is formed at a location 180 degrees around the circumference of the outer shell 53 depicted in FIG. 8A. Thus, the pressurized air circuit for actuating the diametric variation in the stabilizer 51 that is disposed at the machine end of the bridge sleeve 30 is provided with two identically configured pressurized air conduit paths disposed 180 degrees circumferentially apart from each other within the outer shell 53.

Moreover, as schematically shown in FIG. 8C, the outer shell 53 further is provided with a fill opening 103 that is disposed at the outwardly facing end of the threaded surface 71 that receives the complimentary threads of the outer shell ring 70, and this fill opening 103 communicates directly with the axial outer conduit 105. Note that this fill opening 103 does not appear in the view shown in FIG. 5, which is rotated 90 degrees from the view shown in FIGS. 8A and 8C.

Thus, the pressurized air circuit for actuating the expansion mechanisms that expand the diameter of the inner contacting surface 58 of the inner shell 54 of each of the stabilizers 51, 52 includes a continuous air flow path that includes the radially extending entrance bore 100 (FIG. 8C), the outer axial conduit 105 (FIG. 8A), the radial conduit 109 (FIG. 8A), the inner axial conduit 107 (FIG. 8A) and the fill opening 103 (FIG. 8C) through the outer axial conduit 105.

The cross-sectional view shown in FIG. 8B is an enlarged section of the view in FIG. 7 but with the pressurized air having actuated the pressurized air circuit of the bridge sleeve 30 in order to increase the diameter of the inner contacting surface 58 of the inner shell 54 of the first stabilizer 51 at the machine end of the bridge sleeve 30. In this manner, each of the plurality of slots 57 through the inner shell 54 has attained its maximum circumferential distance between the opposed sides that form these slots 57 such that each respective circumferential gap is uniform for the entire axial length of each of the axially extending slots 57. The cross-sectional view shown in FIG. 8D is an enlarged portion of the cross-sectional view in FIG. 8B.

As shown in FIG. 8B for example, pressurized air can be supplied through the operator end of the mandrel 40 to the holes 46 in the outer surface 45 of the mandrel 40 via an axially extending central bore 49 from which radially extending bores 149 branch off as the spokes to a bicycle rim via holes 150 that form the entrances of each of the radial bores 149. Each of the air holes 46 formed through the outer surface 45 of the mandrel 40 forms the exit opening of one of the radial bores 149.

The arrows designated 201 in FIGS. 7 and 8B schematically represent the pressurized air traveling through the axially extending central bore 49 of the operator end of the mandrel 40. The arrows designated 202 in FIGS. 7 and 8B schematically represent the pressurized air traveling from the axially extending central bore 49 of the operator end of the mandrel 40 and into the radially extending bores 149 via the holes 150 that form the entrances of each of the radial bores 149 of the operator end of the mandrel 40. The arrows designated 203 in FIGS. 7, 8B and 8D schematically represent the pressurized air traveling through the radially extending bores 149 of the operator end of the mandrel 40 to the holes 46 through the outer surface 45 of the mandrel 40.

Figure 8D:
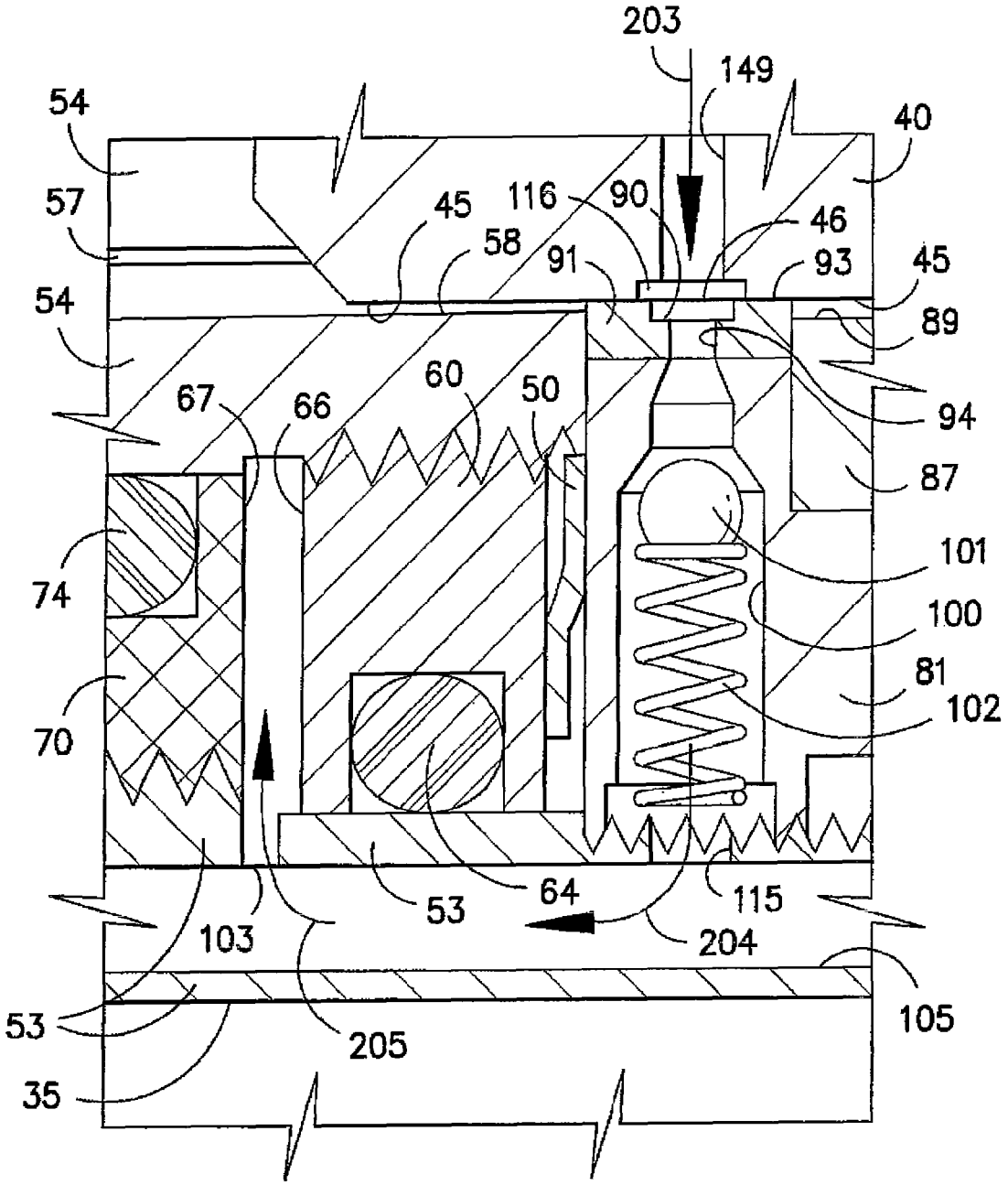
FIG. 8D shows an enlarged partial cross-section of the machine end of the bridge sleeve shown in FIG. 8B being mounted on the mandrel while the pressurized machine air is supplied to the mandrel.

As schematically shown in FIG. 8D, upon exiting the holes 46 through the outer surface 45 of the mandrel 40, the pressurized air fills the air capture groove 90 of the air capture ring 91 and passes through the exit opening 94 that is defined through the air capture ring 91. The pressurized air then enters the radially extending entrance bore 100 and passes through the one-way check valve to pass completely through the radially extending entrance bore 100. As schematically shown in FIG. 8D by the arrow designated 204, upon exiting the radially extending entrance bore 100, the pressurized air enters the outer axial conduit 105 formed in the outer shell 53.

As schematically shown by the arrow designated 205 in FIG. 8D, the pressurized air filling the outer axial conduit 105 flows through the fill opening 103 that introduces the pressurized air 205 between the inwardly facing side 66 of the inner shell ring 60 and the outwardly facing side 67 of the outer shell ring 70 around the entire circumference of the machine end stabilizer 51. As shown in FIG. 7, once the pressurized air flows through the fill opening 103 that introduces the pressurized air between the inwardly facing side 66 of the inner shell ring 60 and the outwardly facing side 67 of the outer shell ring 70, this pressurized air travels to the identically configured outer axial conduit 105, radial conduit 109 and inner axial conduit 107 formed in the outer shell 53 at a circumferential location that is 180 degrees from the outer axial conduit 105, radial conduit 109 and inner axial conduit 107 that is directly connected to the radially extending entrance bore 100.

Accordingly, as schematically represented by the arrow designated 206 in FIG. 7 for example, the pressurized air 205 between the inwardly facing side 66 of the inner shell ring 60 and the outwardly facing side 67 of the outer shell ring 70 exits through the fill opening 103 in the outer shell 53 that communicates with the axial outer conduit 105 defined in the opposite side of the outer shell 53 and enters the axial outer conduit 105 defined in the opposite side of the outer shell 53. As schematically shown in FIG. 7 for example, the arrows designated 207 represent the pressurized air leaving the respective axial outer conduits 105 of the outer shell 53 of the machine end stabilizer 51 and entering the respective the radial conduits 109 of the outer shell 53. As schematically shown in FIG. 7 for example, the arrows designated 208 represent the pressurized air leaving the respective the radial conduits 109 of the outer shell 53 of the machine end stabilizer 51 and entering the respective inner axial conduits 107 of the outer shell 53.

Figure 9:
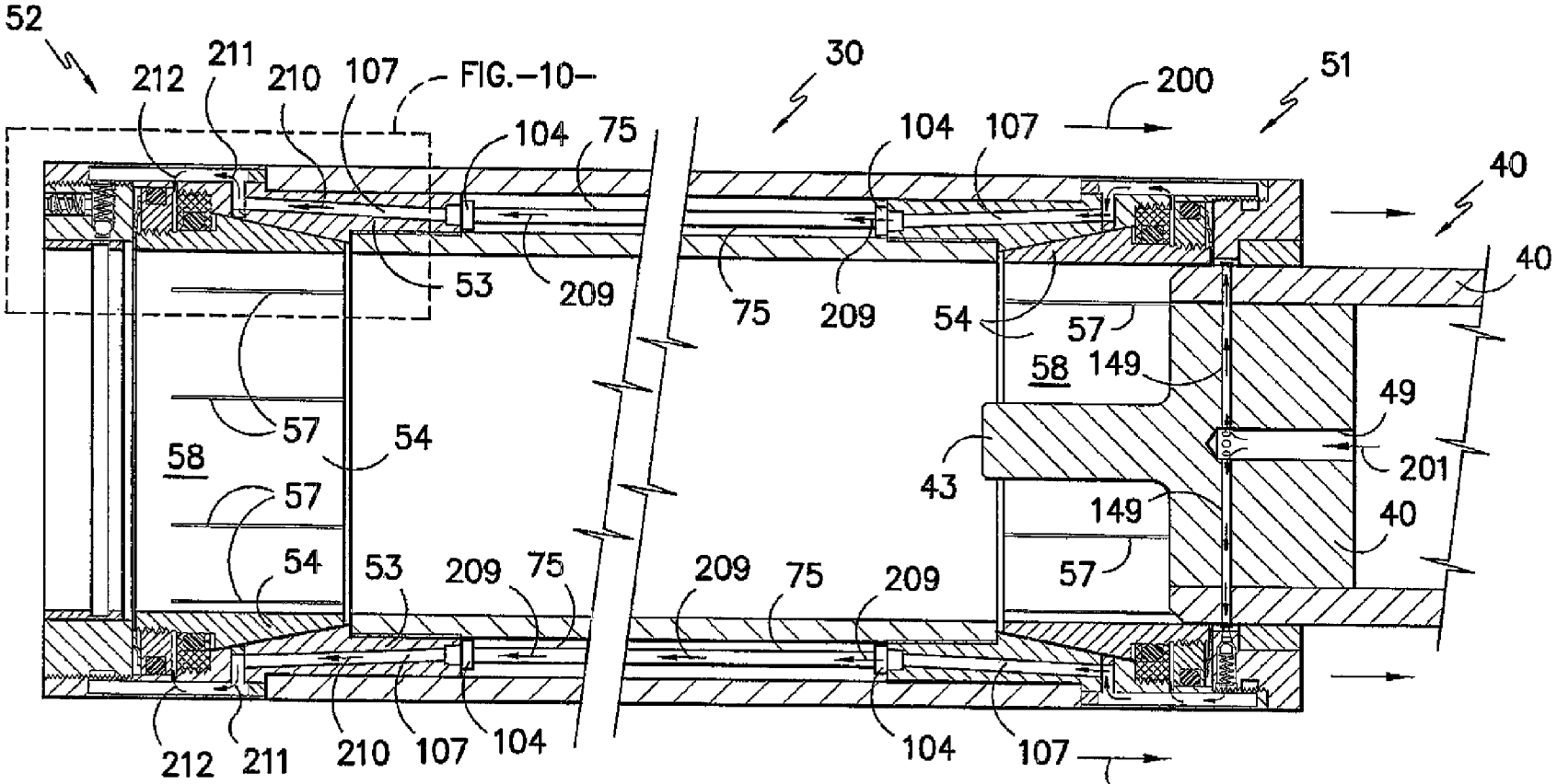
FIG. 9 schematically illustrates a cross-sectional view of an embodiment of the bridge sleeve shown in FIG. 7, but additionally showing the stabilizer at the operator end of the bridge sleeve while the pressurized machine air is supplied to the mandrel.

FIG. 9 schematically illustrates a cross-sectional view of an embodiment of the bridge sleeve 30 shown in FIG. 7, but additionally showing the stabilizer 52 at the operator end of the sleeve 30 while the pressurized machine air is supplied to the mandrel 40. As shown in FIG. 7 as well as in FIGS. 8A, 8B and 9, the terminus of each of the two inner axial conduits 107 at the inwardly facing edge 79 of the outer shell 53 desirably is provided with a press fitted connector 104 that connects each inner axial conduit 107 to one end of one of two pipes 75. These pipes 75 extend axially through the bridge sleeve 30 between the opposed stabilizers 51, 52 and are separated circumferentially by 180 degrees. As schematically shown in FIG. 9, the other end of each pipe 75 is similarly connected desirably to a press fitted connector 104 that connects to one of the inner axial conduits 107 of the second stabilizer 52 at the operator end of the bridge sleeve 30. The arrows designated 209 in FIGS. 7, 8B and 9 for example, schematically represent the flow of pressurized air through the respective pipes 75 from the first stabilizer 51 at the machine end of the bridge sleeve 30 to the second stabilizer 52 at the operator end of the bridge sleeve 30.

Figure 10:
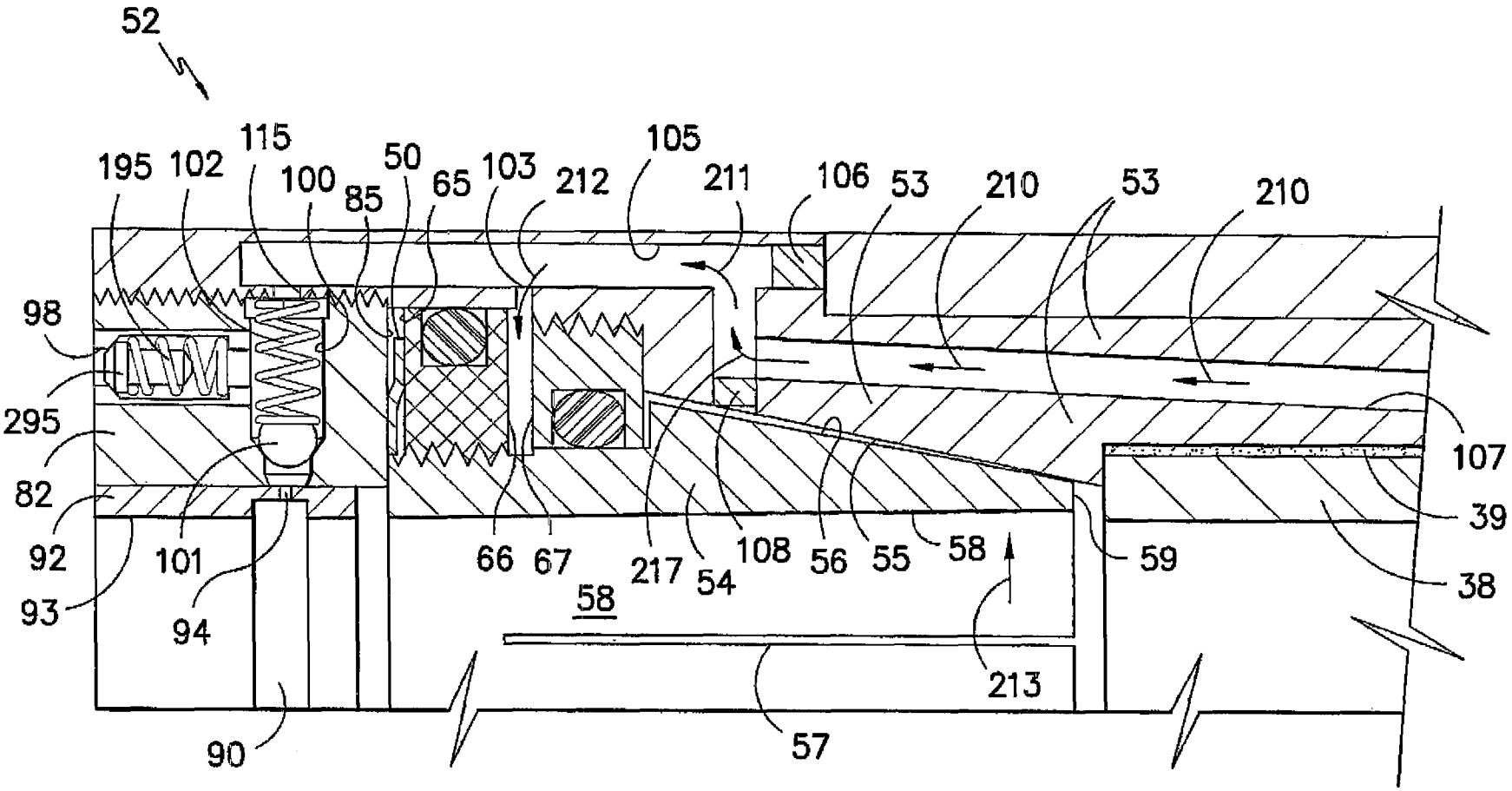
FIG. 10 schematically depicts an expanded view of a portion of the cross-sectional view depicted in FIG. 9.

FIG. 10 schematically depicts an expanded view of a portion of the cross-sectional view of the operator end stabilizer 52 depicted in FIG. 9. As schematically shown in FIGS. 9 and 10 for example, the arrows designated 210 represent the pressurized air that has flowed through the respective pipes 75 from the first stabilizer 51 and is flowing through the respective inner axial conduits 107 of the outer shell 53 toward the respective radial conduits 109 of the outer shell 53 of the operator end stabilizer 52. As schematically shown in FIGS. 9 and 10 for example, the arrows designated 211 represent the pressurized air leaving the respective radial conduits 109 and entering the respective axial outer conduits 105 of the outer shell 53 of the operator end stabilizer 52. As schematically shown in FIGS. 9 and 10 for example, the arrows designated 212 represent the pressurized air entering through the fill opening 103 in the outer shell 53 from the axial outer conduit 105 defined in the opposite side of the outer shell 53 of the operator end stabilizer 52. This flow of pressurized air 212 enters between the inwardly facing side 66 of the inner shell ring 60 and the outwardly facing side 67 of the outer shell ring 70 of the operator end stabilizer 52.

Referring to FIG. 10, the arrow designated 212 represents the pressurized air that expands the gap between the inwardly facing side 66 of the inner shell ring 60 and the outwardly side 67 of the outer shell ring 70 of the second stabilizer 52 at the operator end of the bridge sleeve 30. In this way, the pressurized air 203 (FIG. 8D) provided through the air holes 46 in the outer surface 45 of the mandrel 40 actuates the expansion of the diameters of the inner contacting surfaces 58 of both of the stabilizers 51, 52 sufficiently to easily slide the bridge sleeve 30 onto the mandrel 40 without contact between the inner contacting surfaces 58 and the outer surface 45 of the mandrel 40.

The pressure of the air 205 (FIG. 8D), 212 (FIG. 10) acting on the respective annular surface of the inwardly facing side 66 of the respective inner shell ring 60 of the respective stabilizer 51, 52 provides a force that acts to overcome the biasing force exerted by the respective conical spring 50, which becomes relatively compressed as schematically shown in FIGS. 8D and 10. The effect of this counteracting force provided by the pressurized air 205, 212 is to move the respective inner shell 54 in an axial direction toward the conical spring 50 and toward the respective machine end cap 81, 82 and away from the inwardly facing free edge 79 (e.g., FIG. 8A) of the respective outer shell 53. As schematically shown in FIGS. 8B and 10 for example, the effect of this axial movement of the respective inner shell 54 is also to move the conical surface 56 of the inner shell 54 away from radially inwardly-directed compressive contact that tends to be exerted by the conical surface 55 of the respective outer shell 53. When relieved of the radially inwardly-directed compressive contact imposed by the conical surface 55 of the outer shell 53, the circumferential gaps that define the axial slots 57 in the inner shell 54 are free to expand circumferentially to their maximum circumferential extents as shown in FIGS. 3, 4, 8B and 10 for example. This expanding circumferential movement of the inner contacting surface 58 of the inner shell 54 is schematically indicated in FIG. 10 by the arrow designated 213.

When the axial slots 57 in the inner shell 54 are free to expand circumferentially to their maximum circumferential extents as shown in FIGS. 3, 4, 8B and 10 for example, the diameter of the inner contacting surface 58 of the inner shell 54 becomes large enough to provide a clearance gap between the inner contacting surface 58 and the outer surface 45 of the mandrel 40 as schematically depicted in FIG. 8D for example. Thus, the diameters of the inner contacting surfaces 58 of the stabilizers 51, 52 are expanded sufficiently so as to avoid contact with the outer surface 45 of the mandrel 40, and this contact avoidance allows the bridge sleeve 30 to be mounted onto and/or dismounted from the outer surface 45 of the mandrel 40.

FIG. 10 illustrates an enlarged cross-sectional view of a portion of the operator end stabilizer 52 before it is slid onto the operator end of the mandrel 40 but after the pressurized air circuit has expanded the diameter of the inner contacting surface 58 of the inner shell 54. The pressurized air from the pipe 75 shown in FIG. 7 for example connects via the press fitted couplings 104 shown in FIG. 9 to the axial inner conduit 107 of the outer shell 53 and flows in the direction indicated by the arrows designated 210 in FIG. 10. As indicated by the arrow 217 in FIG. 10, the pressurized air exits from the outwardly facing end of the axial inner conduit 107 into the radial conduit 109. The arrow designated 211 in FIG. 10 indicates the flow of pressurized air exiting from the radial conduit 109 and turning into the inwardly facing end of the axial outer conduit 105. The arrow designated 212 in FIG. 10 indicates the flow of pressurized air through the fill opening 103 in the axial outer conduit 105 and between the inwardly facing side 66 of the inner shell ring 60 and the outwardly facing side 67 of the outer shell ring 70 so as to move the inner shell 54 axially in a direction that compresses the conical spring 50 between the inwardly facing end 85 of the operator end cap 82 and the outwardly facing side 65 of the inner shell ring 60. This axially directed movement of the inner shell 54 permits the complete expansion of the slots 57 in the inner shell 54, which results in the maximum diametric dimension of the inner contacting surface 58 of the inner shell 54. At this maximum diametric dimension, the diameter of the inner contacting surface 58 is larger than the diameter of the outer surface 45 of the mandrel 40 and thus provides a gap between the inner contacting surface 58 and the outer surface 45 that permits the operator to slide the second stabilizer 52 at the operator end of the carrier sleeve 30 easily above the outer surface of the mandrel 40.

Figure 16:
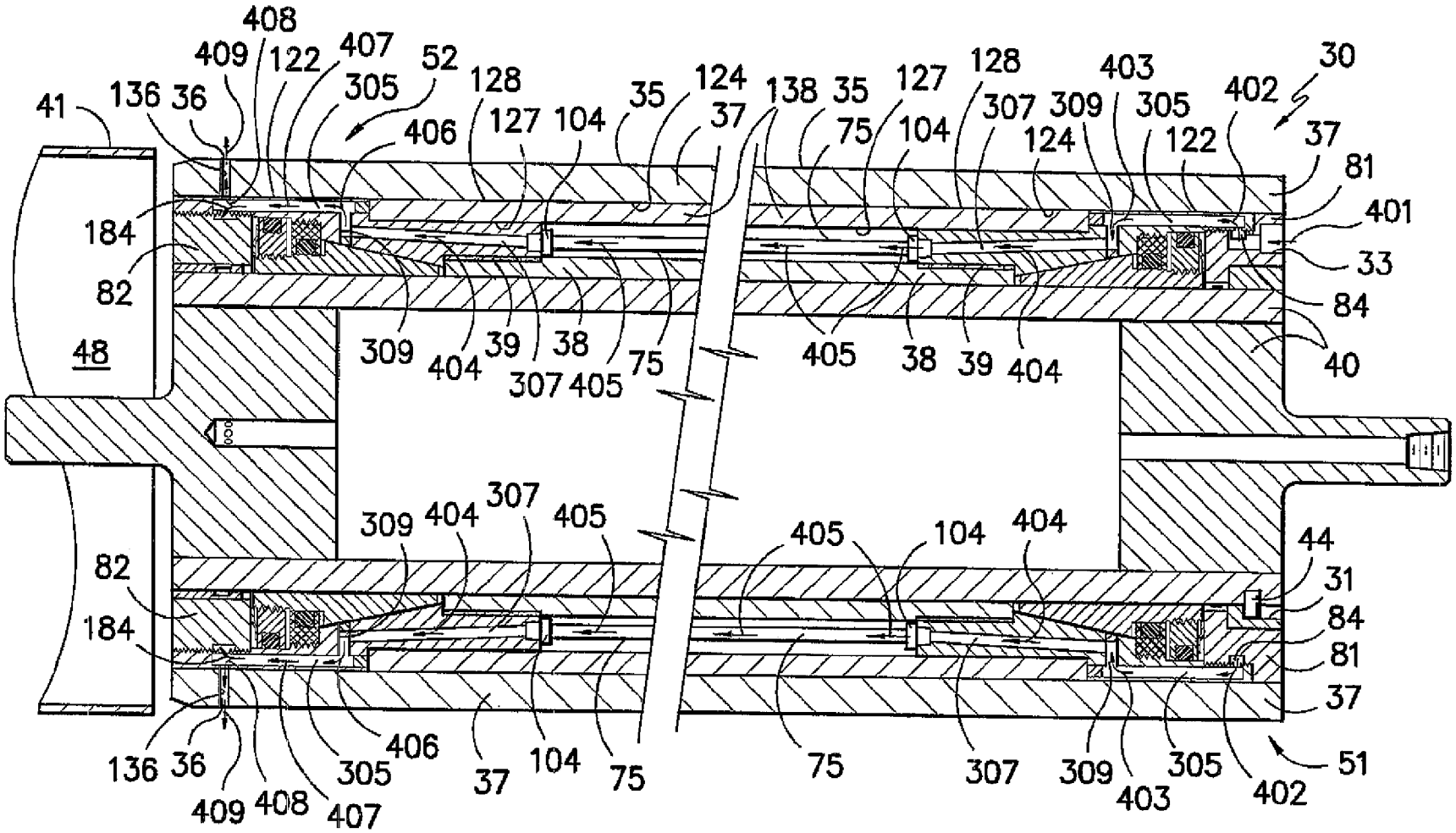
FIG. 16 shows the bridge sleeve mounted to the mandrel, and externally supplied pressurized air being supplied to the separate, piped through air system of the bridge sleeve that is used to mount the print sleeve that approaches the operator end of the bridge sleeve.

Once the bridge sleeve 30 is properly positioned on the outer surface 45 of the mandrel 40 with the registration pin 44 captured in the registration notch 31 as shown in FIG. 16 for example, the inner contacting surfaces 58 of the inner shells 54 of the stabilizers 51, 52 must be brought into direct contact with the outer surface 45 of the mandrel 40. This is done by releasing the pressurized air from the pressurized air circuit, which as explained above can be used to actuate the expansion of the diameter of the inner contacting surface 58. The release of the pressurized air within this circuit frees the conical springs 50 to apply forces that effect a sufficient reduction of the diameters of the inner contacting surfaces 58 that place the inner contacting surfaces 58 into contact with the outer surface 45 of the mandrel 40.

Figure 11:
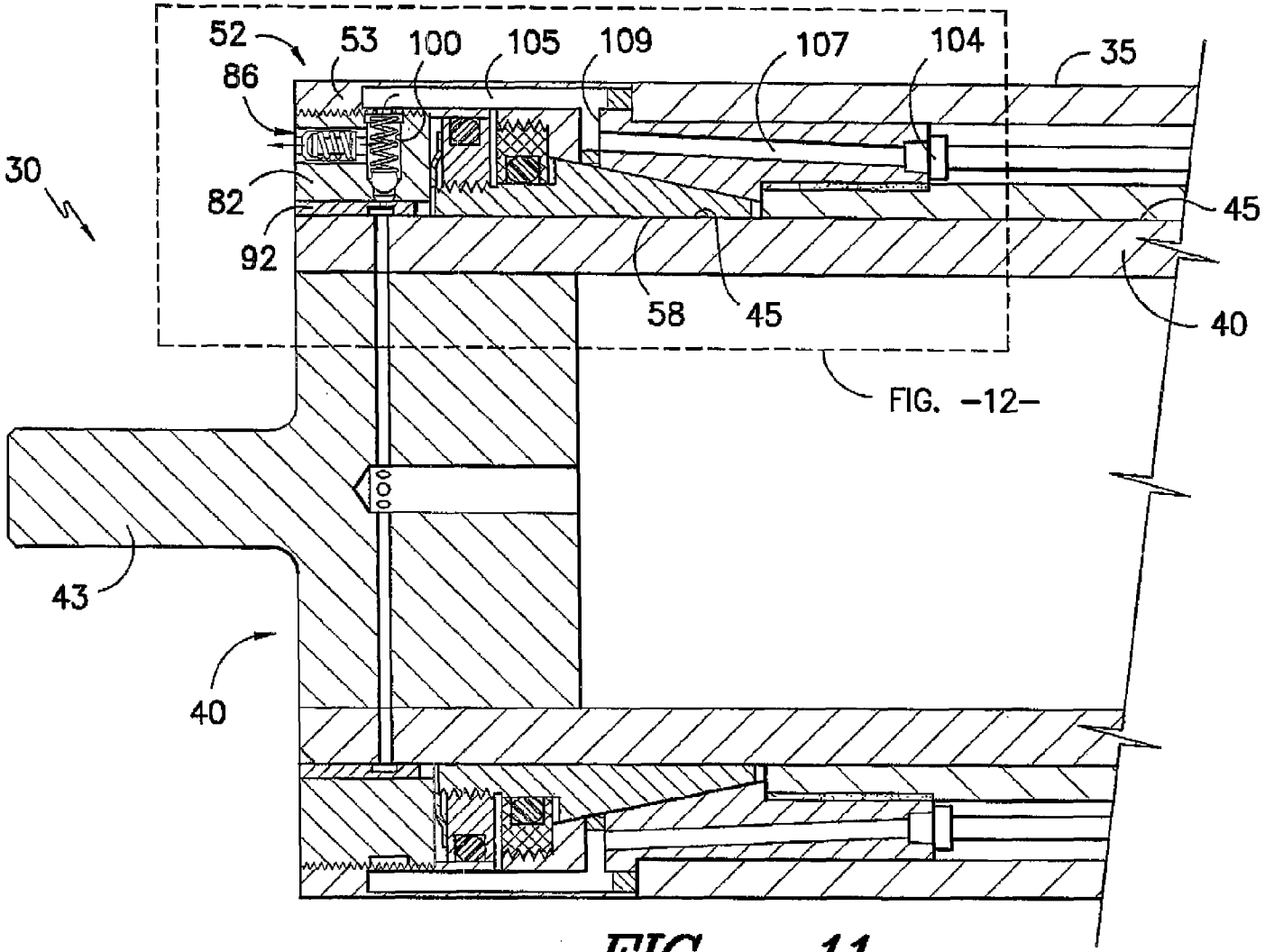
FIG. 11 illustrates a cross-sectional view of the operator end of the bridge sleeve 30 when it is properly positioned on the outer surface 45 of the mandrel 40.
Figure 12:
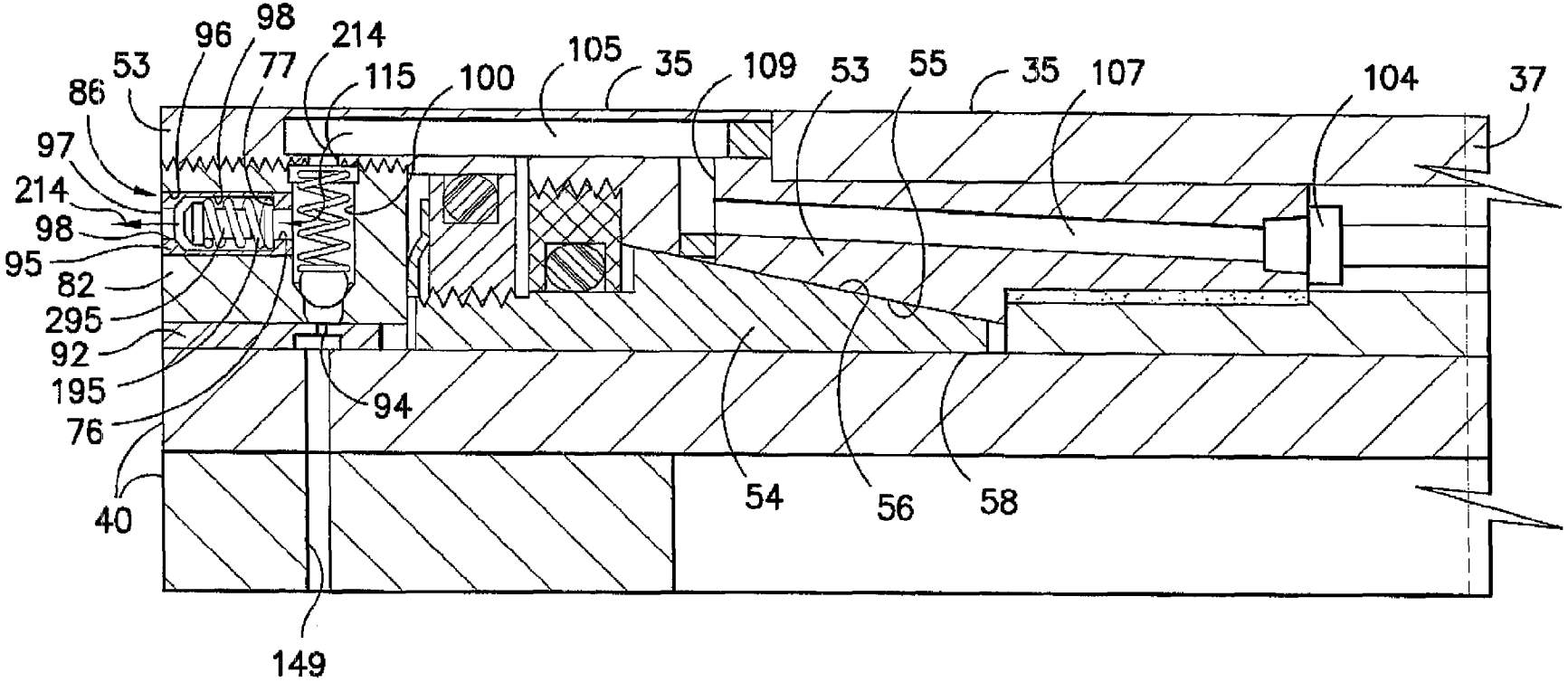
FIG. 12 illustrates an enlarged portion of the view shown in FIG. 11.

FIG. 11 illustrates a cross-sectional view of the operator end of the bridge sleeve 30 when it is properly positioned on the outer surface 45 of the mandrel 40. FIG. 12 illustrates an enlarged portion of the view shown in FIG. 10. As shown in FIGS. 2 and 11 for example, a release valve 86 desirably is fitted into the operator end cap 82. As shown in FIG. 11 for example, the release valve 86 communicates via the radially extending entrance bore 100 with the axial outer conduit 105, the radial conduit 109 and the axial inner conduit 107 of the outer shell 53 of the second stabilizer 52 at the operator end of the bridge sleeve 30.

As shown in FIGS. 4 and 12 for example, one embodiment of the release valve can take the form of a relatively short, cylindrical tube 95 that is fitted into an opening 96 that has been drilled axially into the operator end cap 82 and connects to the radially extending entrance bore 100 formed therein. The exterior surface of the tube 95 desirably is cylindrical, but the interior surface of the tube 95 is configured to define an entrance opening 97 connected to a cylindrical entrance passage 98 that leads into an inner chamber 99 having a larger diameter than the entrance passage 98, an exit opening 76 and a shoulder 77 that receives one end of a spring 195. A retractable pin 295 has a rear end inserted into the central opening of the spring 195. The front end of the retractable pin 295 defines a head that has a back shoulder that rests against the front end of the spring 195 so as to bias the head of the pin 295 against the rear opening of the entrance passage 98 that terminates in the entrance opening 97. Thus, the entrance opening 97 communicates with the radially extending entrance bore 100 that is defined radially into the operator end cap 82. As schematically shown in FIG. 12, this radially extending entrance bore 100 communicates in turn via a radial hole 115 with the axial outer conduit 105 that is defined in the inner shell 53.

As schematically shown in FIG. 12, when the operator depresses the head of the retractable pin 295, any pressurized air 214 in the pressurized air circuit can escape through the entrance passage 98 and out of the entrance opening 97 of the tube 95 and into the ambient atmosphere. When the pressurized air is released from between the inwardly facing side 66 of the inner shell ring 60 and the outwardly facing side 67 of the outer shell ring 70, the conical springs 50 are freed to expand against the outwardly facing side 65 of the inner shell ring 60 so as to move the inner shell 54 axially in a direction that forces the conical surface 56 of the inner shell 54 against the conical surface 55 of the outer shell 53 so as to compress the slots 57 in the inner shell 54. This compression of the slots 57 in the inner shell 54 effects a reduction in the diametric dimension of the inner contacting surface 58 of the inner shell 54. The diameter of the inner contacting surface 58 of the inner shell 54 becomes reduced until it matches the outer diameter of the outer surface 45 of the mandrel 40. Thus, the diameters of the inner contacting surfaces 58 of the stabilizers 51, 52 become sufficiently contracted so as to come into contact with the outer surface 45 of the mandrel 40, and this contact allows the bridge sleeve 30 to be maintain rigid, positive direct contact between the outer surface 45 of the mandrel 40 and the outer surface 35 of the bridge sleeve 30. It is this rigid uninterrupted contact between the outer surface 45 of the mandrel 40 and the outer surface 35 of the bridge sleeve 30 that enables the print sleeve 41 to avoid the type of instability that results in the types of print deterioration described above in the background.

The conical spring 50 in each stabilizer 51, 52 provides the biasing force that keeps the inner contacting surface 58 of the inner shell 54 of each stabilizer 51, 52 firmly in contact with the outer surface 45 of the mandrel 40 and the conical surface 56 of the inner shell 54 firmly in contact with the conical surface of the outer shell 53. The force constant that characterizes each conical spring 50 desirably should be large enough to overcome the centrifugal forces that are anticipated at the rotational speeds that can be attained by the outer surface 35 of the bridge sleeve 30 as it rotates with the mandrel 40 of the printing machine. Thus, the magnitude of these centrifugal forces will vary depending on the diameter of the outer surface 35 of the bridge sleeve 30. Accordingly, the force constant of the conical springs 50 will be selected to ensure sufficient biasing force to overcome these centrifugal forces and keep the stabilizers 51, 52 firmly in contact with the outer surface 45 of the mandrel 40 at the anticipated rotational speeds of the outer surface 35 of the bridge sleeve 30 as it rotates with the mandrel 40 that accommodates the line speed of the printable substrate through the printing machine.

Another consideration in the selection of the force constant of the conical springs 50 is the circumferentially directed force that occurs when the substrate that is being printed becomes involved in a so-called web wrap up event. The function of the stabilizers 51, 52 is not to lock the bridge sleeve 30 onto the outer surface 45 of the mandrel 40, as the locking function of the bridge sleeve 30 to the mandrel 40 is performed solely by the radially expandable cylindrical inner core 38. However, the force constant of the conical springs 50 desirably (but not necessarily) is selected so as to be overcome during the onset of a web wrap-up event so that marring of the outer surface 45 of the mandrel 40 by the inner contacting surface 58 of the inner shell 54 of each of the stabilizers 51, 52 might be avoided altogether or at least reduced insofar as the lengths and depths of the marring striations that otherwise might occur were the inner contacting surfaces 58 to remain in contact with the outer surface 45 of the mandrel 40 during a web wrap-up event.

The force constant of the conical springs 50 desirably (but not necessarily) can be selected so as to be overcome essentially instantaneously when the pressurized air is supplied to the pressurized air circuit of the bridge sleeve 30 via the holes 46 through the outer surface 45 of the mandrel 40. Thus, it becomes possible to outfit the printing machine with sensors that detect the onset of a web wrap up event and to program the operation of the printing machine so that when such sensors detect the onset of a web wrap up event, the pressurized air is automatically supplied to the holes 46 in the outer surface 45 of the mandrel 40. Then the inner contacting surfaces 58 of the inner shells 54 of the stabilizers 51, 52 quickly become expanded in diameter and retracted from contact with the outer surface 45 of the mandrel 40. In this way, it becomes possible to avoid (or at least reduce) marring of the outer surface 45 of the mandrel 40 by the inner contacting surfaces 58 of the inner shells 54 of each of the stabilizers 51, 52.

At some point it becomes necessary to remove the bridge sleeve 30 from the outer surface 45 of the mandrel 40 of the printing machine. In at least one embodiment of the bridge sleeve 30, the release valve 86 shown in FIGS. 2 and 12 for example is configured to be recessed further toward the center of the bridge sleeve 30 than is shown in FIG. 12. In so doing, the end portion of the opening 96 that is drilled axially into the operator end cap 82 becomes exposed. This exposed end portion of the opening 96 can be threaded to receive a complementarily threaded coupling 34 (FIG. 1) that is connected to an operator-controlled supply 47 of pressurized air. The connected coupling 34 can be used to open the release valve 86 so that the pressurized air can enter the tube 95 and the radially extending entrance bore 100. The pressurized air can actuate the stabilizers 51, 52 of the bridge sleeve 30 so as to expand their inner contacting surfaces 58 sufficiently to remove their contact with the underlying outer surface 45 of the mandrel 40 and enable the bridge sleeve 30 to be slid off of the mandrel 40. Indeed, such a coupling 34 likewise can be used to actuate the release valve 86 so that the pressurized air can actuate the stabilizers 51, 52 of the bridge sleeve 30 so as to expand their inner contacting surfaces 58 sufficiently to avoid their contact with the underlying outer surface 45 of the mandrel 40 and enable the bridge sleeve 30 to be slid onto the mandrel 40 without using the machine pressurized air that is expelled from the holes 46 through the outer surface 45 of the operator end of the mandrel 40. Thus, for such an embodiment of the bridge sleeve 30, the expansion of the inner contacting surfaces 58 of the stabilizers 51, 52 can be achieved while the bridge sleeve 30 is located remotely from the printing machine and the mandrels 40.

Alternately, at least one embodiment of the bridge sleeve 30 can be configured so that the pressurized air that can be supplied to the outer surface 45 of the mandrel 40 via the plurality of air holes 46 can be employed to remove the bridge sleeve 30 from the outer surface 45 of the mandrel 40 of the printing machine. As explained below, at least one embodiment of the bridge sleeve 30 is configured to use this supply of pressurized air from the mandrel 40 to actuate the stabilizers 51, 52 of the bridge sleeve 30 so as to expand their inner contacting surfaces 58 sufficiently to remove their contact with the underlying outer surface 45 of the mandrel 40 and enable the bridge sleeve 30 to be slid off of the mandrel 40 while avoiding any metal-to-metal scraping that might otherwise damage the outer surface 45 of the mandrel 40 and damage the inner contacting surfaces 58 of the stabilizers 51, 52.

Figure 13:
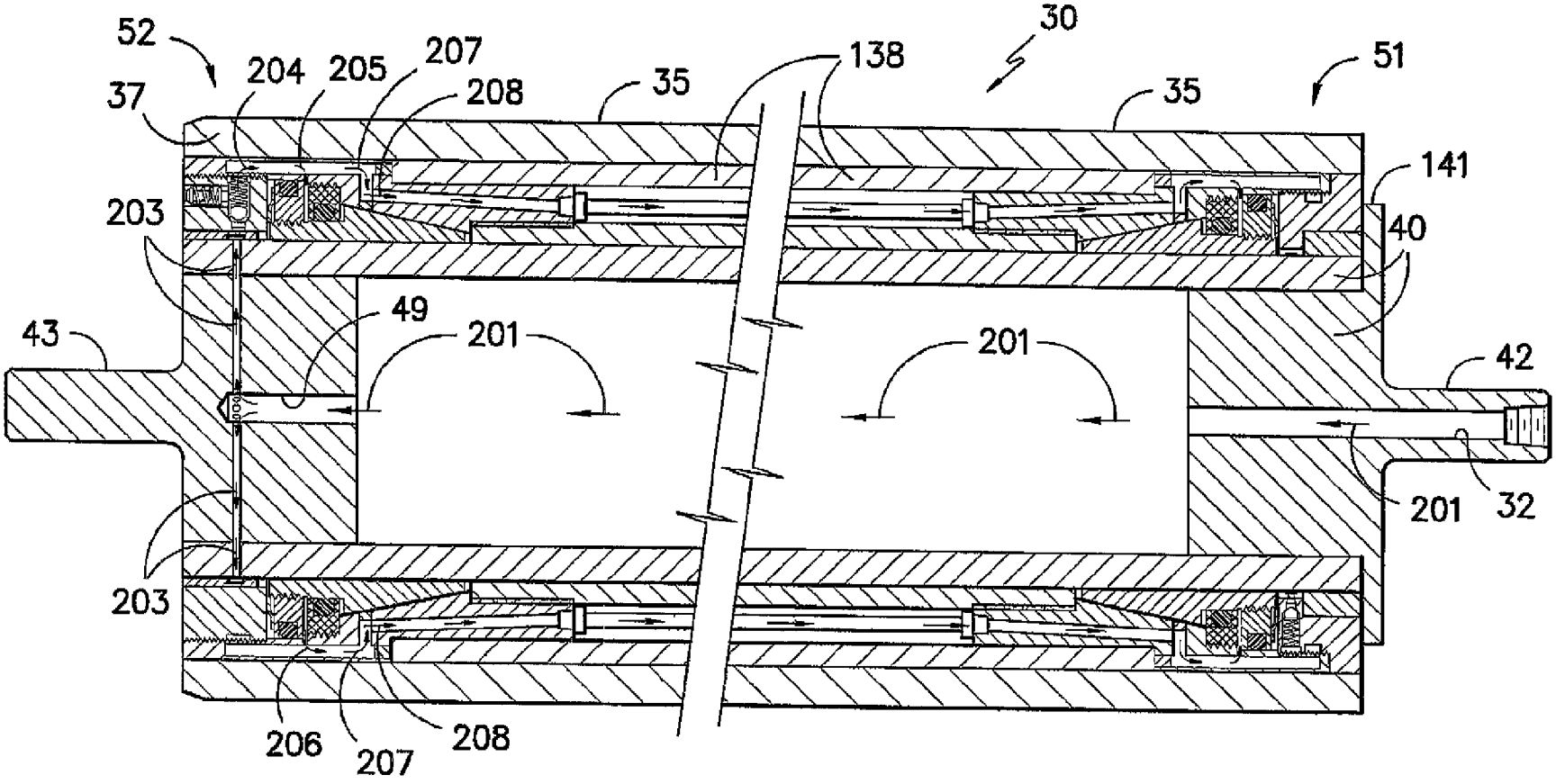
FIG. 13 shows the bridge sleeve mounted to the mandrel, and machine air being supplied to the separate, air system of the bridge sleeve that is used to allow expansion of the diameters of the stabilizers so that the bridge sleeve can be dismounted from the mandrel.

FIG. 13 schematically shows a cross-sectional view of the bridge sleeve 30 mounted on the mandrel 40 when the operator has activated the supply of pressurized air through the central air channel 32 in the motor journal 42 at the machine end of the mandrel 40 as indicated by the arrows designated by the numeral 201. One difference between the embodiment of the bridge sleeve 30 depicted in FIG. 14 and the embodiment of the bridge sleeve 30 depicted in FIG. 13 is that the latter employs a rigid outermost layer 37 that surrounds each entire stabilizer 51, 52. While in the embodiment of the bridge sleeve 30 depicted in FIG. 14, the rigid outermost layer 37 only surrounds a portion of the outer shells 53 of the stabilizers 51, 52 so that the outer surface 35 of the bridge sleeve 30 is formed partially by a portion of the outer shells 53 of the stabilizers 51, 52 and partially by the rigid outermost layer 37. Like the configuration of the bridge sleeve 30 shown in FIG. 13, in the embodiment of the bridge sleeve 30 schematically shown in FIG. 14 the pressurized air 201 enters the central bore 49 formed in the operator journal 43, and then the pressurized air 203 travels through the radially extending bores 149 to the air holes 46 that are defined through the outer surface 45 of the mandrel 40.

Figure 14:
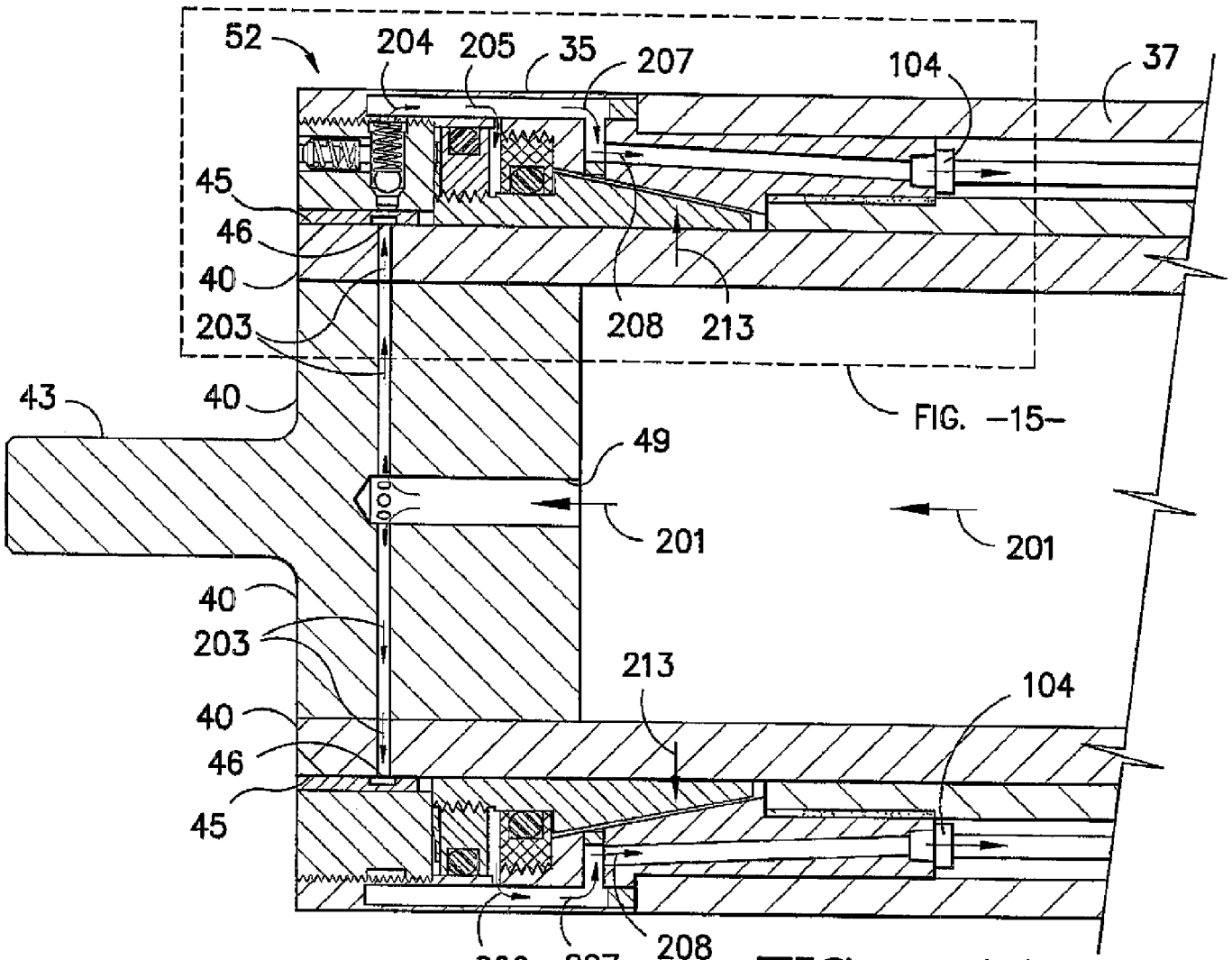
FIG. 14 shows an enlarged view of the operator end of the bridge sleeve mounted to the mandrel as depicted in FIG. 13.
Figure 15:
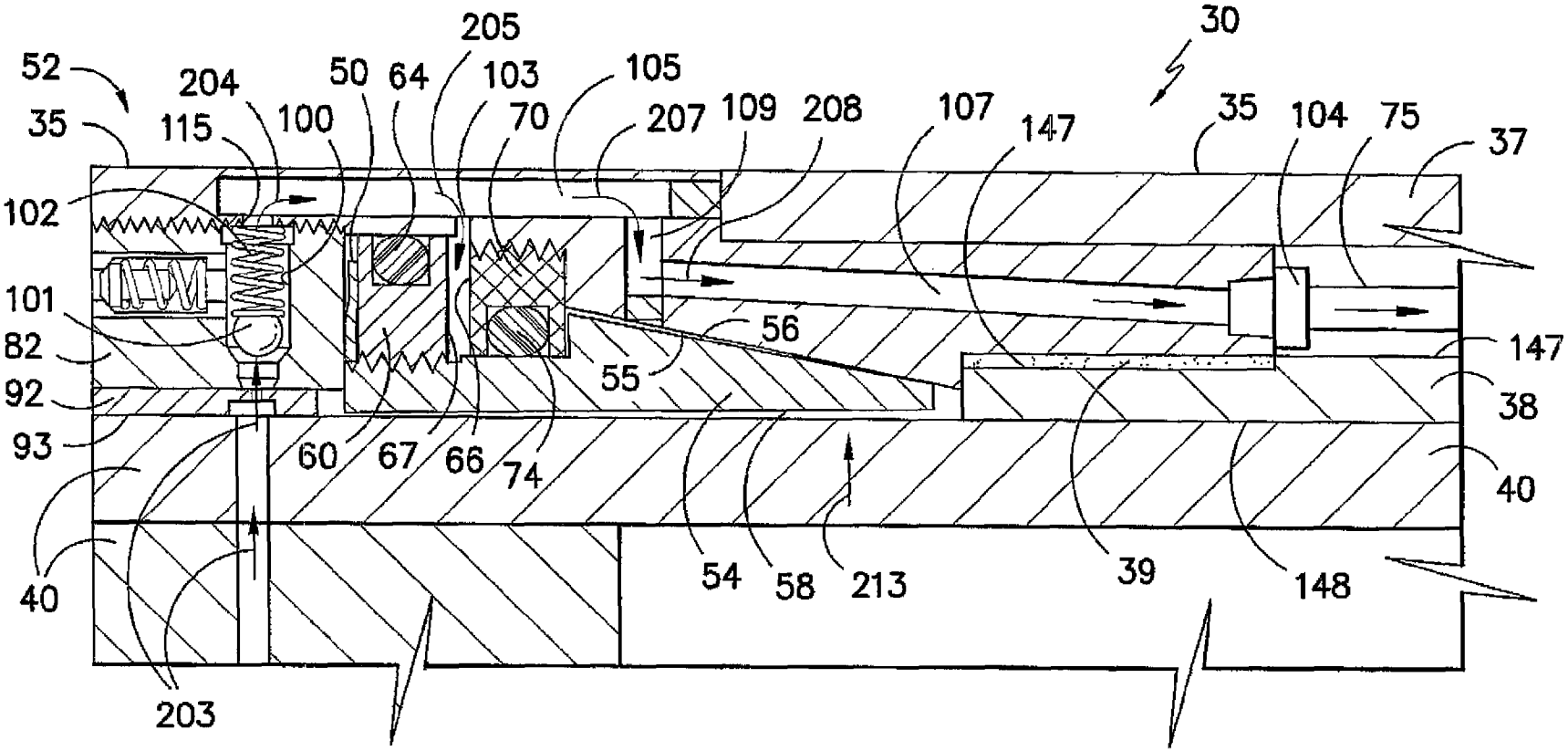
FIG. 15 shows an enlarged portion of a partial cross-section of the operator end of the bridge sleeve depicted in FIG. 14 when machine air is being supplied to compress the conical spring and allow the diameters of the inner contacting surfaces of the operator end stabilizer to expand so that the bridge sleeve can be dismounted from the mandrel.

FIG. 15 illustrates an enlarged portion of the cross-sectional view depicted in FIG. 14. As schematically shown by the arrow designated 203 in FIG. 15, the pressurized air 203 flows through the radially extending bores 149 into the radially extending entrance bore 100 defined in the end cap 82 at the machine end of the bridge sleeve 30. The pressurized air 204 passes through the one way valve and the radial hole 115 through the axial outer conduit 105 of the outer shell 53 to enter the axial outer conduit 105 formed in the outer shell 53 of the second stabilizer 52 at the operator end of the bridge sleeve 30. As schematically indicated in FIG. 15 by the arrow designated 205, the pressurized air 205 enters the fill opening 103 in a wall of outer shell 53 that defines part of the axial outer conduit 105 and then acts on the inwardly facing side 66 of the inner shell ring 60 to apply a force that is large enough to compress the conical spring 50 and permit the inner shell 54 to move axially in a direction toward the operator end cap 82. The magnitude of the pressure supplied by the pressurized air 205 from the mandrel 40 applied over the area of the inwardly facing side 66 of the inner shell ring 60 generates a force having a magnitude that is available to compress the conical spring 50 a given distance. This fact provides the designer of bridge sleeves 30 with the flexibility to choose the force constants of the conical springs 50 and the area of the inwardly facing side 66 of the inner shell ring 60 that can accommodate printing machines with mandrels 40 having different pressurized air flows. By this axial movement of the inner shell 54, the slots 57 (not visible in FIG. 15) have room to expand circumferentially to open completely in the manner shown in FIGS. 9 and 10 for example. As schematically shown in FIG. 15, with this expansion in diameter of the inner contacting surface 58, the diameter of the inner contacting surface 58 of the inner shell 54, and thus of the associated stabilizer 52 as well, becomes larger than the diameter of the outer surface 45 of the mandrel 40. Thus, the increased diameter of the inner contacting surface 58 of the inner shell 54 effectively retracts the inner contacting surface 58 away from any contact with the outer surface 45 of the mandrel 40.

As schematically shown in FIG. 15 by the arrow designated 207, the compressed air 207 likewise enters the radial conduit 109 of the outer shell 53 from the axial outer conduit 105 and then enters the axial inner conduit 107 of the outer shell 53 and further makes its way to the pipes 75 that lead to the axial inner conduit 107 that is formed in the outer shell 53 of the first stabilizer 51 at the machine end of the bridge sleeve 30. Upon arriving at the outer shell 53 of the machine end stabilizer 51 of the bridge sleeve 30, which occurs essentially instantaneously, the inner contacting surface 58 of the inner shell 54 of the first stabilizer 51 at the machine end of the bridge sleeve 30 becomes similarly expanded in diameter and retracted from contact with the outer surface 45 of the mandrel 40. Thus, the inner contacting surfaces 58 of both stabilizers 51, 52 become retracted from contact with the outer surface 45 of the mandrel 40. As schematically shown in FIG. 15, continued supply of the pressurized air 203 penetrates beneath the inner surface 148 of the radially expandable cylindrical inner core 38 of the bridge sleeve 30 in the usual manner to provide a cushion of air that enables the bridge sleeve 30 to be slid off of the outer surface 45 of the mandrel 40.

As shown in FIGS. 3 and 4, a groove 84 is configured to interrupt the threaded surface 83 of the respective end cap 81, 82, and this groove 84 extends completely circumferentially around on the exterior of the respective end cap 81, 82. The function of this groove 84 as part of a passage for distributing compressed air to each of the stabilizers 51, 52 is described below.

Air mounting of the print sleeve 41 onto the outer surface 35 of the bridge sleeve 30 can be accomplished by providing the bridge sleeve 30 with either a piped air mounting circuit or an air flow through mounting circuit. With a piped air mounting circuit, air mounting of the print sleeve 41 onto the outer surface 35 of the bridge sleeve 30 can be accomplished either before or after the bridge sleeve 30 has been mounted onto the outer surface 45 of the mandrel 40 of the printing machine. Thus, an embodiment of a bridge sleeve 30 with an exemplary piped air mounting circuit now will be described.

Once the bridge sleeve 30 is mounted onto the mandrel 40 and the pressurized air in the pressurized air circuit that actuates the stabilizers 51, 52 has been released as schematically shown in FIG. 12 so as to shrink the diameter of the inner contacting surfaces 58 of the stabilizers 51, 52 into contact with the outer surface 45 of the mandrel 40 as schematically shown in FIGS. 11, 12 and 16 for example, the print sleeve 41 can be air-mounted onto the outer surface 35 of the bridge sleeve 30. For this purpose of mounting a print sleeve 41 onto the outer surface 35 of the bridge sleeve 30, the bridge sleeve 30 includes a print sleeve pressurized air mounting circuit.

One embodiment of the print sleeve pressurized air mounting circuit desirably can define a substantially separate flow path from the flow path of the pressurizing air circuit that expands the diameters of the inner contacting surfaces 58 of the stabilizers 51, 52. Moreover, this embodiment of the print sleeve pressurized air mounting circuit can be supplied with pressurized air either while the bridge sleeve 30 is mounted on the outer surface 45 of the mandrel 40 as schematically shown in FIG. 16 for example or before the bridge sleeve 30 is ever mounted on the mandrel 40. In the latter case, the combination of the print sleeve 41 mounted on the bridge sleeve 30 is then mounted on the mandrel 40.

As schematically shown in FIG. 16 by the arrow designated by the numeral 401, pressurized air is supplied to the bridge sleeve 30 from an outside source that typically is available in the environment of these sorts of printing machines. As shown in FIG. 1, a coupling 34 from a pressurized air source 47 can be fitted into a pressure tight receptacle 33 that is axially formed in the end cap 81 at the machine end of the bridge sleeve 30. This pressurized air 401 follows a short axially extending path into the machine end cap 81 before turning in the radial direction to enter an axial outer conduit 305 that is formed in the outer shell 53 of the stabilizer 51 disposed at the machine end of the bridge sleeve 30. Additionally, this pressurized air 401 is routed circumferentially via the groove 84 configured to interrupt the threaded surface 83 around on the exterior of the end cap 81 as shown in FIGS. 3 and 5 for example. In this way, the pressurized air 401 entering the machine end stabilizer 51 is directed to two identically configured branches of the print sleeve pressurized air mounting circuit. As schematically shown in FIG. 16, these two identical branches are separated from one another by 180 degrees. Note that this axial outer conduit 305 formed in the outer shell 53 of the first stabilizer 51 does not communicate with the space between the inner shell ring 60 and the outer shell ring 70 and thus cannot actuate the expansion of the inner contacting surfaces 58 of the stabilizers 51, 52.

As schematically shown in FIG. 16, the arrows designated 402 further indicate that the pressurized air 402 flows axially down the respective axial outer conduit 305 toward the operator end of the bridge sleeve 30 before turning in a radial direction toward the axial center line of the bridge sleeve 30 as indicated by the arrows designated 403. Thereafter, as indicated by the arrows designated 404, the pressurized air 404 turns again toward the operator end of the bridge sleeve 30 and travels down a respective axial inner conduit 307. The inwardly facing end of the axial inner conduit 307 is connected to a press fitted connector 104 that is connected to a respective axially extending pipe 75. As indicated by the arrows designated 405, axially extending pipe 75 carries the pressurized air 405 generally in the axial direction toward the operator end of the bridge sleeve 30. The air 404 exiting the axially extending pipe 75 at the operator end of the bridge sleeve 30 enters and travels through a respective axial inner conduit 307 formed in the outer shell 53 of the second stabilizer 52 at the operator end of the bridge sleeve 30 via another press fitted connector 104.

As indicated by the arrow designated 404 in FIG. 16, the pressurized air 404 travels down the axial inner conduit 307 of the outer shell 53 of the second stabilizer 52 that is disposed at the operator end of the bridge sleeve 30 and enters a radial conduit 309 formed in the outer shell 53 of the second stabilizer 52. As indicated by the arrow designated 406, the pressurized air leaves the radial conduit 309 and turns in an axial direction toward the end cap 82 at the operator end of the bridge sleeve 30 and enters a respective radial outer conduit 305 formed in the outer shell 53 of the second stabilizer 52. The pressurized air flowing axially down the respective radial outer conduit 305 is schematically indicated by the arrow designated 407. Note that this axial outer conduit 305 formed in the outer shell 53 of the second stabilizer 52 does not communicate with the space between the inner shell ring 60 and the outer shell ring 70 and thus cannot actuate the expansion of the inner contacting surfaces 58 of the stabilizers 51, 52.

As schematically indicated by the arrow designated 408 in FIG. 16, the pressurized air from each respective axial outer conduit 305 enters a circumferentially extending plenum 184 that is connected directly to the inner open end of each of a plurality of radial passages 136 that are defined through the rigid outermost layer 37 of the bridge sleeve 30. The circumferentially extending plenum 184 at the operator end of the bridge sleeve 30 is defined in part by the groove 84 that is configured to interrupt the threaded surface 83 around on the exterior of the operator end cap 82 as shown in FIGS. 4 and 6 for example. Each of the radial passages 136 terminates in one of the air holes 36 (FIG. 1) that are used for air mounting the print sleeve 41 onto the outer surface 35 of the bridge sleeve 30. The arrows designated 409 in FIG. 16 schematically represent the pressurized air exiting from the passages 136 via the air holes 36 defined in the outer surface 35 of the bridge sleeve 30.

Note that each of the outer shells 53 of each of the stabilizers 51, 52 is provided with four separate paths formed by three connected conduits, each of the four paths separated from the nearest path circumferentially by 90 degrees. A pair of these separate paths comprising conduits 105, 107, 109 forms part of the pressurized air circuit that actuates the expansion and contraction of the inner contacting diameters 58 of the stabilizers 51, 52, and each conduit in this pair is separated circumferentially from the other by 180 degrees. While the two paths in the other pair of paths comprising conduits 305, 307, 309 in each of the outer shells 53 of the stabilizers 51, 52 separately are connected to the pressurized air circuit that is used to mount the print sleeve 41 onto the outer surface 35 of the bridge sleeve 30.

FIG. 16 illustrates an alternative construction of the bridge sleeve 30 that employs an additional cylindrical layer 138 of fiberglass reinforced resin material that is disposed between the rigid outer carbon fiber cylinder 37 and the interior of the bridge sleeve 30. In the FIG. 16 embodiment, the inner cylindrical surface 124 of the rigid carbon cylindrical outer layer 37 is connected to the portion of the outer surface 122 of each of the outer shells 53 that has the larger diameter. Thus, the outer surface 122 of the larger diameter portion of the outer shell 53 does not form part of the outer surface 35 of the bridge sleeve 30 in the embodiment depicted in FIG. 16. Instead the entire outer surface 35 of the bridge sleeve 30 depicted in FIG. 16 is formed by the outer surface of the rigid carbon fiber cylindrical layer 37. Instead of the inner surface 124 of the rigid carbon fiber layer 37 contacting the outer surface 125 of the smaller diameter portion of the outer shell 53 of each of the stabilizers 51, 52, an end portion of the inner surface 127 of another fiberglass resin cylindrical layer 138 contacts this outer surface 125 of the smaller diameter portion of each of the outer shells 53. However, there is no compressible layer between each of the outer shells 53 and this additional cylindrical layer 138 of fiberglass reinforced material. Nor is there any compressible layer 39 between the outer surface 128 of this additional fiberglass cylindrical layer 138 and the inner surface 124 of the rigid carbon fiber cylindrical layer 37 that defines the outer surface 35 of the bridge sleeve 30. Nonetheless, the additional fiberglass cylindrical layer 138 is believed to contribute to the stability of the bridge sleeve at relatively higher rotational rates that are required to run substrate through the printing machine at speeds on the order of 1,000 meters per minute.

Figure 17:
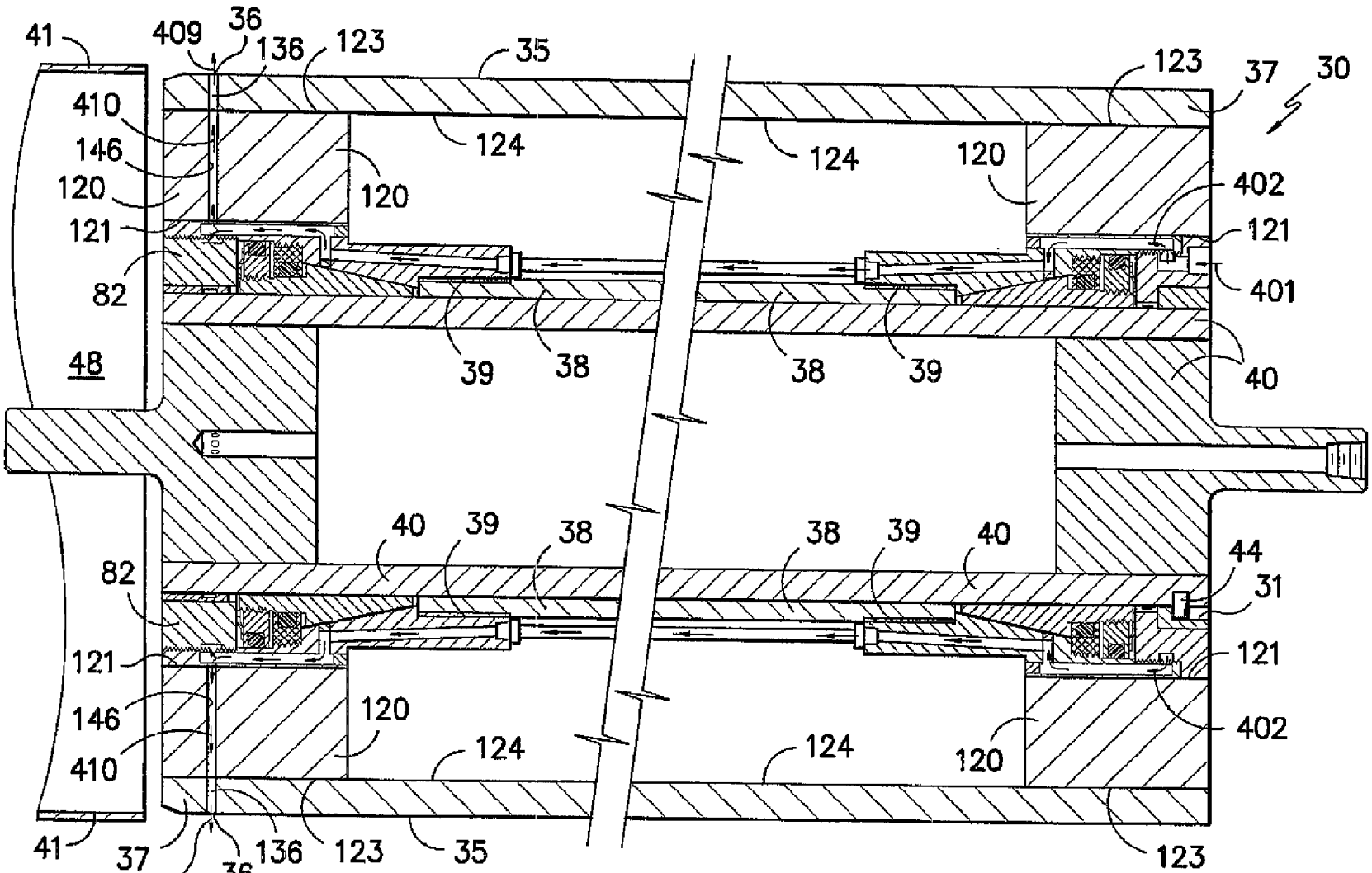
FIG. 17 shows an alternative embodiment of the bridge sleeve with a larger diameter mounted to the mandrel, and machine air being supplied to the bridge sleeve's separate, piped through air system that is used to mount the print sleeve that approaches the operator end of the bridge sleeve.

FIG. 17 illustrates an alternative embodiment of the bridge sleeve 30 that adds at each opposite end of the bridge sleeve 30, a build-up annular member 120 having an inner surface 121 that is connected rigidly to the larger diameter portion of the outer surface 122 of the outer shell 53. As schematically shown in FIG. 17, each build-up annular member 120 has an outer surface 123 that is rigidly connected to the inner cylindrical surface 124 of the rigid carbon fiber outer layer 37 that defines the bridge sleeve 30 in the embodiment shown in FIG. 17. The radial thicknesses of the build-up annular members 120 enable the use of larger print sleeves 41 without having to change the mandrel 40. So as to minimize the weight of the embodiment of the bridge sleeve 30 depicted in FIG. 17, each of the build-up annular members 120 desirably is formed of carbon fiber or aluminum or a hardened, expanded rigid polyurethane foam material that also is an incompressible material. Each of the radial passages 146 defined in the build-up annular member 120 is disposed to align and connect with one of the radial passages 136 in the rigid outermost layer 37 of the bridge sleeve 30 and so ultimately terminates in one of the air holes 36 (FIG. 1) that are used for air mounting the print sleeve 41 onto the outer surface 35 of the bridge sleeve 30. The arrows designated 410 in FIG. 17 schematically represent the pressurized air flowing through the passages 146 defined in the build-up annular member 120 toward the air holes 36 defined in the outer surface 35 of the bridge sleeve 30.

Figure 18:
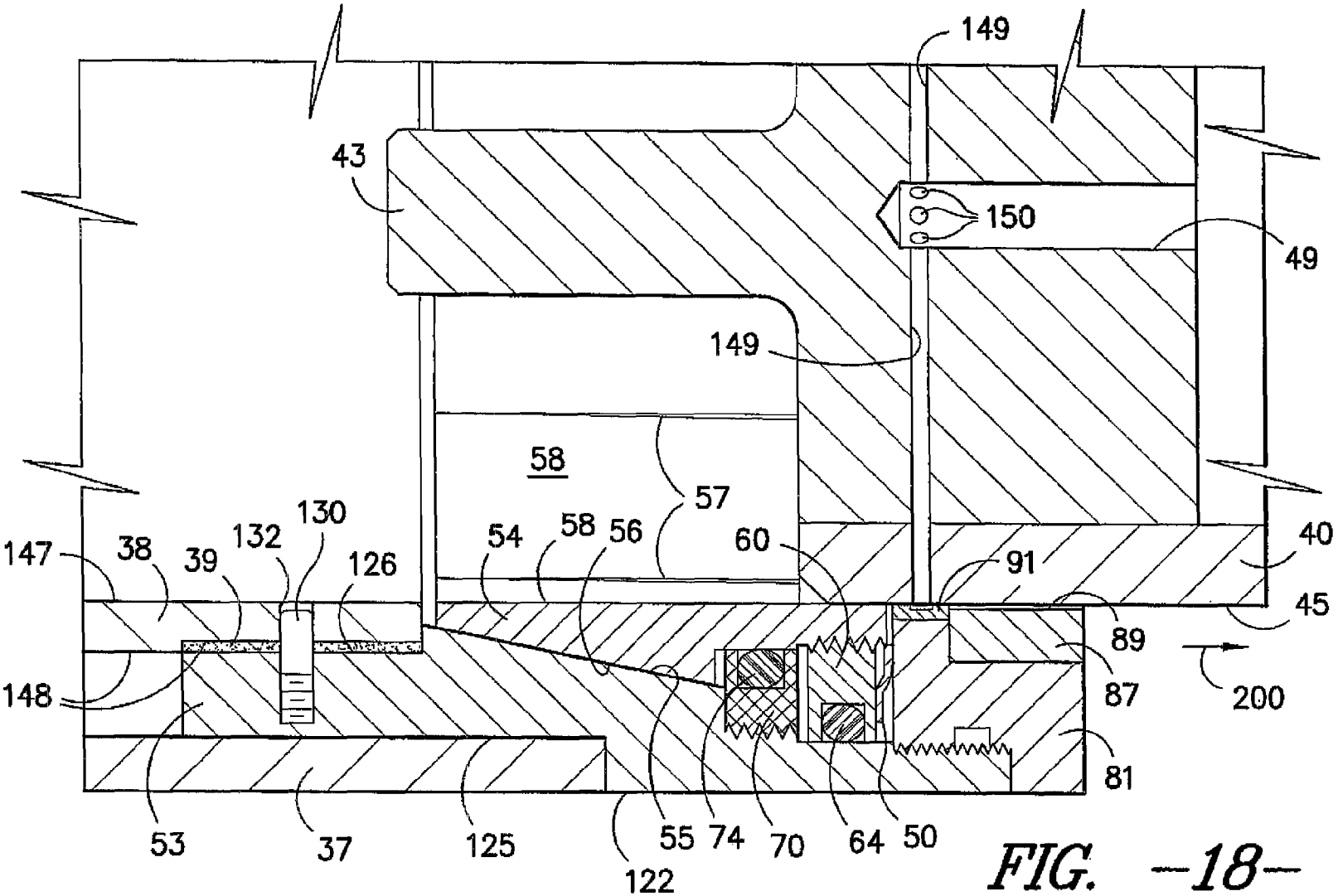
FIG. 18 schematically represents a cross-sectional view of a portion of components of the machine end of an embodiment of a bridge sleeve that has a pinned inner core layer attached to the outer shell of the machine end stabilizer.
Figure 19:
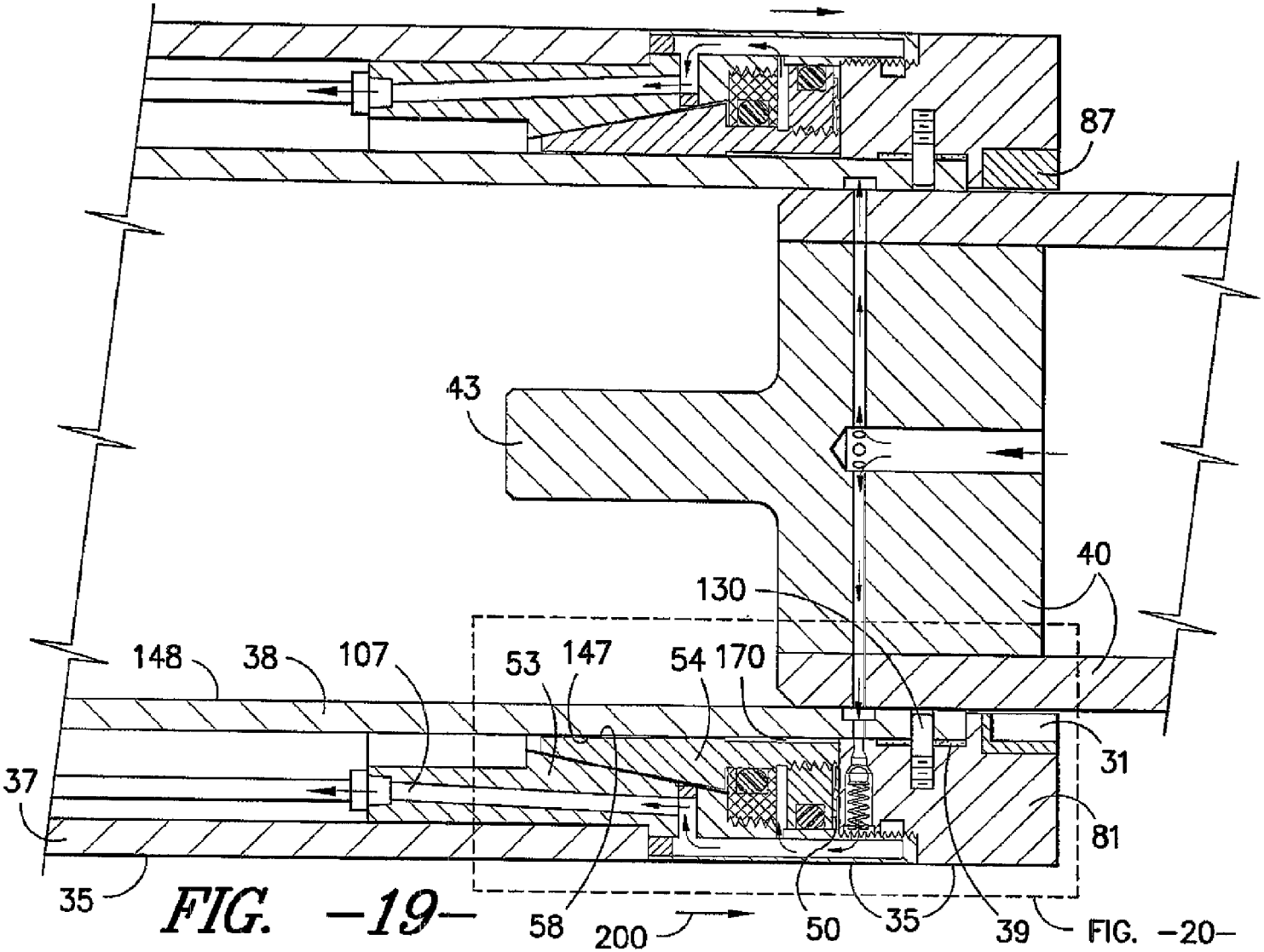
FIG. 19 schematically represents a cross-sectional view of an embodiment of the bridge sleeve that has the expandable inner core extending beneath the stabilizers with the axially sliding inner shell.

FIG. 18 schematically illustrates another alternative embodiment of the configuration of the bridge sleeve 30 in which each of the extreme opposite ends of the inner core layer 38 is connected via a compressible layer 39 to the inner surface 126 of the smaller diameter portion of one of the outer shells 53 that is disposed inwardly from the conical surface 55 of the outer shell 53. Moreover, each of radial pins 130 is arranged circumferentially spaced apart from each other radial pin 130 with one end of each radial pin 130 fixed in a hole formed radially into the inwardly facing portion of the outer shells 53 so that the radial pin 130 extends away from the inner surface 126 thereof. The opposite end of each of the radial pins 130 extends slidably through a hole 132 formed radially through the inner core layer 38 and the compressible layer 39 but is not long enough to extend beyond the inner surface 148 of the inner core layer 38. The radial pins 130 are provided so as to permit radial movement of the inner core layer 38 against the compressible layer 39 while preventing relative circumferential or axial movement between the inner core layer 38 and the stabilizers 51, 52.

In the embodiments of the bridge sleeve 30 schematically depicted in each of FIGS. 19, 20, 21 and 22, each of the extreme ends of the inner core layer 38 is connected to one of the end caps 81 or 82 instead of to one of the outer shells 53 of the respective stabilizers 51, 52. Accordingly, in each of these embodiments of the bridge sleeve 30, the inner contacting surface 58 of the inner shell 54 of each stabilizer 51, 52 contacts the outer surface 147 of the inner core layer 38 instead of directly contacting the outer surface 45 of the mandrel 40 when the diameter of the inner contacting surface 58 is sufficiently reduced by the action of the conical spring 50.

Figure 20:
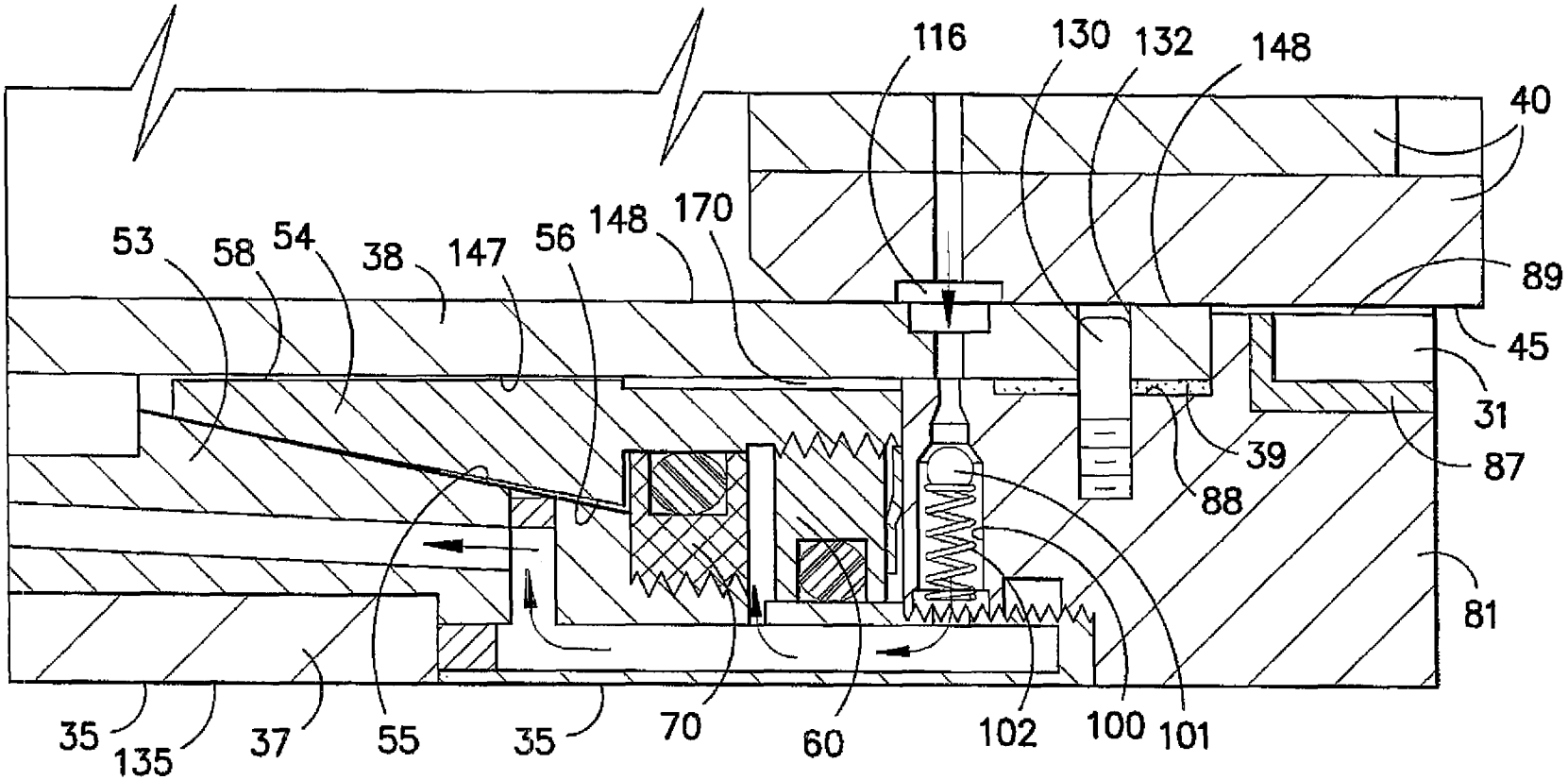
FIG. 20 schematically represents an enlarged portion of the machine end of the bridge sleeve being mounted on the mandrel of the printing machine depicted in FIG. 19 with the machine air turned on to move the axially sliding inner shell to compress the conical spring and allow the diameter of the inner contacting surface of the inner shell to expand.
Figure 21:
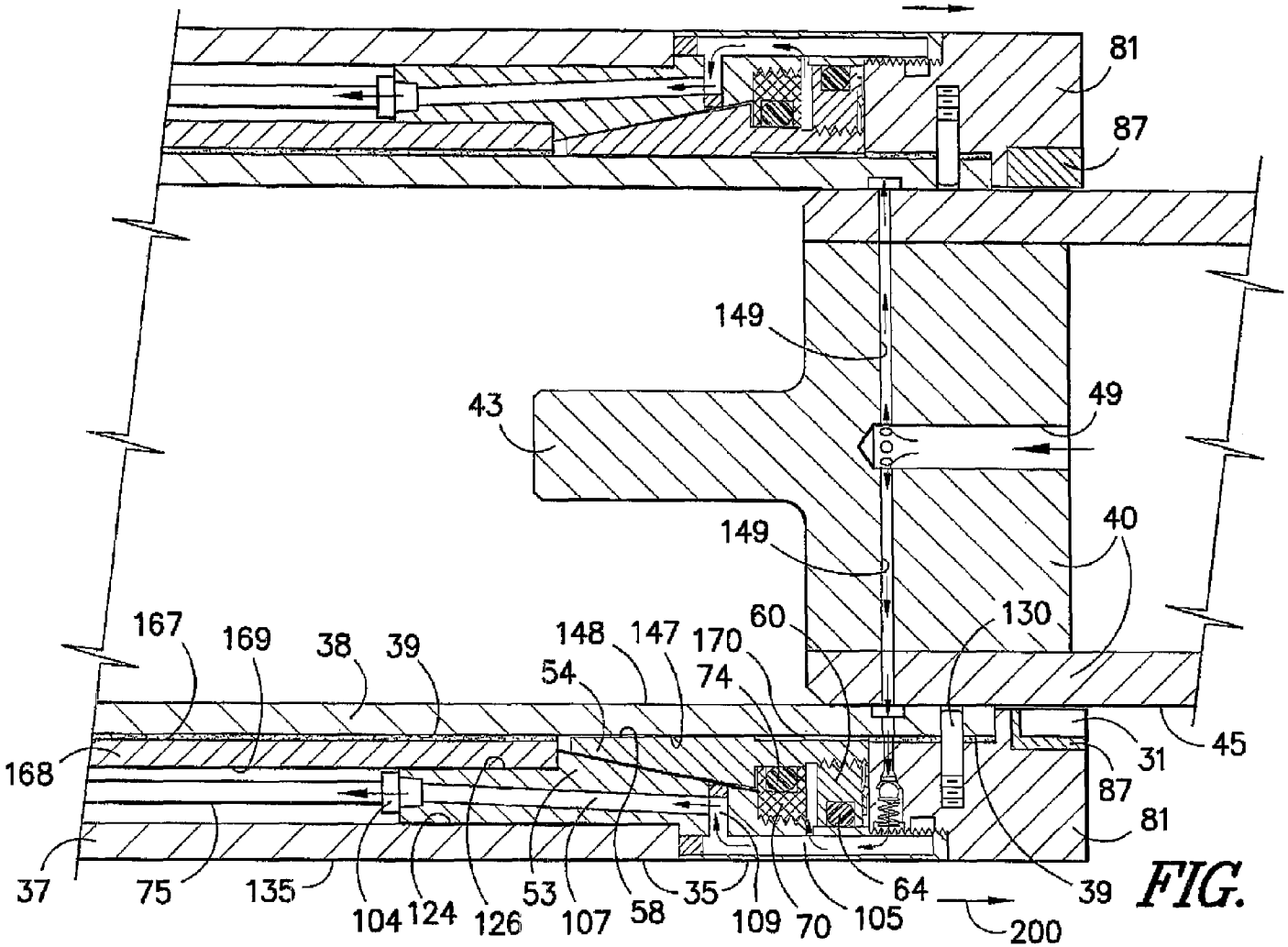
FIG. 21 schematically represents a cross-sectional view of an embodiment of the bridge sleeve that has the expandable inner core extending beneath the stabilizers with the axially sliding inner shell.
Figure 22:
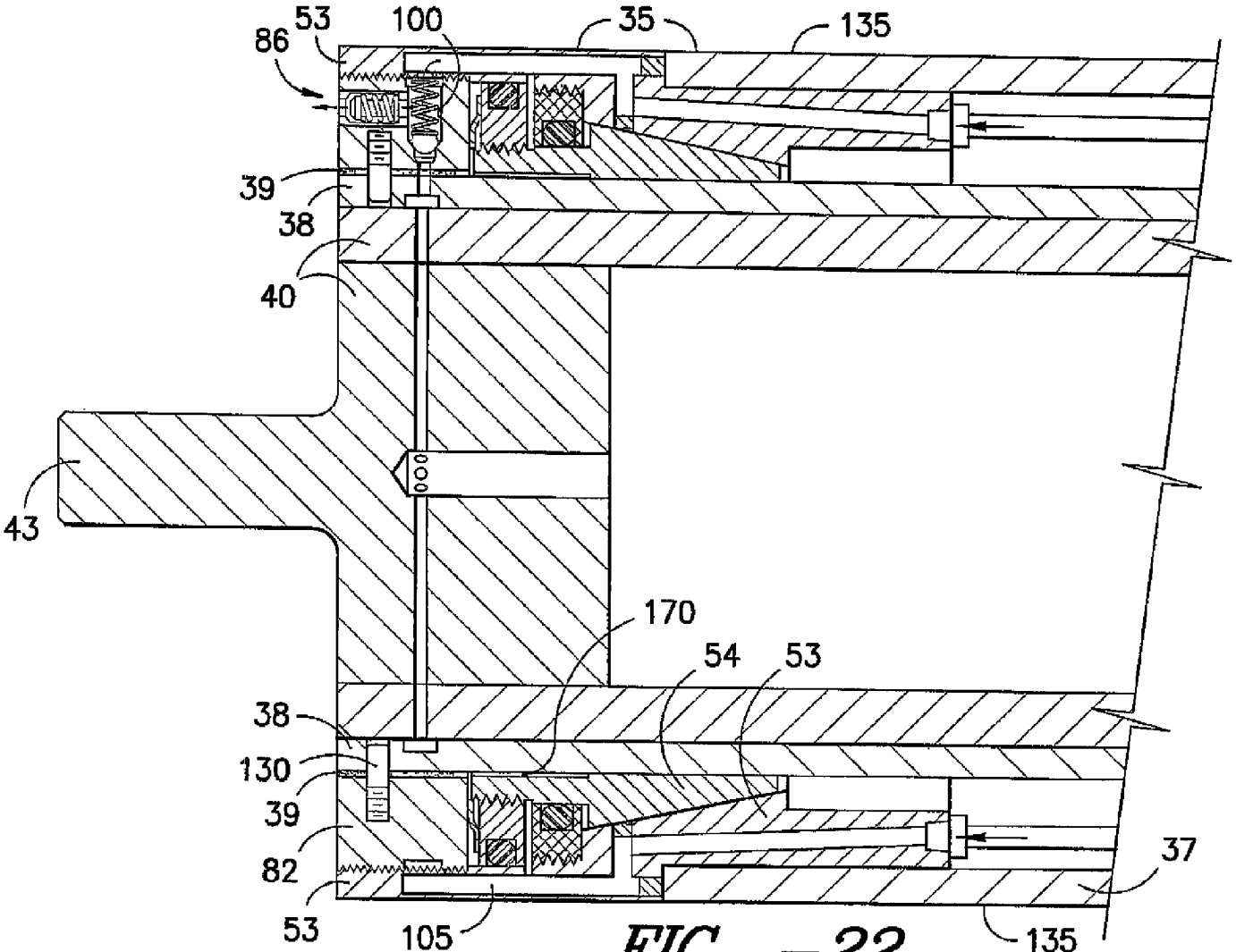
FIG. 22 schematically represents a cross-sectional view of an embodiment of the bridge sleeve that has the expandable inner core extending beneath the stabilizers with the axially sliding inner shell.

Moreover, in the embodiments of the bridge sleeve 30 schematically depicted in each of FIGS. 19, 20, 21 and 22, the connection of the extreme ends of the inner core layer 38 to one of the end caps 81, 82 is done with the interposition of a compressible layer 39 between the inner core layer 38 and the end cap 81 or 82. FIG. 22 schematically represents a cross-sectional view of the operator end of the bridge sleeve 30 depicted in FIG. 19.

FIG. 20's relatively enlarged view facilitates explanation of the configuration present in each of FIGS. 19, 20, 21 and 22, wherein each of a plurality of radial pins 130 is arranged circumferentially spaced apart from each other radial pin 130 with one end of each radial pin 130 fixed in a hole formed radially through the inner surface 88 of the respective end cap 81 or 82 so that the radial pin 130 extends away from the inner surface 88 thereof. The opposite end of each of the radial pins 130 extends slidably through a hole 132 formed radially through the inner core layer 38 and the compressible layer 39 but is not long enough to extend beyond the inner surface 148 of the inner core layer 38. Additionally, as shown in FIG. 20, the pins 130 are provided through the inner core layer 38 near the extreme end thereof to permit the movement in the radial direction of the inner core layer 38 with respect to the outer surface 45 of the mandrel and the inner surface 88 of the end cap 81 or 82 when the bridge sleeve 30 is being mounted onto the outer surface 45 of the mandrel 40.

Moreover, as shown in FIGS. 19, 20, 21 and 22, the inner contacting surface 58 of the inner shell 54 touches the outer surface 147 of the inner core layer 38 rather than the outer surface 45 of the mandrel 40. However, since the inner core layer 38 is not radially compressible, this arrangement still provides rigid continuous radial contact from the outer surface 45 of the mandrel 40 to the outer surface 35 of the bridge sleeve 30.

As schematically shown in FIG. 21, an additional cylindrical layer 168 that desirably formed of fiberglass reinforced resin material is disposed between a compressible layer 39 and the inner core layer 38. The outer surface 169 of each end section of this additional cylindrical layer 168 is connected to the inner surface 126 of the smaller diameter portion of one the outer shells 53 of one of the stabilizers 51, 52. The compressible layer 39 contacts the outer surface 147 of the inner core layer 38 and the inner surface 167 of the additional cylindrical layer 168. The embodiment in FIG. 21 is one of the embodiments in which the outer cylindrical surface 135 of the rigid carbon fiber outer layer 37 serves as the major part of the outer surface 35 of the bridge sleeve 30.

As schematically shown in FIGS. 19, 20, 21 and 22, while the inner contacting surface 58 of inner shell 54 directly contacts the outer surface 147 of the inner core layer 38, the remaining outwardly facing portion of the inner surface of the inner shell 54 defines a recess 170 that provides a gap between the inner shell 54 and the outer surface 147 of the inner core layer 38. This recess 170 is thought to facilitate mounting the machine end of the bridge sleeve 30 onto the outer surface 45 of the mandrel 40.

Figure 23:
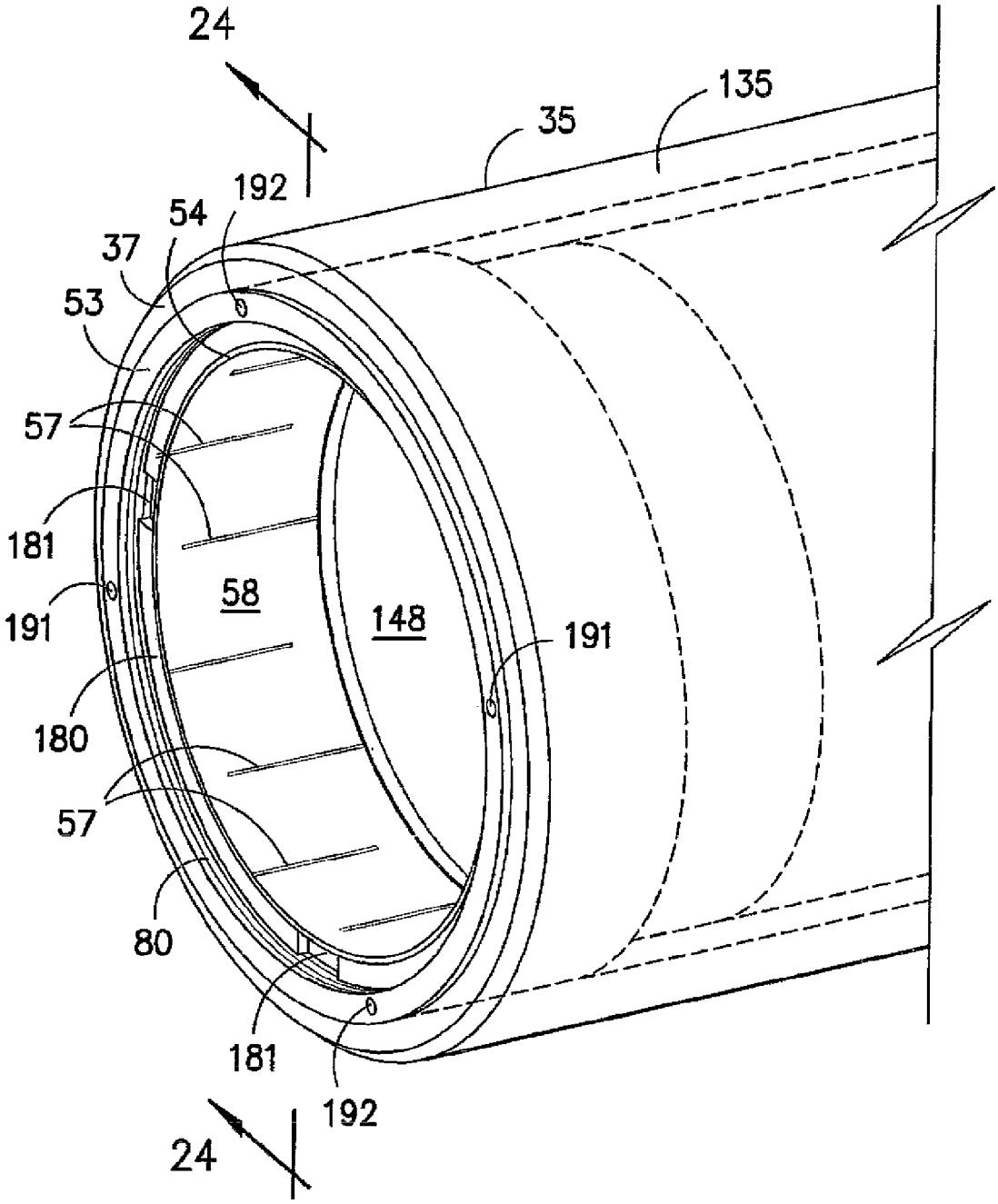
FIG. 23 schematically represents an elevated perspective view of an embodiment of the operator end of a bridge sleeve in accordance with an embodiment of the invention.
Figure 24:
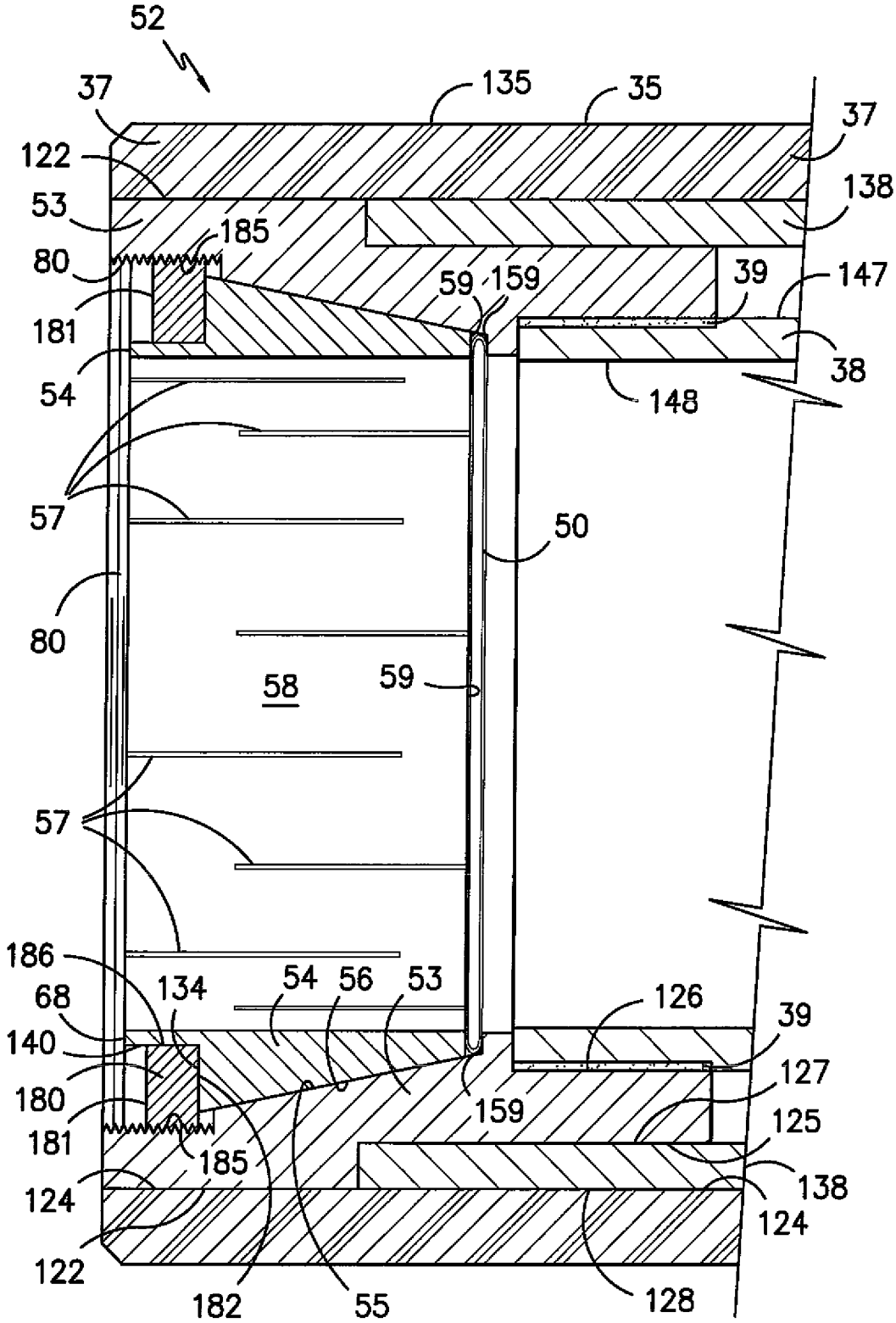
FIG. 24 schematically represents a cross-sectional view taken along the lines 24-24 of the embodiment of the stabilizer of FIG. 23 at the operator end of the bridge sleeve before it is being mounted on the mandrel, showing the pinched slots that maximize the inner diameter of the stabilizer.
Figure 25:
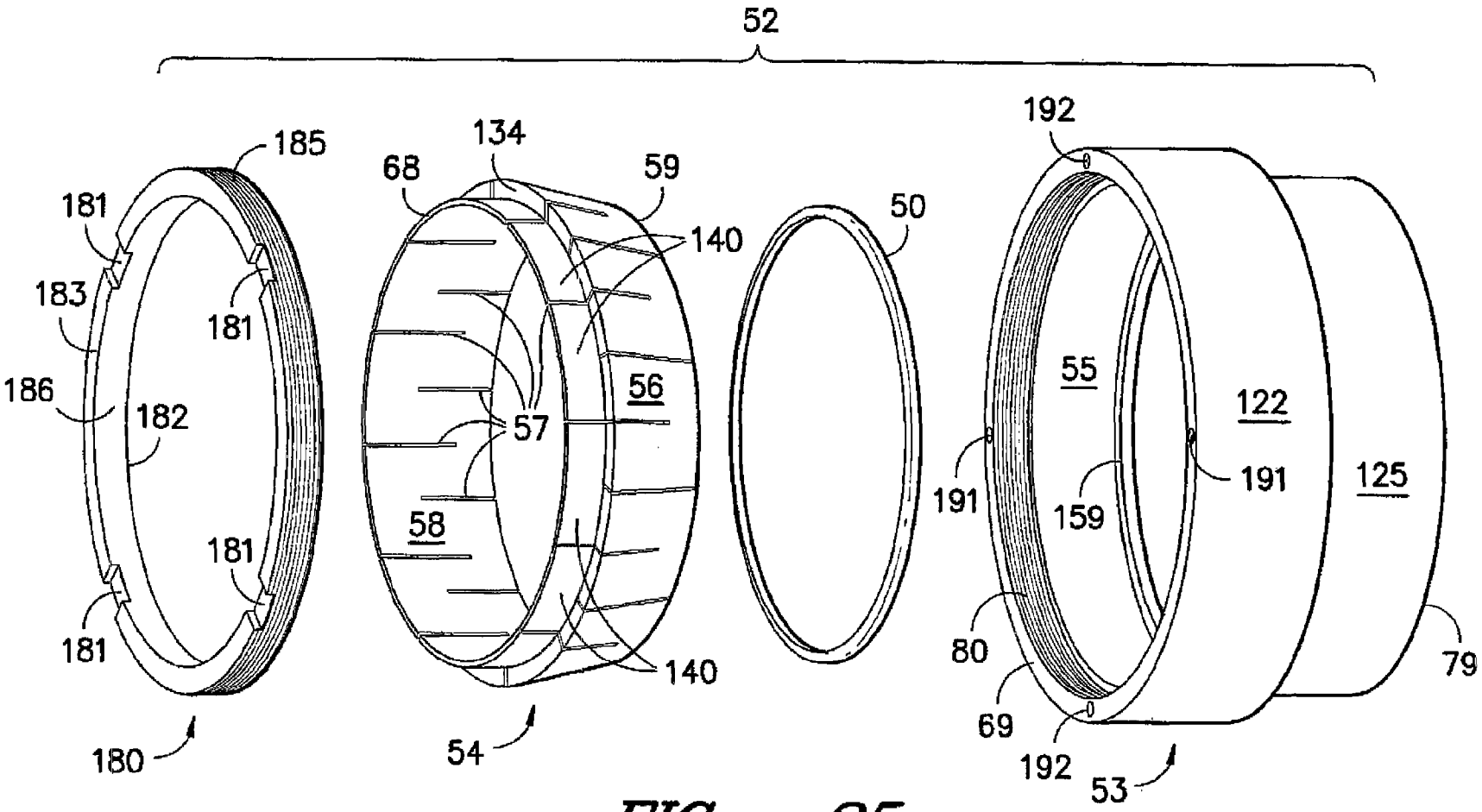
FIG. 25 schematically represents an unassembled perspective view of an embodiment of a stabilizer for the operator end of an embodiment of the bridge sleeve, showing the fully expanded slots that indicate the maximum inner diameter of the stabilizer.

An alternative embodiment of an operator end stabilizer 52 of a bridge sleeve 30 is depicted in FIGS. 23-25 for example. This particular embodiment of the operator end stabilizer 52 provides a manually actuatable mechanism for changing the diameter of the inner contacting surface 58 of the inner shell 54 of the operator end stabilizer 52. As shown in FIGS. 23-25 for example, a special form of the machine end cap 81 (shown in FIGS. 3-5) is provided in the form of a manually actuatable actuator ring 180. As shown in FIGS. 24 and 25 for example, this embodiment of the actuator ring 180 is provided on its outer circumference with a threaded outer surface 185 that can be screwed into the threaded circumferential surface 80 on the interior section of the outer shell 53 that is disposed adjacent the outwardly facing free edge 69 of the outer shell 53 in much the same way that the machine end cap 81 shown in FIGS. 3-5 is provided with the threaded outer circumferential surface 83 that screws onto the threaded surface 80 on the interior section of the outer shell 53.

As schematically shown in FIG. 24 for example, the inner shell 54 desirably has slots 57 extending axially from the outwardly-facing edge 68 and formed in the tongue flange 140 as well as slots 57 extending axially from the inward-facing edge 59 and formed in the portion defining the conical surface 56. The inward-facing edge 59 of the inner shell 54 is pressed against the outwardly facing side of the conical spring 50. The opposite surface of the conical spring 50 facing toward the center of the bridge sleeve 30 is backstopped by a shoulder 159 that is formed in the inner surface of the outer shell 53. As schematically shown in FIG. 24 for example, the shoulder 159 desirably is disposed nearest the narrowest diameter portion of the conical surface 55 of the outer shell 53. As schematically shown in FIG. 24 for example, the inner face 182 of this embodiment of the actuator ring 180 butts against the outward-facing shoulder 134 of the inner shell 54. The inner surface 186 of the actuator ring 180 rotates against the surface of the tongue flange 140 of the inner shell 54.

With reference to the embodiment depicted in FIGS. 24 and 25, a key (not shown) in the form of a cross desirably is provided with feet that fit into the key slots 181 formed in the outer face 183 of the actuator ring 180 that is a special form of the machine end cap 81 (shown in FIGS. 3-5). When the operator rotates the actuator ring 180 by means of force applied to the cross key (not shown) inserted into the key slots 181 in a first circumferential direction, the embodiment of the actuator ring 180 depicted in FIG. 24 moves axially inwardly toward the center of the bridge sleeve 30 so as to move the inner shell 54 in the same axial direction whereby the inward-facing edge 59 compresses the conical spring 50 and causes the inner conical surface 55 of the outer shell 53 to compress the outer conical surface 56 of the inner shell 54 circumferentially and radially while ensuring positive direct contact between the outer shell 53 and the inner shell 54 along their respective conical surfaces 55, 56. Such circumferential and radial compression of the conical surface 56 of the inner shell 54 has the effect of narrowing the gaps defining the slots 57 formed in the inner shell 54 and commensurately reducing the diameter of the inner contacting surface 58 of the inner shell 54, thereby ensuring positive direct contact between the inner contacting surface 58 of the inner shell 54 and the outer surface 45 of the mandrel 40. In this way, once the bridge sleeve 30 is mounted in its operative position on the mandrel 40, the inner contacting surface 58 of the stabilizer 52 can be deployed into contact with the outer surface 45 of the mandrel 40 so as to maintain direct rigid and incompressible contact from the outer surface 45 of the mandrel 40 to the outer surface 35 of the rigid carbon fiber outer layer 37 of the bridge sleeve 30.

Conversely, as shown in the FIG. 24 embodiment, rotation of the actuator ring 180 circumferentially in the opposite direction has the effect of allowing the conical spring 50 to expand against the inward-facing edge 59 of the inner shell 54 to push the inner shell 54 axially in the outward direction away from the center of the bridge sleeve 30, thereby eliminating the compressive effect of the conical surface 55 of the outer shell 53 against the conical surface 56 of the inner shell 54. This elimination of the circumferential and radial compression of the conical surface 56 of the inner shell 54 has the effect of allowing the slots 57 of the inner shell 54 to expand to their maximum circumferential gaps as shown in FIG. 24 for example. Accordingly, the diameter of the inner contacting surface 58 of the inner shell 54 increases commensurately to a diameter that is greater than the diameter of the outer surface 45 of the mandrel 40 and greater than the inner surface 148 of the radially expandable cylindrical inner core 38 in the latter's unexpanded state in the absence of any pressurized air cushion as shown in FIG. 24 for example. In this state, the stabilizers 51, 52 no longer contact the outer surface 45 of the mandrel 40 and thus allow for mounting and dismounting of the bridge sleeve 30 with respect to the mandrel 40.

Though not shown in the views of FIGS. 23-25 for example, the manually actuatable operator end stabilizer 52 nonetheless is provided with the requisite pressurized air circuits addressed by holes 191 or 192 that are necessary for actuating the expansion and contraction of the inner contacting surface 58 of the machine end stabilizer 51 and providing pressurized air to the holes 36 (not shown for the sake of simplification) that would be formed at the operator end of the bridge sleeve 30 for purposes of being able to air mount a print sleeve 41 onto the outer surface 35 of the bridge sleeve 30. Once the desired diameter of the inner contacting surface 58 of the operator end stabilizer 52 has been set manually by the operator, the cross key (not shown) is removed, and an operator end cap 82 (not shown) is screwed into the remaining segment of the threaded surface 80 closest to the outwardly facing free edge 69 on the interior section of the outer shell 53 with appropriate fixtures for attaching a supply of pressurized air to the bridge sleeve 30 via entrance holes 191 or 192 formed in the outwardly facing free edge 69 of the outer shell 53, whether for purposes of actuating the variation in the diameter of the inner contacting surface 58 of the machine end stabilizer 51 or for purposes of accepting a flow of pressurized air from the holes 46 in the outer surface 45 of the mandrel 40 to facilitate air mounting of the print sleeve 41 onto the outer surface 35 of the bridge sleeve 30.

Figure 26:
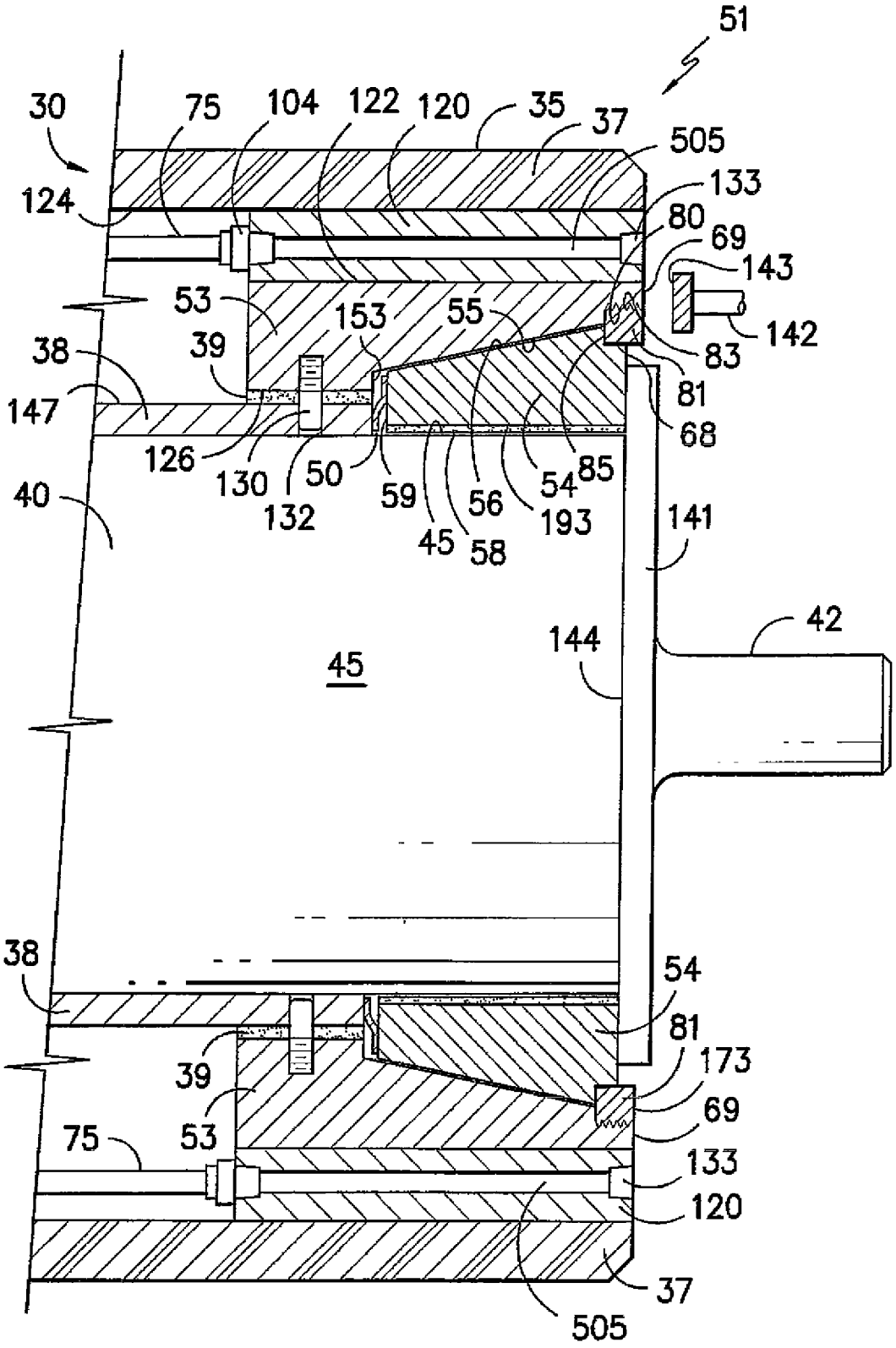
FIG. 26 schematically represents an elevated perspective view of another embodiment of the operator end of a bridge sleeve in accordance with another embodiment of the invention.
Figure 27:
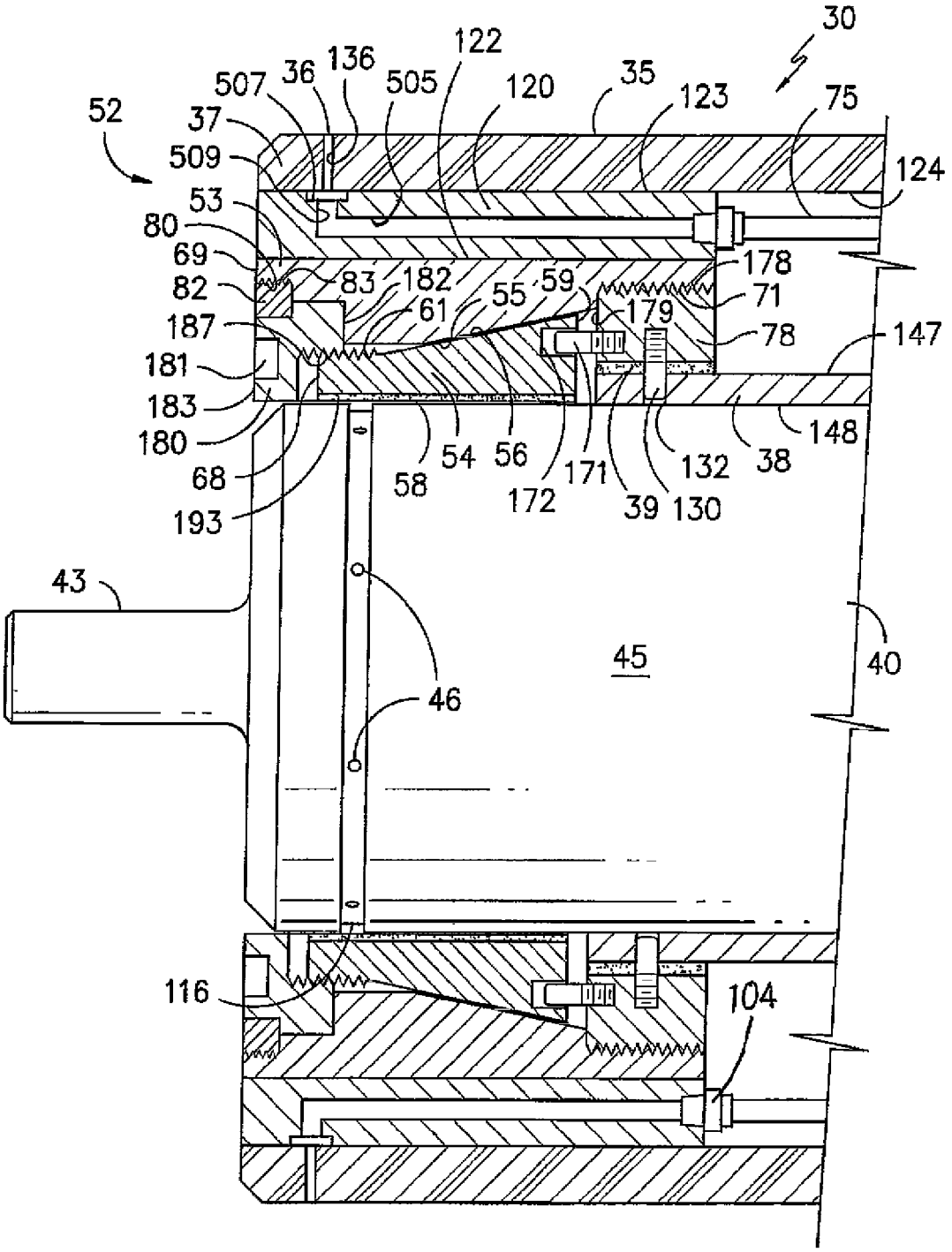
FIG. 27 schematically represents an elevated perspective view of another embodiment of the machine end of a bridge sleeve in accordance with the embodiment of FIG. 26.

Two additional embodiments of bridge sleeves 30 with stabilizers 51, 52 that can be manually actuated to change the diameter of the inner contacting surface 58 of the inner shells 54, and thus of the stabilizers 51, 52, are depicted in FIGS. 26-29. FIGS. 26 and 27 illustrate an embodiment of a bridge sleeve 30 that includes an embodiment of a piped pressurized air circuit for mounting a printing sleeve 41 on the outer surface 35 of the bridge sleeve 30. FIG. 26 illustrates the machine end of the bridge sleeve 30 with the machine end stabilizer 51 and the mandrel 40, while FIG. 27 illustrates the operator end of the bridge sleeve 30 with the operator end stabilizer 52 and the mandrel 40. In the embodiment of FIGS. 26 and 27, the inner contacting surfaces 58 of the stabilizers 51, 52 can be selectively positioned by manual operation of mechanical means to directly contact the outer surface 45 of the mandrel 40. In embodiments of a bridge sleeve 30 fitted with a piped pressurized air circuit for mounting a print sleeve 41 (FIG. 1) onto the outer surface 35 of the bridge sleeve 30 such as depicted in FIGS. 26 and 27, it is possible to mount the print sleeve 41 onto the bridge sleeve either before or after the bridge sleeve 30 is air mounted onto the mandrel 40 of the printing machine.

Similarly, FIGS. 28 and 29 illustrate an embodiment of a bridge sleeve 30 that is fitted with an embodiment of a flow-through pressurized air circuit for mounting a print sleeve 41 onto the outer surface 35 of the bridge sleeve 30. FIG. 28 illustrates the machine end of the bridge sleeve 30 with the machine end stabilizer 51 and the mandrel 40, while FIG. 29 illustrates the operator end of the bridge sleeve 30 with the operator end stabilizer 52 and the mandrel 40. In the embodiment of FIGS. 28 and 29, the inner contacting surfaces 58 of the stabilizers 51, 52 can be selectively positioned by manual operation of mechanical means to directly contact the outer surface 147 of the radially expandable cylindrical inner core 38, and the inner surface 148 of the radially expandable cylindrical inner core 38 in turn directly contacts the outer surface 45 of the mandrel 40.

Though not visible in the views shown in FIGS. 26-29, each inner shell 54 defines the same sorts of slots 57 such as those depicted in FIGS. 3-6 or those depicted FIGS. 23-25 for example. As will become apparent with further references to FIGS. 26-29, each of the machine end stabilizers 51 is actuated by pressure exerted by the shoulder 141 of the mandrel 40 against the outwardly-facing edge 68 of the inner shell 54 when the bridge sleeve 30 is air-mounted onto the mandrel 40, and the result of this manual actuation brings the inner contacting surface 58 of the machine end stabilizer 51 into stable rigid contact with the outer surface 45 of the mandrel 40 (FIG. 26) or the outer surface 147 of the inner core 38 (FIG. 28). When the pressurized air cushion is removed from the mandrel 40 so that the inner surface 148 of the inner core 38 of the bridge sleeve 30 is fixed immovably to the outer surface 45 of the mandrel 40, then each operator end stabilizer 52 is actuated by manual rotation of an actuator ring 180 so that the inner contacting surface 58 of the operator end stabilizer 52 is brought into stable rigid contact with the outer surface 45 of the mandrel 40 (FIG. 27) or the outer surface 147 of the inner core 38 (FIG. 29).

As shown in FIGS. 26-29 for example, in these embodiments of the inner shell 54, it is desirable for the inner contacting surface 58 to be formed by a thin layer or coating 193 that is disposed on the entire portion of the inner surface of the inner shell 54 that is to be brought into contact with the outer surface 45 of the mandrel 40 (FIGS. 26 and 27) or the outer surface 147 of the inner core layer 38 (FIGS. 28 and 29) of the bridge sleeve 30. The radial thickness of this coating 193 has been exaggerated in FIGS. 26-29 for purposes of ease of explanation. This coating 193 desirably is formed of a layer of material that is rigid and not radially deformable yet has a very low coefficient friction. Examples of such material for the coating 193 would include molybdenum dichloride or nylon or polytetrafluoroethylene. Though not visible in the view shown in FIGS. 26-29, the slots 57 also are defined through the coating 193 that covers the cylindrical inner surface of the inner shell 54.

However, in alternative embodiments of the stabilizers 51, 52, it is desirable to form the inner shell 54 of carbon fiber composite material so that the diameter of the inner contacting surface 58 is equal to the diameter of the outer surface 45 of the mandrel 40, whereupon a very fine abrasive can be used against the inner contacting surface 58 to remove only enough material from the inner contacting surface 58 until the inner contacting surface 58 easily slides over the outer surface 45 of the mandrel 40 during mounting and dismounting of the bridge sleeve 30 onto and from the mandrel 40.

Referring to FIG. 26, the stabilizer 51 at the machine end of a so-called piped air embodiment of a bridge sleeve 30 employing a manually actuatable stabilizer 51 includes an inner shell 54 defining an annular recess in the outwardly-facing edge 68 at the largest diameter portion of the conical surface 56. The inwardly facing-end 85 of the machine end cap 81 is rotatably received within that recess formed in the inner shell 54 as the threaded outer surface 83 of the machine end cap 81 is screwed into the mating threaded surface 80 on the interior section of the outer shell 53 that is disposed adjacent the outwardly facing free edge 69 of the outer shell 53.

Referring to FIG. 26, the cylindrical inner surface 126 of the smaller diameter portion of the outer shell 53 is connected to the outer surface 147 of the radially expandable cylindrical inner core 38 via a compressible layer 39, the radial thickness of which is exaggerated larger than life in FIG. 26 for ease of illustration. One end of a radial pin 130 extends radially through the compressible layer 39 and the inner surface 126 of the outer shell 53 and is anchored in a fixed manner (as by being screwed) into the outer shell 53. Though only two of these pins 130 are visible in the view shown in FIG. 26, more than the two shown in FIG. 26 can be provided and arranged symmetrically around the circumference of the bridge sleeve 30 as deemed desirable. The opposite end of each pin 130 is radially and slidably received in a hole 132 that is radially formed through the inner core layer 38. The radial expansion and contraction of the inner core layer 38 is accommodated by the compressible layer 39 and the radial pin 130 that slides within the hole 132 formed through the inner core layer 38. However, the radial pins 130 serve to prevent relative circumferential and/or axial movement between the inner core layer 38 and the machine end stabilizer 51.

Desirably, a conical spring 50 is disposed between the outwardly-facing free edge of the radially expandable cylindrical inner core 38 and the inward-facing edge 59 of the inner shell 54 that defines the narrowest portion of the conical section 56 of the inner shell 54. Though the conical spring 50 is shown contacting the outwardly-facing edge of the cylindrical inner core 38 in the view shown in FIG. 26, an alternative disposition of the conical spring 50 would place one of its sides against the opposing shoulder 153 of the outer shell 53 that faces the inward-facing edge 59 of the inner shell 54. In each case, the conical spring 50 biases the conical surface 56 of the inner shell 54 away from compressive contact with the conical surface 55 of the outer shell and so enables the conical surface 56 of the inner shell 54 to be freed from pressing against and being compressed by the conical surface 55 of the outer shell 53. Because the conical surface 56 of the inner shell 54 is freed of this compressive force of the conical surface 55 of the outer shell 53, the gaps that define the slots 57 formed axially in the inner shell 54 are spread apart to their widest extent. Accordingly, the diameter of the inner contacting surface 58 of the machine end stabilizer 51 attains its maximum diameter, which is sufficiently larger than the diameter of the outer surface 45 of the mandrel 40 to permit the machine end of the bridge sleeve 30 to slide over the outer surface 45 without touching the outer surface 45 of the mandrel 40.

Referring to the embodiment of the operator end of a bridge sleeve shown in FIG. 27 for example, the inner cylindrical surface of an attachment ring 78 is connected to the outer surface 147 of the radially expandable cylindrical inner core 38 via a compressible layer 39. One end of a radial pin 130 extends radially through the compressible layer 39 and the inner surface of the attachment ring 78 and is anchored in a fixed manner (as by being screwed) into the attachment ring 78. The opposite end of the radial pin 130 is radially and slidably received in a hole 132 formed in a radial direction through the inner core layer 38. The outer cylindrical surface 178 of the attachment ring 78 is threaded in a manner complementary to the threaded surface 71 (see FIG. 4) on the interior section of the outer shell 53. Taking account of the direction of rotation of the mandrel 40 and the direction of the substrate that is being printed, the pitch of each of the mating threaded surfaces 178, 71 desirably is arranged to ensure that in the event of a web wrap-up event, the attachment ring 78 acts as a stop that precludes relative rotation between the attachment ring 78 and the outer shell 53.

As shown in FIGS. 27 and 29 for example, the inner face 182 of an actuator ring 180 butts against a shoulder defined in the outwardly facing free edge 69 of the outer shell 53. The inner circumferential surface of an operator end cap 82 is received rotatably within a circumferential groove defined in the outer circumferential surface and outer face 183 of the actuator ring 180. The operator end cap 82 functions as a retainer ring, and the outer circumferential surface 83 of the retainer ring 82 is threaded to be screwed into a mating threaded inner circumferential surface 80 defined in the outer shell 53 (see FIG. 4).

In order to limit circumferential relative rotation between the attachment ring 78 and the inner shell 54 of the embodiment shown in FIG. 27, a rotation stop pin 171, which desirably is a rigid, solid cylindrically shaped member formed of material such as steel for example, can be provided. As shown in the embodiment depicted in FIGS. 27 and 29 for example, a rotation stop pin 171 has one end inserted in an axial direction through the outer face 179 of the attachment ring 78 and fixed therein. The opposite end of the rotation stop pin 171 is received slidably within an arcuately shaped groove 172 that is shown in cross-section in FIGS. 27 and 29 and defined axially into the inward-facing edge 59 of the inner shell 54. The radial width of the groove 172 is just slightly larger than the diameter of the rotation stop pin 171. In the embodiments of the inner shell 54 shown in FIGS. 27 and 29, the inward-facing edge 59 borders the largest diameter portion of the conical surface 56 of the inner shell 54. The groove 172 desirably extends circumferentially for a relatively short arcuate length of no more than about 5 degrees, which is sufficient to ensure that the assembler can easily align the end of the rotation stop pin 171 that projects outwardly from the outer face 179 of the attachment ring 78 into the groove 172. The axial depth of the arcuately shaped groove 172 must allow for the axial movement of the inner shell 54 that is necessary to expand and contract the diameter of the inner contacting surface 58 by the magnitude that is required to provide clearance from and contact with the outer surface 45 of the mandrel 40. Thus, as shown in FIGS. 27 and 29 for example, the rotation stop pin 171 slideably connects the inner core 38 to the inner shell 54 of one of the stabilizers 52 in a manner permitting axial movement between the respective inner shell 54 and outer shell 53 of the stabilizer 52 that is needed to effectuate diametrical expansion and contraction of the inner core 38.

As shown in FIGS. 27 and 29, the exterior circumferential surface of the end of the inner shell 54 nearest to the outwardly-facing edge 68 carries a threaded surface 61 that mates with the threaded surface 187 on the larger diameter inner circumferential surface of the actuator ring 180, which has a plurality of key slots 181 defined in the outer face 183. A key (not shown) in the form of a cross is provided with feet that fit into the key slots 181 formed in the outer face 183 of the actuator ring 180. When the cross key (not shown) is inserted into the key slots 181 and the operator rotates the actuator ring 180 by means of force applied to the cross key in a first circumferential direction, the inner shell 54 moves axially inwardly toward the center of the bridge sleeve 30 and the rotation stop pin 171 moves deeper into the arcuate groove 172 in the inward-facing edge 59 of the inner shell 54. This movement of the inner shell 54 toward the center of the bridge sleeve 30 moves the conical surface 56 of the inner shell 54 away from the conical surface 55 of the outer shell 53, thereby eliminating the compressive effect of the conical surface 55 of the outer shell 53 against the conical surface 56 of the inner shell 54. This elimination of the circumferential and radial compression of the conical surface 56 of the inner shell 54 has the effect of allowing the slots 57 of the inner shell 54 to expand to their maximum circumferential gaps (shown in FIG. 24 for example). Accordingly, the diameter of the inner contacting surface 58 of the inner shell 54 increases commensurately to a diameter that is greater than the diameter of the outer surface 45 of the mandrel 40 in FIG. 27 or greater than the diameter of the inner surface 148 of the radially expandable cylindrical inner core 38 in FIG. 29, even in the latter's radially expanded state under the influence of any pressurized air cushion as shown in FIG. 27. Thus, the operator end stabilizer 52 of the bridge sleeve is configured so as to be ready to be air mounted to the mandrel 40.

As schematically shown in FIG. 26, as the bridge sleeve 30 is air mounted onto the mandrel 40, the stabilizer 51 at the machine end of the bridge sleeve 30 eventually contacts the inwardly-facing surface 144 of the shoulder 141 of the mandrel 40. In particular, the outwardly-facing edge 68 of the inner shell 54 contacts the inwardly-facing surface 144 of the shoulder 141. Once this contact is made, the inner shell 54 is pushed toward the center of the bridge sleeve 30 in an axially directed shimming action in a manner that causes the conical surface 55 of the outer shell to press against and compress the conical surface 56 of the inner shell 54. Such compression closes the gaps that define the slots 57 formed in the inner shell 54 and in so doing reduces the diameter of the inner contacting surface 58 of the inner shell 54 until the inner contacting surface 58 comes into direct and solid contact with the outer surface 45 of the mandrel 40. Desirably, the clearance between the contact surface 143 of the pusher plate 142 of the print machine (not shown in FIG. 26) and the outwardly-facing free edge 69 of the outer shell 53 can be set in relation to the desired maximum axial compression of the conical spring 50 so that the pusher plate 142 is disposed to stop axial movement of the bridge sleeve 30 before the maximum axial compression of the conical spring 50 has been exceeded.

Then as schematically shown in FIG. 27, the actuator ring 180 is rotated circumferentially in the direction that pulls the inner shell 54 outwardly away from the attachment ring 78 and toward the conical surface 55 of the outer shell 53 so that the conical surface 56 of the inner shell 54 is forced against the conical surface 55 of the outer shell 53. This movement of the inner shell 54 has the effect of causing the conical surface 55 of the outer shell 53 to compress the conical surface 56 of the inner shell 54 circumferentially and radially, thereby causing the slots 57 (not shown in FIG. 27) of the inner shell 54 to become narrowed with a commensurate reduction in the diameter of the inner contacting surface 58 of the inner shell 54. Such circumferential and radial compression of the conical surface 56 commensurately reduces the diameter of the inner contacting surface 58 of the inner shell 54 until there is positive, incompressible direct contact between the inner contacting surface 58 of the inner shell 54 and the outer surface 45 of the mandrel 40 as well as positive, incompressible direct contact between the conical surface 55 of the outer shell 53 and the conical surface 56 of the inner shell 54. At this point both stabilizers 51, 52 are configured and disposed to ensure contact between the outer surface 45 of the mandrel 40 and the outer surface 35 of the bridge sleeve 30 wherein such contact is rigid, continuous, incompressible, positive and direct.

As shown in FIG. 26 for example, a build-up annular member 120 can be disposed between the outer surface 122 of the outer shell 53 and the inner cylindrical surface 124 of the rigid carbon fiber outer layer 37. Alternatively, the outer surface 122 of the outer shell 53 can be connected to the inner cylindrical surface 124 of the rigid carbon fiber outer layer 37. As shown in the embodiment depicted in FIG. 26 for example, an air flow conduit 505 is defined axially through the annular build-up member 120. The outwardly facing end of the axial air flow conduit 505 is defined by a pressure tight receptacle 133 that can be connected to a supply 47 of pressurized air for mounting the print sleeve 41. The inwardly facing end of the axial air flow conduit 505 desirably is connected by a press fitted connector 104 to one opposite end of a pressurized air pipe 75. As shown in FIG. 27 for example, the opposite end of the pressurized air pipe 75 extends to the operator end of the bridge sleeve 30. A pressure fitted connector 104 desirably connects that end of the pressurized air pipe 75 to another air flow conduit 505 that extends axially through the build-up annual member 120 at the operator end of the bridge sleeve 30. As shown in each of FIGS. 26 and 27 for example, an identical second arrangement of air flow conduit 505, connector 104 and pipe 75 is disposed 180 degrees around the circumference of the bridge sleeve 30. In order to maintain the pressure in the pressurized air circuit for mounting the print sleeve onto the bridge sleeve 30, one of the pressure tight receptacles 133 can be connected to an air-tight sealing cap (not shown).

As shown in FIG. 27 for example, a build-up annular member 120 can be disposed between the outer surface 122 of the outer shell 53 and the inner cylindrical surface 124 of the rigid carbon fiber outer layer 37. Alternatively, the outer surface 122 of the outer shell 53 can be connected to the inner cylindrical surface 124 of the rigid carbon fiber outer layer 37. As shown in the embodiment depicted in FIG. 27 for example, an air flow conduit 505 is defined axially through the annular build-up member 120 and terminates in a radial air flow conduit 509 that feeds into a circumferentially extending air flow distribution recess 507 that is defined in the outer surface 123 of the annular build-up member 120. An identical arrangement of air flow conduit 505 and radial air flow conduit 509 that feeds into the circumferentially extending air flow distribution recess 507 is disposed 180 degrees around the circumference of the bridge sleeve 30. The air flow distribution recess 507 is connected to the inner open ends of a plurality of radial passages 136 that are defined radially through the rigid outermost layer 37 of the bridge sleeve 30 and terminate at the outer surface 35 of the bridge sleeve 30 in a respective air discharge hole 36 through which compressed air can be supplied to the outer surface 35 of the bridge sleeve 30 for purposes of air mounting the print sleeve 41 (not shown in FIG. 27).

Referring to FIG. 28, the stabilizer 51 at the machine end of a so-called flow through air embodiment of a bridge sleeve 30 employing a manually actuatable stabilizer 51 includes an inner shell 54 defining an annular recess in the outwardly-facing edge 68 at the largest diameter portion of the conical surface 56. The inwardly facing-end 85 of the machine end cap 81 is rotatably received within that recess formed in the inner shell 54 as the threaded outer surface 83 of the machine end cap 81 is screwed into the mating threaded surface 80 on the interior circumferential section of the outer shell 53 that is disposed adjacent the outwardly facing free edge 69 of the outer shell 53.

Referring to FIG. 28, the cylindrical inner surface 126 having the smaller diameter portion of the outer shell 53 is connected to the outer surface 147 of the radially expandable cylindrical inner core 38 via a compressible layer 39, the radial thickness of which is exaggerated larger than life in FIG. 28 for ease of illustration. One end of a radial pin 130 extends radially through the compressible layer 39 and the inner surface 126 of the outer shell 53 and is anchored in a fixed manner (as by being screwed) into the outer shell 53. Though only two of these pins 130 are visible in the view shown in FIG. 28, more than the two pins 130 shown in FIG. 28 can be provided and arranged symmetrically around the circumference of the bridge sleeve 30 as deemed desirable. The opposite end of each pin 130 is radially and slidably received in a hole 132 that is radially formed through the inner core layer 38. The radial expansion and contraction of the inner core layer 38 is accommodated by the compressible layer 39 and the radial pin 130 that slides within the hole 132 formed through the inner core layer 38. However, the radial pins 130 serve to prevent relative circumferential and/or axial movement between the inner core layer 38 and the machine end stabilizer 51.

Desirably, a conical spring 50 is disposed between the outwardly-facing shoulder 153 of the smaller diameter section of the outer shell 53 and the inward-facing edge 59 of the inner shell 54 that defines the narrowest portion of the conical section 56 of the inner shell 54. As shown in the embodiment of FIG. 28, at least part of one side of the conical spring 50 is disposed against the opposing shoulder 153 of the outer shell 53 that faces the inward-facing edge 59 of the inner shell 54. Alternatively, one entire side of the conical spring 50 is disposed against the opposing shoulder 153 of the outer shell 53 that faces the inward-facing edge 59 of the inner shell 54. In each case, the conical spring 50 biases the conical surface 56 of the inner shell 54 away from compressive contact with the conical surface 55 of the outer shell and so enables the conical surface 56 of the inner shell 54 to be freed from pressing against and being compressed by the conical surface 55 of the outer shell 53. Because the conical surface 56 of the inner shell 54 is freed of this compressive force of the conical surface 55 of the outer shell 53, the gaps that define the slots 57 formed axially in the inner shell 54 are spread apart to their widest extent. Accordingly, the diameter of the inner contacting surface 58 of the machine end stabilizer 51 attains its maximum diameter, which is sufficiently larger than the expanded diameter of the outer surface 147 of the inner core layer 38 to permit a cushion of pressurized air between the inner surface 148 of the inner core layer 38 and the inner contacting surface 58. This cushion of pressurized air expands the inner surface 148 of the inner core layer 38 sufficiently to permit the machine end of the bridge sleeve 30 to slide over the outer surface 45 of the mandrel 40 without touching the outer surface 45 of the mandrel 40.

Referring to the embodiment of the operator end of a bridge sleeve shown in FIG. 29 for example, the inner cylindrical surface of an attachment ring 78 is connected to the outer surface 147 of the radially expandable cylindrical inner core 38 via a compressible layer 39. One end of a radial pin 130 extends radially through the compressible layer 39 and the inner surface of the attachment ring 78 and is anchored in a fixed manner (as by being screwed) into the attachment ring 78. The opposite end of the radial pin 130 is radially and slidably received in a hole 132 formed through the inner core layer 38. The outer cylindrical surface 178 of the attachment ring 78 is threaded in a manner complementary to the threaded surface 80 on the interior section of the outer shell 53. Taking account of the direction of rotation of the mandrel 40 and the direction of the substrate that is being printed, the pitch of the mating threaded surfaces 178, 80 is arranged to ensure that in the event of a web wrap-up event, the attachment ring 78 acts as a stop that precludes relative rotation between the attachment ring 78 and the outer shell 53.

The inner face 182 of an actuator ring 180 butts against a shoulder defined in the outwardly facing free edge 69 of the outer shell 53. The inner circumferential surface of a retainer ring 82 is received within a circumferential groove defined in the outer surface and outer face 183 of the actuator ring 180. The operator end cap 82 functions as a retainer ring, and the outer surface 83 of the retainer ring 82 is threaded to be screwed into a mating threaded inner circumferential surface 80 defined in the outer shell 53.

In order to limit circumferential relative rotation between the attachment ring 78 and the inner shell 54 of the embodiment shown in FIG. 29, a rotation stop pin 171 has one end inserted in an axial direction through the outer face 179 of the attachment ring 78 and fixed therein (as by being screwed into a threaded opening therein) while the opposite end of the rotation stop pin 171 is received slidably within an arcuately shaped groove 172 that is defined axially into the inward-facing edge 59 of the inner shell 54. In this embodiment of the inner shell 54 shown in FIG. 29, the inward-facing edge 59 borders the largest diameter portion of the conical surface 56 of the inner shell 54. The groove 172 desirably extends in the circumferential direction for a relatively short arcuate length of no more than about 5 degrees, which is sufficient to ensure that the assembler can easily align the end of the rotation stop pin 171 that projects outwardly from the outer face 179 of the attachment ring 78 into the groove 172. The axial depth of the arcuately shaped groove 172 must allow for the axial movement of the inner shell 54 that is necessary to expand and contract the diameter of the inner contacting surface 58 by the magnitude that is required to provide clearance from and contact with the outer surface 147 of the radially expandable cylindrical inner core 38 of the bridge sleeve 30.

As shown in FIG. 29, the exterior surface 61 of the end of the inner shell 54 nearest to the outwardly-facing edge 68 carries a threaded surface 61 that mates with the threaded surface 187 on the larger diameter inner surface of the actuator ring 180, which has a plurality of key slots 181 defined in the outer face 183. A key (not shown) in the form of a bar or a cross is provided with feet (two for a bar or four for a cross, respectively) that fit into the key slots 181 formed in the outer face 183 of the actuator ring 180. When the cross key (not shown) is inserted into the key slots 181 and the operator rotates the actuator ring 180 by means of force applied to the cross key in a first circumferential direction, the inner shell 54 moves axially inwardly toward the center of the bridge sleeve 30 and the rotation stop pin 171 moves deeper into the arcuate groove 172 in the inward-facing edge 59 of the inner shell 54.

As shown in FIG. 29, axially inward movement of the inner shell 54 toward the center of the bridge sleeve 30 moves the conical surface 56 of the inner shell 54 away from the conical surface 55 of the outer shell 53, thereby eliminating the compressive effect of the conical surface 55 of the outer shell 53 against the conical surface 56 of the inner shell 54. This elimination of the circumferential and radial compression of the conical surface 56 of the inner shell 54 has the effect of allowing the slots 57 of the inner shell 54 to expand to their maximum circumferential gaps (shown in FIG. 24 for example). Accordingly, the diameter of the inner contacting surface 58 of the inner shell 54 increases commensurately to a diameter that is greater than the diameter of the outer surface 147 of the radially expandable cylindrical inner core 38, even in the latter's radially expanded state under the influence of any pressurized air cushion as shown in FIG. 29. Thus, the operator end stabilizer 52 of the bridge sleeve 30 is configured so as to be ready to be air mounted to the mandrel 40.

As schematically shown in FIG. 28, as the bridge sleeve 30 is air mounted onto the mandrel 40, the stabilizer 51 at the machine end of the bridge sleeve 30 eventually contacts the inwardly-facing surface 144 of the shoulder 141 of the mandrel 40. In particular, the outwardly-facing edge 68 of the inner shell 54 contacts the inwardly-facing surface 144 of the shoulder 141. Once this contact is made, the inner shell 54 is pushed toward the center of the bridge sleeve 30 in a manner that causes the conical surface 55 of the outer shell to press against and compress the conical surface 56 of the inner shell 54. Such compression closes the gaps that define the slots 57 formed in the inner shell 54 and in so doing reduces the diameter of the inner contacting surface 58 of the inner shell 54 until the inner contacting surface 58 comes into direct and solid contact with the outer surface 147 of the radially expandable cylindrical inner core 38 and causes the inner surface 148 of the radially expandable cylindrical inner core 38 to come into direct and solid contact with the outer surface 45 of the mandrel 40. Desirably, the clearance between the contact surface 143 of the pusher plate 142 of the print machine (not shown in FIG. 28) and the outwardly-facing free edge 69 of the outer shell 53 can be set in relation to the desired maximum axial compression of the conical spring 50 so that the pusher plate 142 is disposed to stop axial movement of the bridge sleeve 30 before the maximum axial compression of the conical spring 50 has been exceeded.

Then after the pressurized air cushion from the mandrel's holes 46 has been turned off and the inner surface 148 of the bridge sleeve's radially expandable cylindrical inner core 38 has shrunk to tightly grip the outer surface 45 of the mandrel 40, the machine end stabilizer 52 of the bridge sleeve 30 can be set into its stabilizing contact orientation. As schematically shown in FIG. 29, the actuator ring 180 is rotated circumferentially in the direction that pulls the inner shell 54 outwardly away from the attachment ring 78 and toward the conical surface 55 of the outer shell 53 so that the conical surface 56 of the inner shell 54 is forced against the conical surface 55 of the outer shell 53.

As shown schematically in FIG. 29, axially outward movement of the inner shell 54 has the effect of causing the conical surface 55 of the outer shell 53 to compress the conical surface 56 of the inner shell 54 circumferentially and radially, thereby causing the slots 57 (not shown in FIG. 29) of the inner shell 54 to become narrowed with a commensurate reduction in the diameter of the inner contacting surface 58 of the inner shell 54. Such reduction in the diameter of the inner contacting surface 58 of the inner shell 54 can continue until there is positive direct contact between the inner contacting surface 58 of the inner shell 54 and the outer surface 147 of the radially expandable cylindrical inner core 38, between the inner surface 148 of the radially expandable cylindrical inner core 38 and the outer surface 45 of the mandrel as well as positive direct contact between the conical surface 55 of the outer shell 53 and the conical surface 56 of the inner shell 54. At this point both stabilizers 51, 52 are configured and disposed to ensure rigid, continuous positive direct contact between the outer surface 45 of the mandrel 40 and the outer surface 35 of the bridge sleeve 30.

As shown in FIG. 28 for example, a build-up annular member 120 can be disposed between the outer surface 122 of the outer shell 53 and the inner cylindrical surface 124 of the rigid carbon fiber outer layer 37. Alternatively, the outer surface 122 of the outer shell 53 can be connected to the inner cylindrical surface 124 of the rigid carbon fiber outer layer 37.

As shown in dashed line in FIG. 29 for example, a build-up annular member 120 can be disposed between the outer surface 122 of the outer shell 53 and the inner cylindrical surface 124 of the rigid carbon fiber outer layer 37. Alternatively, as shown in solid line in FIG. 29 for example, the outer surface 122 of the outer shell 53 can be connected to the inner cylindrical surface 124 of the rigid carbon fiber outer layer 37.

As is conventional in the art and shown in solid line in FIG. 29 for example, the so-called operator end of the mandrel 40 desirably can be provided with a circumferentially extending groove 116 and a plurality of air holes 46 through which compressed air can be supplied to the outer surface 45 of the mandrel 40 from a supply 47 of pressurized air (e.g., FIG. 1) that can be associated with the printing machine or can be available in the facility that houses the printing machine. When the bridge sleeve 30 is properly aligned on the mandrel 40, the inner end of each of a plurality of air entrance bores 157 that are drilled radially through the radially expandable cylindrical inner core 38 at the operator end stabilizer 52 of the embodiment depicted in FIG. 29 for example, will be aligned in fluid communication with the groove 116 and air holes 46 of the mandrel 40. Desirably six to eight air entrance bores 157 are disposed symmetrically about the circumference of the bridge sleeve 30 at the operator end thereof. Larger diameter bridge sleeves can have more than eight of these air entrance bores 157 disposed symmetrically about the circumference of the bridge sleeve 30 at the operator end thereof. A flow of pressurized air expelled from the holes 46 of the mandrel 40 will fill the groove 116 and enter the air entrance bores 157 at the operator end of the bridge sleeve 30.

As schematically shown in FIG. 29, the outer end of each of the plurality of air entrance bores 157 communicates with the inner end of a radial air channel 188 that is defined radially through the actuator ring 180. Desirably six to eight radial air channels 188 are disposed symmetrically about the circumference of the bridge sleeve 30 at the operator end thereof. As schematically shown in FIG. 29, the inner ends of each of the radial air channels 188 communicates with a circumferential recess 156 that desirably is formed in the smaller diameter inner surface of the actuator ring 180 to eliminate the need for precise alignment between the central axes of the radial air channels 188 and the air entrance bores 157.

Desirably, as shown in FIG. 29, two circumferential grooves 189 are formed axially spaced apart from one another in the smaller diameter inner surface of the actuator ring 180. One of the grooves 189 is disposed near each opposite side of the circumferential recess 156, and each groove 189 receives therein a pressure sealing gasket 129, which desirably can be provided in the form of an O-ring. The gaskets 129 serve to ensure that all of the pressurized air leaving the air entrance bores 157 of the radially expandable cylindrical inner core 38 enters the radial air channels 188 of the actuator ring 180.

As schematically shown in FIG. 29, the outer end of each of the plurality of radial air channels 188 communicates with the inner end of a radial air channel 158 that is defined radially through the outer shell 53. Desirably six to eight radial air channels 158 are disposed symmetrically about the circumference of the bridge sleeve 30 at the operator end thereof, but the number can vary depending on the diameter of the bridge sleeve 30. As schematically shown in FIG. 29, a circumferential recess 155 desirably is formed in the larger diameter inner surface of the outer shell 53 at the inner ends of the radial air channels 158 to eliminate the need for precise alignment between the central axes of the radial air channels 158 in the outer shell 53 and the radial air channels 158 in the actuator ring 180.

As schematically shown in FIG. 29, the outer end of each of the plurality of radial air channels 158 that is defined radially through the outer shell 53 communicates with the inner end of a radial passage 136 that is defined radially through the rigid outermost layer 37 of the bridge sleeve 30. Desirably six to eight radial air passages 136 are disposed symmetrically about the circumference of the bridge sleeve 30 at the operator end thereof, but the number can vary depending on the diameter of the bridge sleeve 30. Each radial air passage 136 terminates at its outer end in one of the holes 36 through which compressed air can be supplied to the outer surface 35 of the bridge sleeve 30. As schematically shown in FIG. 29, a circumferential recess 154 desirably is formed in the outer surface 122 of the outer shell 53 at the outer ends of the radial air channels 158 to eliminate the need for precise alignment between the central axes of the radial air channels 158 in the outer shell 53 and the radial air passages 136 in the outermost layer 37 of the bridge sleeve 30.

Alternatively, as shown in dashed line in FIG. 29, the outer end of each of the plurality of radial air channels 158 that is defined radially through the outer shell 53 communicates with the inner end of a radial passage 146 that is defined radially through the build-up annular member 120 of the bridge sleeve 30. Desirably six to eight radial air passages 146 are disposed symmetrically about the circumference of the bridge sleeve 30 at the operator end thereof, but the number can vary depending on the diameter of the bridge sleeve 30. As schematically shown in FIG. 29, a circumferential recess 154 desirably is formed in the outer surface 122 of the outer shell 53 at the outer ends of the radial air channels 158 to eliminate the need for precise alignment between the central axes of the radial air channels 158 in the outer shell 53 and the central axes of the radial air passages 146 in the build-up annular member 120 of the bridge sleeve 30. As shown in dashed line in FIG. 29, the outer end of each of the plurality of radial air passages 146 in the build-up annular member 120 communicates with the inner end of a radial passage 136 that is defined radially through the rigid outermost layer 37 of the bridge sleeve 30. Desirably six to eight radial air passages 136 are disposed symmetrically about the circumference of the bridge sleeve 30 at the operator end thereof, but the number can vary depending on the diameter of the bridge sleeve 30. Each radial air passage 136 terminates at its outer end in one of the holes 36 through which compressed air can be supplied to the outer surface 35 of the bridge sleeve 30. As schematically shown in dashed line in FIG. 29, a circumferential recess 152 desirably is formed in the outer surface 123 of the build-up annular member 120 at the outer ends of the radial air passages 146 to eliminate the need for precise alignment between the central axes of the radial air passages 136 in the outermost layer 37 of the bridge sleeve 30 and the central axes of the radial air passages 146 in the build-up annular member 120 of the bridge sleeve 30.

Thus, the pressurized air flow leaving the air holes 46 in the outer surface 45 of the mandrel 40 is evenly distributed around the groove 116 formed circumferentially in the outer surface 45 of the mandrel 40 and enters the bridge sleeve 30 via the inner ends of the plurality of air entrance bores 157 that are drilled radially through the radially expandable cylindrical inner core 38 at the operator end stabilizer 52 of the embodiment depicted in FIG. 29. The pressurized air is directed radially to the outer surface 35 of the bridge sleeve 30 and exits through the holes 36 in the outer cylindrical surface 135 of the rigid carbon fiber outer layer 37 of the bridge sleeve 30 for purposes of air mounting the print sleeve 41 (not shown in FIG. 29).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A bridge sleeve on which a print sleeve can be air-mounted, the bridge sleeve defining a through bore that is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve; and f. a pressurized air circuit extending axially between the stabilizers and including at least one air-flow check valve; and g. wherein the diameter of the respective inner cylindrical contacting surface changes as the respective inner shell moves axially relative to the respective rigid outer shell.

2. The bridge sleeve as in claim 1, wherein each inner shell of each stabilizer defines an exterior surface and at least some portion of the exterior surface of each inner shell defines an outer conical surface disposed slidably in opposition to the inner conical surface of the respective outer shell of each stabilizer.

3. A bridge sleeve as in claim 1, further comprising:

a. a first spring disposed in the first stabilizer;

b. a second spring disposed in the second stabilizer; and c. wherein the diameter of the respective inner cylindrical contacting surface of each respective inner shell changes according to the magnitude of the compression of the respective spring.

4. A bridge sleeve as in claim 1, further comprising:

a. a first fixed ring that is disposed in the first stabilizer;

b. a first displacement ring disposed in the first stabilizer, the first displacement ring being disposed adjacent the first fixed ring and moveable with respect to the first fixed ring;

c. a second fixed ring that is disposed in the second stabilizer;

d. a second displacement ring disposed in the second stabilizer, the second displacement ring being disposed adjacent the second fixed ring and moveable with respect to the second fixed ring; and e. wherein the diameter of the respective inner cylindrical contacting surface of the respective stabilizer changes as the magnitude of the distance between the respective stabilizer's fixed ring and displacement ring changes.

5. The bridge sleeve as in claim 4, further comprising a first spring disposed between the first fixed ring and the first displacement ring of the first stabilizer.

6. The bridge sleeve as in claim 4, wherein at least one of the stabilizers has its inner shell connected to its respective displacement ring and has its outer shell connected to its respective fixed ring.

7. The bridge sleeve as in claim 1, wherein a plurality of slots is defined through each inner shell of each stabilizer.

8. The bridge sleeve as in claim 7, wherein each of a plurality of slots extends axially from one of the opposite ends of the inner shell but terminates before reaching the opposite end of the inner shell.

9. The bridge sleeve as in claim 1, further comprising:

a. a manually actuatable actuator ring defining a threaded inner circumferential surface and received in and rotatable with respect to the first stabilizer;

b. wherein the inner shell of the first stabilizer defines an axially outwardly facing free end having an exterior circumferential section on which is defined a threaded surface onto which the actuator ring is screwed via the threaded inner circumferential surface of the actuator ring, and wherein the diameter of the inner cylindrical contacting surface of the first stabilizer changes according to the degree to which the actuator ring is screwed onto the inner shell.

10. A bridge sleeve on which a print sleeve can be air-mounted, the bridge sleeve defining a through bore that is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve;

f. a pressurized air circuit extending axially between the stabilizers and including at least one air-flow check valve; and g. wherein the diameter of the respective inner cylindrical contacting surface changes as the respective inner shell moves axially relative to the respective rigid outer shell; and h. wherein the diameter of the respective inner cylindrical contacting surface of each respective inner shell changes according to the magnitude of the pressure in the pressurized air circuit.

11. A bridge sleeve on which a print sleeve can be air-mounted, the bridge sleeve defining a through bore that is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve;

f. a first spring disposed in the first stabilizer;

g. a second spring disposed in the second stabilizer; and h. a pressurized air circuit extending axially between the stabilizers and including at least one air-flow check valve; and i. wherein the diameter of the respective inner cylindrical contacting surface of each respective inner shell changes as the respective inner shell moves axially relative to the respective rigid outer shell and according to the magnitude of the compression of the respective spring; and j. wherein the degree of compression of each spring varies according to the magnitude of the pressure in the pressurized air circuit.

12. A bridge sleeve on which a print sleeve can be air-mounted, the bridge sleeve defining a through bore that is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve;

f. a first spring disposed in the first stabilizer;

g. a second spring disposed in the second stabilizer; and h. wherein the diameter of the respective inner cylindrical contacting surface of each respective inner shell changes as the respective inner shell moves axially relative to the respective rigid outer shell and according to the magnitude of the compression of the respective spring; and wherein at least one of the first and second springs is a conical spring.

13. A bridge sleeve on which a print sleeve can be air-mounted, the bridge sleeve defining a through bore that is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve; and f. a first spring disposed in the first stabilizer between the inner shell and the outer shell of the first stabilizer; and g. a second spring disposed in the second stabilizer; and h. wherein the diameter of the respective inner cylindrical contacting surface of each respective inner shell changes as the respective inner shell moves axially relative to the respective rigid outer shell and according to the magnitude of the compression of the respective spring.

14. The bridge sleeve as in claim 13, further comprising:

a. an annular end cap defining a threaded outer circumferential surface;

b. wherein the outer shell of the first stabilizer defines an axially outwardly facing free end having an interior section on which is defined a threaded surface onto which the end cap is screwed via the threaded outer circumferential surface of the end cap, wherein the inner shell of the first stabilizer defines an axially outwardly facing free end having a recess within which the end cap is rotatably received as the threaded outer circumferential surface of the end cap is screwed into the mating threaded surface on the interior section of the outer shell, and wherein each of the degree of compression of the first spring and the diameter of the inner cylindrical contacting surface of the inner shell of the first stabilizer varies with the degree to which the end cap is screwed onto the outer shell.

15. The bridge sleeve as in claim 14, wherein the annular end cap defines at least one key slot that is configured to receive therein a key that facilitates manual rotation of the annular end cap to vary the diameter of the inner cylindrical contacting surface of the inner shell of the first stabilizer.

16. A bridge sleeve on which a print sleeve can be air-mounted, the bridge sleeve defining a through bore that is open at each opposite end so that the bridge sleeve is air-mountable on a mandrel of a printing machine, the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve;

f. a first fixed ring that is disposed in the first stabilizer;

g. a first displacement ring disposed in the first stabilizer, the first displacement ring being disposed adjacent the first fixed ring and moveable with respect to the first fixed ring;

h. a first groove configured in an exterior surface of the first displacement ring, and a first pressure sealing O-ring disposed in this first groove;

i. a second groove configured in an interior surface of the first fixed ring, and a second pressure sealing O-ring disposed in this second groove;

j. a second fixed ring that is disposed in the second stabilizer;

k. a second displacement ring disposed in the second stabilizer, the second displacement ring being disposed adjacent the second fixed ring and moveable with respect to the second fixed ring; and l. wherein the diameter of the respective inner cylindrical contacting surface of the respective stabilizer changes as the respective inner shell moves axially relative to the respective rigid outer shell and as the magnitude of the distance between the respective stabilizer's fixed ring and displacement ring changes; and m. wherein at least one of the stabilizers has its inner shell connected to its respective displacement ring and has its outer shell connected to its respective fixed ring.

17. A bridge sleeve on which a print sleeve can be air-mounted, the bridge sleeve defining a through bore that is open at each opposite end so that the bridge sleeve is air-mountable on a mandrel of a printing machine, further the bridge sleeve comprising:

a. an incompressible outer layer defining a hollow, cylindrically shaped member and a first end and a second end displaced axially from the first end, the incompressible outer layer further defining an outer surface extending axially between the two ends and configured for contacting the inner surface of a print sleeve;

b. a first stabilizer at one end of the bridge sleeve and carrying the first end of the incompressible outer layer;

c. a second stabilizer axially displaced from the first stabilizer and carrying the second end of the incompressible outer layer;

d. each stabilizer includes a rigid outer shell that has an axially extending inner cavity that is partially defined by a rigid inner surface with a section defining an inner conical surface;

e. each stabilizer includes a respective inner shell that is axially, moveably received within the respective axially extending inner cavity of the respective rigid outer shell, and wherein each respective inner shell defines a respective inner cylindrical contacting surface that faces away from the rigid outer shell and toward the through bore of the bridge sleeve; and f. an inner core that is axially extending, cylindrically shaped and defining a portion of the through bore of the bridge sleeve between each of a first end and a second end displaced axially from the first end, each of the first end and second end of the inner core being open, the first end of the inner core being connected to the first stabilizer and the second end of the inner core being connected to the second stabilizer, wherein the inner core is resiliently, diametrically expandable and resiliently, diametrically contractable; and g. wherein the diameter of the respective inner cylindrical contacting surface changes as the respective inner shell moves axially relative to the respective rigid outer shell.

18. The bridge sleeve as in claim 17, further comprising:

a. at least one radial pin extending in a normal direction with respect to the axially extending inner core, the at least one radial pin slideably connecting the inner core to a first one of the stabilizers in a manner permitting diametrical expansion and contraction of the inner core.

19. The bridge sleeve as in claim 18, further comprising:

a. at least a one rotation stop pin extending in a parallel direction with respect to the axially extending inner core, the at least one rotation stop pin slideably connecting the inner core to the first one of the stabilizers in a manner permitting axial movement between the respective inner shell and outer shell of the first stabilizer.

20. The bridge sleeve as in claim 19, further comprising:

a. a manually actuatable actuator ring defining a threaded inner circumferential surface and received in and rotatable with respect to the first stabilizer;

b. wherein the inner shell of the first stabilizer defines an axially outwardly facing free end having an exterior circumferential section on which is defined a threaded surface onto which the actuator ring is screwed via the threaded inner circumferential surface of the actuator ring, and wherein the diameter of the inner cylindrical contacting surface of the first stabilizer changes according to the degree to which the actuator ring is screwed onto the inner shell.

21. A bridge sleeve that is air-mountable on the exterior surface of a mandrel of a printing machine and on which bridge sleeve a print sleeve can be air-mounted, the bridge sleeve comprising:

a. an incompressible outer layer defining a first end and a second end displaced axially from the first end and defining an outer surface extending axially between the two ends, the outer surface configured for contacting the inner surface of a print sleeve, the incompressible outer layer;

b. a resiliently, diametrically expandable and contractable inner core defining a first end and a second end displaced axially from the first end and defining a portion of a through bore of the bridge sleeve extending between the first end and the second end, each of the first end and second end being open;

c. a first, rigid stabilizer at one end of the bridge sleeve and connected to the first end of the inner core and the first end of the incompressible outer layer;

d. a second, rigid stabilizer axially displaced from the first stabilizer and connected to the second end of the inner core and the second end of the incompressible outer layer;

e. each stabilizer includes a rigid outer shell that has an axially extending inner cavity that is partially defined by a rigid inner surface with a section defining a conical surface;

f. each stabilizer includes a respective inner shell that defines an inner cylindrical contacting surface that faces away from the rigid outer shell and toward the through bore of the bridge sleeve and each respective inner shell is axially, moveably received within the respective axially extending inner cavity of the respective rigid outer shell so as to change the diameter of the respective inner cylindrical contacting surface of the respective inner shell; and g. wherein when the bridge sleeve is non-rotatably mounted to the mandrel, the axial position of the respective inner shell relative to the respective rigid outer shell is disposed to ensure rigid concentric contact from the exterior surface of the rotary mandrel successively through the inner core, the respective inner shell, the respective rigid outer shell and the incompressible outer layer.

22. A bridge sleeve as in claim 21, further comprising:

a. a first fixed ring that is attached to the outer shell of the first stabilizer and selectively detachable therefrom;

b. a first displacement ring attached to the inner shell of the first stabilizer and selectively detachable therefrom, the first displacement ring being disposed adjacent the first fixed ring and moveable with respect to the first fixed ring;

c. a second fixed ring that is attached to the outer shell of the second stabilizer and selectively detachable therefrom;

d. a second displacement ring attached to the inner shell of the second stabilizer and selectively detachable therefrom, the second displacement ring being disposed adjacent the second fixed ring and moveable with respect to the second fixed ring;

e. wherein the diameter of the respective inner cylindrical contacting surface of the respective stabilizer changes as the magnitude of the distance between the respective stabilizer's fixed ring and displacement ring changes.

23. The bridge sleeve as in claim 22, wherein a plurality of slots is defined through the inner shell of at least the first stabilizer.

24. The bridge sleeve as in claim 23, further comprising: a first spring disposed between the first displacement ring and the first fixed ring so as to resiliently bias the first displacement ring away from the first fixed ring.

* * * * *